US005836703A

United States Patent [19]

Watanabe

[11] Patent Number: 5,836,703

[45] Date of Patent: Nov. 17, 1998

[54] PRINTER SYSTEM WITH AUTOMATIC INK RIBBON CASSETTE EXCHANGE FUNCTION

[75] Inventor: Tadashi Watanabe, Yamatokoriyama, Japan

[73] Assignee: Sharp Kabushiki Kaisha, Osaka, Japan

[21] Appl. No.: 915,411

[22] Filed: Aug. 20, 1997

Related U.S. Application Data

[62] Division of Ser. No. 469,457, Jun. 6, 1995, Pat. No. 5,720, 562.

[30] Foreign Application Priority Data

| | | | |
|---|---|---|---|
| Sep. 1, 1994 | [JP] | Japan | 6-208905 |
| Sep. 1, 1994 | [JP] | Japan | 6-208906 |
| Sep. 22, 1994 | [JP] | Japan | 6-228526 |
| Sep. 22, 1994 | [JP] | Japan | 6-228527 |

[51] Int. Cl.[6] ..... B41J 33/36

[52] U.S. Cl. ..... 400/208; 400/120.01; 400/249

[58] Field of Search ..... 400/194, 195, 400/196, 196.1, 207, 208, 208.1, 171, 492, 242, 247, 120.01, 120.16, 206, 82, 250, 191, 249

[56] References Cited

U.S. PATENT DOCUMENTS

| | | | |
|---|---|---|---|
| 4,281,938 | 8/1981 | Phillips . | |
| 4,469,459 | 9/1984 | Trezise et al. . | |
| 4,569,608 | 2/1986 | Watanabe . | |
| 5,180,236 | 1/1993 | Kitahara et al. | 400/208 |
| 5,267,802 | 12/1993 | Parnell et al. . | |
| 5,631,688 | 5/1997 | Hibino et al. | 400/120.01 |

FOREIGN PATENT DOCUMENTS

| | | | |
|---|---|---|---|
| 2622791 | 2/1997 | Germany . | |
| 60-0072776 | 4/1985 | Japan . | |
| 60-253578 | 12/1985 | Japan . | |
| 61-24482 | 2/1986 | Japan | 400/208 |
| 61-112666 | 5/1986 | Japan . | |
| 62-227781 | 10/1987 | Japan . | |
| 1-218879 | 9/1989 | Japan | 400/208 |
| 2258276 | 10/1990 | Japan . | |
| 3-126575 | 5/1991 | Japan | 400/208 |
| 3187777 | 8/1991 | Japan . | |
| 3187779 | 8/1991 | Japan . | |
| 5169783 | 7/1993 | Japan . | |
| 2268122 | 1/1994 | United Kingdom . | |

OTHER PUBLICATIONS

Abstract of JP–A–60 253578 (Hitachi Seisakusho K.K.), Dec. 14, 1985; *Patent Abstracts of Japan*, Vo.10, No. 126 (M–477) May 10, 1986.

*IBM Technical Disclosure Bulletin*, vol. 32, No. 38, Aug. 1989; "Easily Replaceable Ink Ribbon Cartridge".

*Primary Examiner*—Christopher A. Bennett

[57] ABSTRACT

A printer system includes an ink ribbon end detector for detecting that the ink ribbon cassette has been used to the end; an used ink ribbon cassette holding position memory device for storing therein information indicative of holding position of a used ink ribbon cassette held on a stocker when the ink ribbon cassette end detection means detects that an ink ribbon has been used to the end, and a cassette holding determining device for determining whether or not an ink ribbon cassette whose ink ribbon has not been used is set in the stocker based on holding information. In the printer system having the described arrangement, an optimal available ink ribbon cassette is selected, and in the case of storing plural ink ribbon cassettes in the same color, a continuous printing operation of a large capacity may be performed without using user's hands.

4 Claims, 60 Drawing Sheets

FIG. 18

| LEFT END 1 | CENTER LEFT 2 | CENTER RIGHT 3 | RIGHT END 4 |
|---|---|---|---|

INPUT THE NUMBER FROM LEAST REMAINING AMOUNT.

FIG. 19

| ADDRESS + 0<br>LEFT END | ADDRESS + 1<br>CENTER LEFT | ADDRESS + 2<br>CENTER RIGHT | ADDRESS + 3<br>RIGHT END |
|---|---|---|---|
| 3 | 1 | 2 | 4 |

FIG. 20

| ADDRESS + 4<br>LEFT END | ADDRESS + 5<br>CENTER LEFT | ADDRESS + 6<br>CENTER RIGHT | ADDRESS + 7<br>RIGHT END |
|---|---|---|---|
| 0 | 1 | 1 | 0 |

FIG. 21

| LEFT END 1 | CENTER LEFT 2 | CENTER RIGHT 3 | RIGHT END 4 |
|---|---|---|---|
| | END | END | |

STOCKER HAS END RIBBON CASSETTE.
PLEASE CHANGE WHILE OPENING STOCKER.

| ADDRESS +4 LEFT END | ADDRESS +5 CENTER LEFT | ADDRESS +6 CENTER RIGHT | ADDRESS +7 RIGHT END |
|---|---|---|---|
| BLACK | YELLOW | MAGENTA | CYAN |

FIG. 27

| | |
|---|---|
| 1: BLACK | 5: RED |
| 2: YELLOW | 6: BLUE |
| 3: MAGENTA | 7: GOLD |
| 4: CYAN | 8: SILVER |
| | 9: LABEL CASSETE |

PLEASE INPUT NUMBER.

FIG. 30

| RIBBON TYPE | BLACK | YELLOW | MAGENTA | CYAN | RED | GREEN | BLUE | NO CASSETT |
|---|---|---|---|---|---|---|---|---|
| IDENTIFICATION HOLE 1 | NON-EXISTENCE | EXISTENCE | NON-EXISTENCE | EXISTENCE | NON-EXISTENCE | EXISTENCE | NON-EXISTENCE | — |
| IDENTIFICATION HOLE 2 | NON-EXISTENCE | NON-EXISTENCE | EXISTENCE | EXISTENCE | NON-EXISTENCE | NON-EXISTENCE | EXISTENCE | — |
| IDENTIFICATION HOLE 3 | NON-EXISTENCE | NON-EXISTENCE | NON-EXISTENCE | NON-EXISTENCE | EXISTENCE | EXISTENCE | EXISTENCE | — |
| SENSOR A | ON | OFF | ON | OFF | ON | OFF | ON | OFF |
| SENSOR B | ON | ON | OFF | OFF | ON | ON | OFF | OFF |
| SENSOR C | ON | ON | ON | ON | OFF | OFF | OFF | OFF |

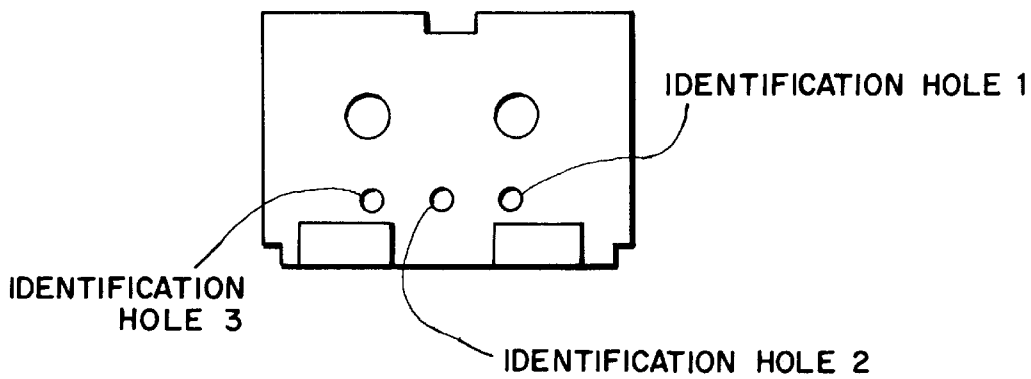

FIG. 34

| RIBBON TYPE | BLACK | YELLOW | MAGENTA | CYAN | RED | GREEN | BLUE | NO CASSETT |
|---|---|---|---|---|---|---|---|---|
| IDENTIFICATION HOLE 1 | NON-EXISTENCE | EXISTENCE | NON-EXISTENCE | EXISTENCE | NON-EXISTENCE | EXISTENCE | NON-EXISTENCE | — |
| IDENTIFICATION HOLE 2 | NON-EXISTENCE | NON-EXISTENCE | EXISTENCE | EXISTENCE | NON-EXISTENCE | NON-EXISTENCE | EXISTENCE | — |
| IDENTIFICATION HOLE 3 | NON-EXISTENCE | NON-EXISTENCE | NON-EXISTENCE | NON-EXISTENCE | EXISTENCE | EXISTENCE | EXISTENCE | — |
| SENSOR A | ON | OFF | ON | OFF | ON | OFF | ON | OFF |
| SENSOR B | ON | ON | OFF | OFF | ON | ON | OFF | OFF |
| SENSOR C | ON | ON | ON | ON | OFF | OFF | OFF | OFF |

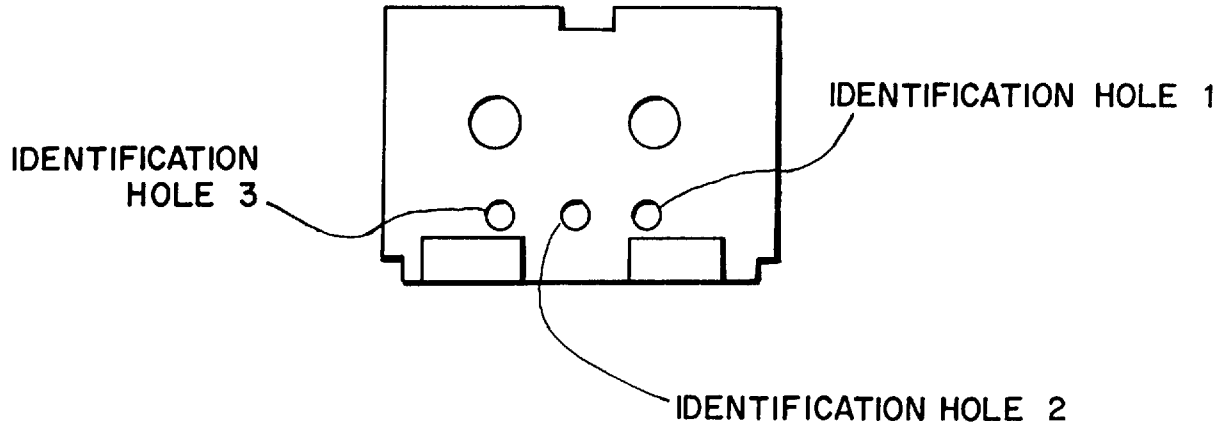

FIG. 41

| LEFT END 5-1-1 | CENTER LEFT 5-1-2 | CENTER RIGHT 5-1-3 | RIGHT END 5-1-4 | CARRIAGE 5-3-1 |
|---|---|---|---|---|
| EXISTENCE | EXISTENCE | NON-EXISTENCE | NON-EXISTENCE | NON-EXISTENCE |

FIG. 42

| LEFT END 5-1-1 | CENTER LEFT 5-1-2 | CENTER RIGHT 5-1-3 | RIGHT END 5-1-4 | CARRIAGE 5-3-1 |
|---|---|---|---|---|
| NON-EXISTENCE | EXISTENCE | NON-EXISTENCE | NON-EXISTENCE | EXISTENCE |

FIG. 43

| PRINTING MODE | LEFT END | CENTER LEFT | CENTER RIGHT | RIGHT END |
|---|---|---|---|---|
| BLACK PRINTING | BLACK | ARBITRARY | ARBITRARY | ARBITRARY |
| TWO COLOR PRINTING | BLACK | COLOR | ARBITRARY | ARBITRARY |
| COLOR PRINTING | BLACK | YELLOW | MAGENTA | CYAN |

FIG. 44

PRINTING MODE : COLOR PRINTING

| LEFT END | CENTER LEFT | CENTER RIGHT | RIGHT END |
|---|---|---|---|
| BLACK | YELLOW | MAGENTA | CYAN |

PLEASE CONFIRM WHETHER THE RESPECTIVE INK RIBBON CASSETTES ARE ATTACHED IN ACCORDANCE WITH THE ABOVE TABLE ?

FIG. 45

1 BLACK
2 YELLOW
3 MAGENTA
4 CYAN
5 RED
6 GREEN
7 BLUE

PLEASE INPUT THE NUMBER OF INK RIBBON CASSETTE OF THE LEFT END.

FIG. 46

| HOLDING POSITION 1 (LEFT END) | HOLDING POSITION 2 (CENTER LEFT) | HOLDING POSITION 3 (CENTER RIGHT) | HOLDING POSITION 4 (RIGHT END) |
|---|---|---|---|
| CYAN | BLACK | MAGENTA | YELLOW |

FIG. 49

| HOLDING POSITION 1 (LEFT END) | HOLDING POSITION 2 (CENTER LEFT) | HOLDING POSITION 3 (CENTER RIGHT) | HOLDING POSITION 4 (RIGHT END) |
|---|---|---|---|
| EXISTENCE | EXISTENCE | NON-EXISTENCE | NON-EXISTENCE |

FIG. 50

| HOLDING POSITION 1 (LEFT END) | HOLDING POSITION 2 (CENTER LEFT) | HOLDING POSITION 3 (CENTER RIGHT) | HOLDING POSITION 4 (RIGHT END) |
|---|---|---|---|
| BLACK | YELLOW | MAGENTA | CYAN |

FIG. 51

| UPPER END SENSOR 5－2－2 | LOWER END SENSOR 5－2－3 | ANGLE OF CAM | UP AND DOWN POSITIONS OF STOCKER |
|---|---|---|---|
| ON | OFF | 0° | UPPER END |
| ON | ON | 0°～180° | INTERIUM |
| OFF | ON | 180° | LOWER END |
| OFF | OFF | 180°～360° (0°) | INTERIUM |

FIG. 59

| HOLDING POSITION 1 LEFT END | HOLDING POSITION 2 CENTER LEFT | HOLDING POSITION 3 CENTER RIGHT | HOLDING POSITION 4 RIGHT END |
|---|---|---|---|
| BLACK | YELLOW | MAGENTA | CYAN |

FIG. 60(a)
| HOLDING POSITION 1 LEFT END 5-1-1 | HOLDING POSITION 2 CENTER LEFT 5-1-2 | HOLDING POSITION 3 CENTER RIGHT 5-1-3 | HOLDING POSITION 4 RIGHT END 5-1-4 |
|---|---|---|---|
| EXISTENCE | EXISTENCE | EXISTENCE | EXISTENCE |
FIG. 60(b)
| HOLDING POSITION 1 LEFT END 5-1-1 | HOLDING POSITION 2 CENTER LEFT 5-1-2 | HOLDING POSITION 3 CENTER RIGHT 5-1-3 | HOLDING POSITION 4 RIGHT END 5-1-4 |
|---|---|---|---|
| NON-EXISTENCE | EXISTENCE | EXISTENCE | EXISTENCE |
FIG. 61
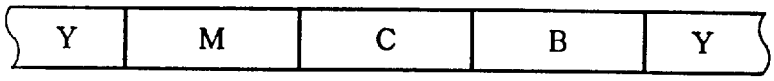
FIG. 62
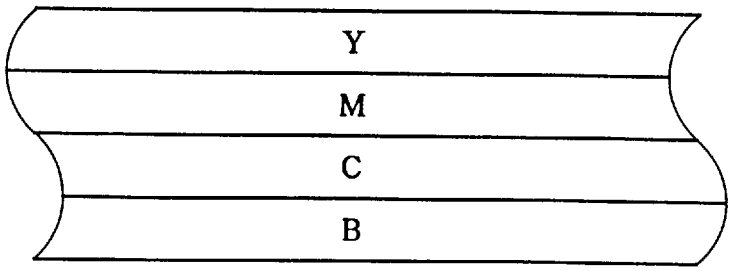

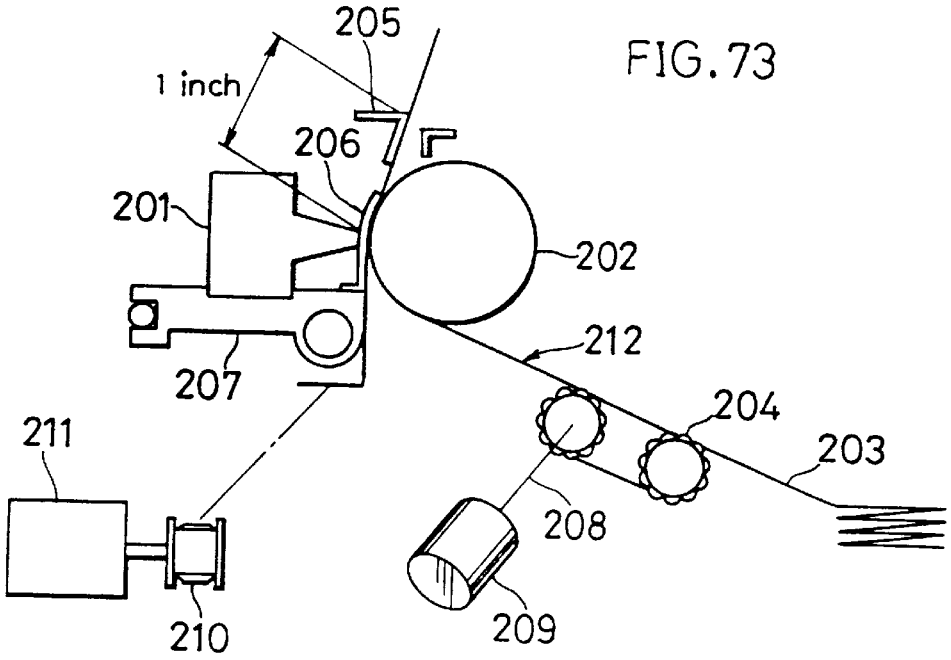
FIG. 73
FIG. 74
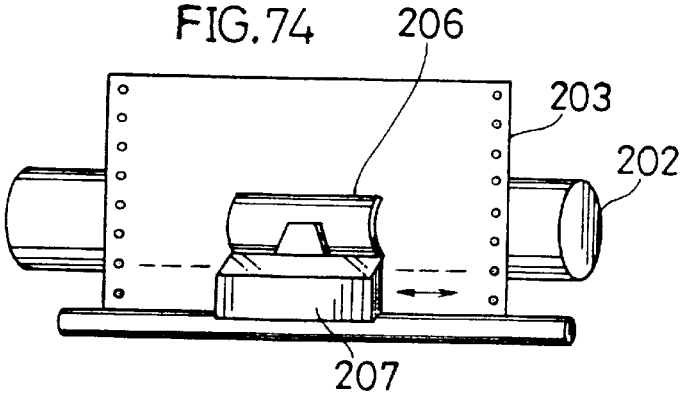
FIG. 75
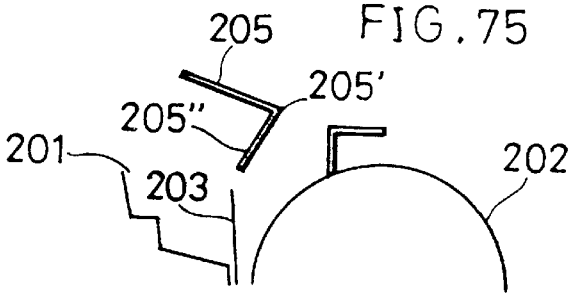

PRINTER SYSTEM WITH AUTOMATIC INK RIBBON CASSETTE EXCHANGE FUNCTION

This application is a divisional of application Ser. No. 08/469,457, filed on Jun. 6, 1995, now Pat. No. 5,720,562, the entire contents of which are hereby incorporated by reference.

FIELD OF THE INVENTION

The present invention relates to a printer system with an automatic ink ribbon cassette exchange function, and particularly relates to a printer system with an automatic ink ribbon cassette exchange function, which automatically changes a plurality of ink ribbon cassettes so as to carry out the printing.

BACKGROUND OF THE INVENTION

According to a conventional color printers, an ink ribbon cassette is divided into a plurality of areas, in a checkered manner (see FIG. 61) or in a stripe manner (see FIG. 62), such as Y (yellow)/M (magenta)/C (cyan)/B (black) so as to be printed while overlapping one another as disclosed in the Japanese unexamined patent publication No. 60-253578/1985 (hereinafter referred to as JP'578).

However, such a printer has the problem that the ribbon on whose color is not used is sent without being contributed to the printing when the colors are not uniformly used. In order to solve the problem, the thermal transfer printer disclosed in the JP'578 is arranged such that a plurality of ink ribbon cassettes are prepared so as to be disposed parallel to a moving direction of a carriage, thereby ensuring that the carriage can go and catch a target ink ribbon cassette in accordance with the need.

FIG. 63 is an explanatory view illustrating such an arrangement. As illustrated in FIG. 63, a carriage 100 can be moved in the direction parallel to a platen (not illustrated) by a timing belt 107 and a carriage drive motor 108. A stocker 105 can hold four ink ribbon cassettes 101 through 104 in the direction parallel to the platen.

Since the carriage 100 holds the ink ribbon cassette 103 as illustrated in FIG. 63, the printing can be carried out by a printing head 109 with the use of the ink ribbon cassette 103. When carrying out the printing with the use of another ink ribbon cassette such as an ink ribbon cassette 103, the ink ribbon cassettes 101 may be acquired by the carriage 100 after the ink ribbon cassette 103 is returned to a vacant position of the stocker 105.

The following methods are for delivering an ink ribbon cassette between the carriage 100 and the stocker 105: a method wherein the carriage moves and gets the necessary ink ribbon cassette without the movement of the stocker; and a method wherein the stocker itself moves and places the ink ribbon cassette on the carriage.

Here it is assumed that the colors of the respective ink ribbon cassettes 101 through 104 are the same. In such a case, when the ink ribbon cassette 101 is ended, the ink ribbon cassette 102 is substituted therefor. When the ink ribbon cassette 102 is ended, the ink ribbon cassette 103 is substituted therefor. Thus, the consecutive printing can be carried out.

According to the JP'578, a method wherein four ink ribbon cassettes are stacked on a carriage is proposed.

FIG. 64 is an explanatory view illustrating the method proposed in the JP'578, and shows that the upper most ink ribbon cassette 101 among the four stacked ink ribbon cassettes is in a state where the printing operation can be carried out.

In such a state, in order to change the ink ribbon cassette with another one for use in the printing operation, it is required that (1) a motor (not illustrated) for moving up and down the ink ribbon cassette is rotated, (2) the legs of a cassette cradle are pushed up, and (3) the motor from moving up and down the ink ribbon cassette is stopped when the next ink ribbon cassette is disposed in the position of the printing head 109.

In the case where the printing is carried out by moving the ink ribbon cassettes group in the moving direction of the printing head, i.e., in the vertical direction with respect to the shaft direction of the platen, when the current ink ribbon is consumed, the changing of the ink ribbon cassettes are automatically carried out from the fourth stacked ink ribbon cassette to the third stacked ink ribbon cassette, from the third to the second, and from the second to the first. Thus, the consecutive printing can be carried out.

According to the Japanese unexamined patent publication No. 62-227781/1987 (hereinafter referred to as JP'781), the consecutive printing by the ink ribbon can be carried out with the use of a thermal transfer serial printer in which an ink ribbon cassette containing two ink ribbons is provided.

FIG. 65 is a front view illustrating the state where the lower side ink ribbon (159*b*) of the two ink ribbons 159*a* and 159*b* which are contained by the ink ribbon cassette 158 is used. FIG. 66 is a front view illustrating the state where the upper side ink ribbon (159*a*) of the two ink ribbons 159*a* and 159*b* is used.

In FIGS. 65 and 66, supporters 156*a* and 156*b* are (1) fixed to a holder 155 for holding the ink ribbon cassette 158, (2) are fitted to respective guides 153*a* and 153*b* which are fixed to a carrier frame 151, and (3) are slidable in the up-and-down direction by a driving mechanism 155*a* (a solenoid 152, an armature 152*a*, and a spring 152*b*).

In FIG. 65, when one line printing with the ink ribbon 159*b* is finished, the printing operation is suspended so that the holder 155 is pushed down so as to change the state into that of FIG. 66. Namely, the state is realized where the ink ribbon 159*a* and the printing head 154 can neighbor with each other. Then, the printing operation restarts while the ink ribbon 159*a* is fed by a ribbon motor 157. When it is detected that the ink ribbon 159*a* became in a ribbon end state during repeatedly carrying out the bidirectional printing in accordance with the foregoing operations, the printing operation is suspended. In such a case, the printing for the remaining characters is continuously carried out while the ink ribbon cassette 158 is lifted up to the position of FIG. 65 and the ink ribbon 159*b* is driven.

The following is well known as the printers having no stocker: a thermal printer disclosed in the Japanese unexamined patent publication No. 61-112666/1986 (hereinafter referred to as JP'666); a thermal transfer recording apparatus disclosed in the Japanese unexamined patent publication No. 3-187777/1991 (hereinafter referred to as JP'777); and a thermal printer disclosed in the Japanese unexamined patent publication No. 5-169783/1993 (hereinafter referred to as JP'783). According to such a printer, the printing is carried out with respect to a plain paper with the use of an ink ribbon cassette, in addition thereto the printing may be carried out with respect to a thermosensible paper which colors up on receipt of heat. The printer has the problem that the ink ribbon cassette should be taken out for each printing with respect to the thermosensible paper. In order to solve the problem, the thermal printer disclosed in the JP'666 proposes the arrangement wherein a carriage is provided with the moving mechanism for moving the ink ribbon cassette from a thermal head and wherein the ink ribbon cassette is taken out from the thermal head during the mode in which the printing is carried out with respect to the thermosensible paper which does not necessitate the use of the ink ribbon cassette.

FIGS. 67(*a*) and 67(*b*) are explanatory views illustrating such an arrangement, FIG. 67(*a*) illustrates the state in which the printing is carried out with respect to the plain paper while FIG. 67(*b*) illustrates the state in which the printing is carried out with respect to the thermosensible paper. A carriage 110 can be moved by a timing belt (not illustrated) and a carriage drive motor (not illustrated) in a direction vertical to a moving direction of a recording paper 111 as illustrated in FIGS. 67(*a*) and 67(*b*).

The carriage 110 is provided with (1) an ink ribbon cassette holder mechanism 113 having an ink ribbon cassette winding mechanism 112 and (2) a printing head 114. With the arrangement, the printing is carried out by the printing head 114 with an ink ribbon cassette 115 being held by the carriage 110. In contrast, when the printing is carried out with respect to a thermosensible paper 119 without the ink ribbon cassette 115, the ink ribbon cassette holder mechanism 113 is pushed up by a cam plate 116, which is actuated by a motor 118 and a gear 117 in the carriage, so that the printing is carried out while the ink ribbon cassette 115 is taken away from the printing head 114.

FIGS. 68(*a*) and 68(*b*) are views illustrating the arrangement disclosed in the JP'783, FIG. 68(*a*) illustrates the state in which the printing is carried out with respect to the plain paper while FIG. 68(*b*) illustrates the state in which the printing is carried out with respect to the thermosensible paper. In the thermal printer disclosed in the JP'783, like the foregoing case, a carriage 120 is provided with an ink ribbon cassette plate 122 for holding an ink ribbon cassette 121, the carriage 120 being moved by a timing belt (not illustrated) and a drive motor (not illustrated) in a direction vertical to a moving direction of printing paper (not illustrated). The carriage 120 is connected with the ink ribbon cassette plate 122 by a moving arm 123 so that the ink ribbon cassette plate .122 can be parallelly moved with respect to the carriage 120.

With the arrangement, in the mode in which the printing is carried out with respect to the thermosensible paper without the ink ribbon cassette 121, a cam 124 pushes up the ink ribbon cassette plate 122 so that a printing head 125 directly comes into contact with printing paper (not illustrated), thereby ensuring that the printing is carried out with respect to the thermosensible paper without the user's removing operation of the ink ribbon cassette 121.

The thermal transfer recording apparatus disclosed in the JP'777 proposes the structure in which (1) a carriage holds a plurality of ink ribbon cassettes and (2) a mechanism is prepared for avoiding of the erroneous insertion of the ink ribbon cassette, thereby ensuring that the plurality of ink ribbon cassettes are simultaneously used for the multiple color printing. FIG. 69 is an explanatory view illustrating such a thermal transfer recording apparatus. There is provided, on a carriage 127, with a cassette plate 128 which can hold a plurality of ink ribbon cassettes that are elevated by an elevator 126, the carriage 127 being moved by a timing belt (not illustrated) and a drive motor (not illustrated) in a direction vertical to a moving direction of printing paper (not illustrated).

When the color printing is carried out by the thermal transfer recording apparatus, a yellow ink ribbon cassette 129*c*, a magenta ink ribbon cassette 129*b*, and a cyan ink ribbon cassette 129*a* are stacked in this order on the cassette plate of the carriage 127. (see FIG. 70) so that (1) the printing is carried out in yellow color by the yellow ink ribbon cassette 129*c* while keeping the cassette plate 128 lowered, then (2) the printing is carried out in magenta color by the magenta ink ribbon cassette 129*b* while the elevator 126 keeps the cassette plate 128 raised by one stage, and thereafter (3) the printing is carried out in cyan color by the cyan ink ribbon cassette 129*a* while the elevator 126 keeps the cassette plate 128 further raised by another one stage.

The three different color ink ribbon cassettes 129*a* through 129*c* have detection elements 130*a* through 130*c* for identifying respective ink ribbon colors (see FIG. 71). Detection switches 131*a* through 131*c* for detecting the detection elements 130*a* through 130*c* respectively are provided in the cassette plate 128 (see FIGS. 69 and 70).

As illustrated in FIG. 69, in the cassette plate 128, the detection switches 131*a* through 131*c* are disposed so as to come into contact with the detection elements 130*a* through 130*c* of the respective ink ribbon cassettes 129*a* through 129*c* when the ink ribbon cassettes 129*a* through 129*c* are attached to the cassette plate 128.

When the ink ribbon cassettes 129*a* through 129*c* are attached to the cassette plate 128, the detection switches 131*a* through 131*c* detect the detection elements 130*a* through 130*c* of the respective ink ribbon cassettes 129*a* through 129*c*, thereby judging whether or not the respective ink ribbon cassettes 129*a* through 129*c* are appropriately attached to the cassette plate 128.

The detail operations of the thermal printer in the JP'666, the thermal transfer recording apparatus in the JP'777, and the thermal printer in the JP'783 are disclosed in the respective unexamined patent publications, so such explanations are omitted here.

In FIGS. 72(*a*) and 72(*b*), a printing paper feed roller feeds a printing paper 111 in an arrow direction. When the printing paper 111 is inserted, the output of a sensor 113 for detecting whether or not the printing paper exists becomes the on state.

The following methods are for delivering an ink ribbon cassette between the carriage 100 and the stocker 105: a method wherein the carriage moves and gets the necessary ink ribbon cassette without the movement of the stocker; and a method wherein the stocker itself moves and places the ink ribbon cassette on the carriage. FIGS. 72(*a*) and 72(*b*) illustrate the latter method. FIG. 72(*a*) illustrates the state where the stocker is moved up, while FIG. 72(*b*) illustrates the state where the stocker is moved down so that the ink ribbon cassette is held by the carriage.

According to the Japanese unexamined patent publication No. 2-258276/1990 (hereinafter referred to as JP'276), in order to smoothly feed the printing paper, the carriage is moved to the center of the printing paper so as to press the printing paper during feeding of the printing paper, so that the jam of the printing paper can be avoided. FIGS. 73 through 75 are explanatory views illustrating the technique of JP'276.

In FIG. 73, the feed system of the printer is composed of a printing head 201, a platen 202 facing the printing head 201, a ribbon guide 206 disposed between the printing head 201 and the platen 202, a carriage (carrier) 207, movable in the right and left directions, having the printing head 201 and the ribbon guide 206, a tractor 204 for feeding a printing paper 203, and a cutter 205 for cutting away the printing paper. The tractor 204 is driven to rotate by a stepping motor 209 through a driving shaft 208.

The carriage 207 is horizontally moved by a stepping motor 211 through a timing belt 210. There is provided a detection sensor 212, for determining the feed position of the printing paper, on the feed path connecting the printing head 201 and the tractor 204. FIG. 74 is a view illustrating the position of the carriage 207 when the printing paper 203 is fed in the discharge direction. FIG. 75 is an enlarged view illustrating the printing paper feed path up to the cutter after the printing.

A predetermined amount of the printing paper is fed based on the fact that (1) the printing paper 203 is set to the tractor 204, (2) the stepping motor 209 is driven upon pressing a switch on an operation panel so as to feed the printing paper 203, and (3) the detection sensor 212 detects the upper end portion of the printing paper. Note that the carriage 207 is driven by the stepping motor 211 so as to move to the center of the printing paper upon pressing the switch on the operation panel (see FIG. 74), thereby causing that the printing paper 203 is pressed by the ribbon guide 206.

Thus, the printing paper 203 is fed while being fallen in a direction reverse to the direction in which the printing paper 203 winds around the platen 202 (the printing paper feed path), and the upper end portion of the printing paper is caught by a guide lower end 205" of the cutter 205, thereby avoiding the printing paper jam.

In a conventional printer which can not change the ink ribbon cassette while holding a plurality of ink ribbon cassettes, when a ribbon end is detected during printing, it is required that (1) the printing is suspended so that the user takes away the ink ribbon cassette from the carriage and attaches the new ink ribbon cassette on the carriage, and thereafter (2) the user restarts the printing.

JP'578 does not disclose how to control the continuous printing when a plurality of same color ribbons are set. However, since one ink ribbon cassette can be automatically changed with another ink ribbon cassette, the method, where in the printing is carried out while changing the ink ribbon cassettes in order when each ribbon end is detected during printing, may be proposed.

However, such a method presents the problem that it is likely that the printing is carried out while the ink ribbon cassette which is already ended is attached to the carriage again, since the holding positions of the respective ink ribbon cassettes which are already ended are not stored.

In contrast, when the holding positions of the ink ribbon cassettes which are already ended are stored, the following problem arises. More specifically, even though the user changes the ink ribbon cassette which is already ended with a new one, the new ink ribbon cassette will never be used since it is not detected on the printer side whether or not the changing of the ink ribbon cassette has been carried out.

Moreover, since the control wherein the ink ribbon cassette having least remaining amount has priority over other ink ribbon cassettes to be used is not carried out, it is likely that a plurality of ink ribbon cassettes which can still be used are presented.

According to the continuous printing method of the ribbons disclosed in JP'781, one ink ribbon cassette contains two ink ribbons and when one ink ribbon is ended, another ink ribbon is substituted therefor.

However, such a method presents the problem that the user can not know whether or not only one ink ribbon has been ended when the first ink ribbon was ended. Thus, since the printing can not be carried out when the second ink ribbon is ended, at this time the user must simultaneously change two ink ribbon cassettes with new ones.

Even if the user knows that the first ink ribbon cassette is ended and changes only the first one with a new one, the printer can not know the changing of the first ink ribbon cassette. Therefore, the printer continues the printing with the use of only the second ink ribbon cassette though the first ink ribbon cassette has been changed with a new one.

Accordingly, though such a printing method carries out the bidirectional printing with the alternate use of the first and second ink ribbons, the continuous printing can not be carried out while changing the ink ribbon each time each ink ribbon is ended.

In the arrangement where the stocker is provided which stores plural ink ribbon cassettes in a direction parallel to the moving direction of the carriage, and the ink ribbon cassette is exchanged between the carriage and the stocker, the following problems are presented.

In order to exchange the ink ribbon cassette between the carriage and the stocker smoothly and speedily, it is required to place the carriage and the stocker so as to face one another and to set the distance between them as small as possible. Therefore, the space between the carriage and the stocker wherein the ink ribbon cassette is set becomes small, and it is not easy to insert the user's hand, thereby presenting the problem of inconvenience in exchanging the cassette.

For this reason, it may be arranged such that the user exchanges the ink ribbon cassette by adopting the stocker which is rotatable or detachable, i.e., by opening the stocker. However, if the carriage is activated by mistake when the stocker is opened, even if the exchange is not performed properly, the printing may be started using the wrong ink ribbon cassette without notice.

Moreover, in the case of placing the ink ribbon cassette on the carriage by moving the stocker in the direction of the carriage, since the entire height of the printer is low, by setting such that the printer is set in this state except during the printing operation, the printer can be miniaturized.

However, in this state, since the stocker and the carriage are in tight contact with one another through the ink ribbon cassette, it is not possible for the user to exchange the ink ribbon cassette.

Furthermore, when the ink ribbon has been used to the end in the middle of the printing operation, and the ink ribbon cassette of the same kind (color) is not stored in the stocker, the new ink ribbon cassette is set on the carriage, and the printing operation must be restarted. In the described printer, it is difficult to set and take out the ink ribbon cassette on and from the carriage as being disturbed by the mechanical section of the stocker and the carriage.

In the case of the printer which is not provided with the detection means for detecting the kind (color) of the ink ribbon cassette for reducing the cost, etc., normally, the color of the ink ribbon cassette to be mounted to the position of the stocker is set beforehand, for example, black, yellow, magenta, cyan, etc. from the left end, so as to store the color of the ink ribbon each time.

However, when the user sets the ink ribbon cassette not on the stocker but directly on the carriage, since the printer does not know the set ink ribbon cassette is in what color, a printing operation may not be performed in correct color.

The thermal transfer printer disclosed in the JP'578 is an automatic changer printer in which the ink on the ribbon of the ink ribbon cassette is transferred to the printing paper by heating a plurality of small heating elements disposed on the printing head while the printing head comes into contact with the ink ribbon. However, since there is no sensor for detecting whether or not the ink ribbon cassette is attached to the carriage, it can not be detected whether or not the ink ribbon cassette is attached onto the carriage. Thus, in the case where the printing is carried out with respect to a thermosensible paper which colors upon receipt of heat without the ink ribbon cassette, the user has to confirm whether the ink ribbon cassette is not attached to the carriage for each printing so that the printing is not carried out while the ink ribbon cassette is attached to the carriage. When the user finds that the ink ribbon cassette is attached to the carriage, the user must take out the ink ribbon cassette from the carriage. Note that no description concerning the printing with respect to the thermosensible paper is disclosed in the the JP'578.

Moreover, in the case where the ink ribbon cassette is automatically moved to the carriage for each printing from the stocker which holds the ink ribbon cassettes, the ribbon which is to be moved to the carriage should be taken out from the stocker beforehand prior to each printing.

Namely, it is required to confirm for each thermosensible paper printing whether or not the ink ribbon cassette is attached to the carriage so that the printing is not carried out with the ink ribbon cassette, thereby presenting the problem that the printing is not effectively carried out.

According to the thermal printer of the JP'666 and the thermal printer disclosed in the JP'783, the user can carry out, without taking out the ink ribbon cassette at the user's end, (1) the printing with respect to the plain paper with the ink ribbon cassette and (2) the printing with respect to the thermosensible paper without the ink ribbon cassette. However, it is not considered to carry out the multiple color printing with the use of a plurality of ink ribbons. Accordingly, the user must change the ink ribbon cassette in accordance with the color to be printed for each multiple color printing.

In especial, three color ink ribbon cassettes, i.e., the yellow, magenta and cyan ink ribbon cassettes, are ordinarily used for the color printing. So, it is frequently required to change the ink ribbon, thereby presenting the problem that the color printing can not effectively carried out. In order to carry out only the color printing, the complicated structure is separately required, thereby presenting another problem.

According to the thermal transfer recording apparatus disclosed in the JP'777, with the use of a plurality of ink ribbon cassettes, the user can effectively carry out the multiple color printing without changing the ink ribbon cassette. The thermal transfer recording apparatus is arranged so that the ink ribbon cassettes are stacked on the carriage.

When the printing is carried out with respect to the thermosensible paper, another sliding corresponding to one ink ribbon cassette is required so that the printing head does not face the ink ribbon of the ink ribbon cassette thereby realizing the printing with respect to the thermosensible paper. So, when using three color ink ribbons such as yellow, magenta and cyan ink ribbons, the space for four ink ribbon cassettes should be totally prepared on the carriage for the color printing based on the fact that the space for the three ink ribbon cassettes and the space for the sliding during the printing with respect to the thermosensible paper should be prepared, thereby requiring the great space and thereby resulting in that the printer becomes bulky.

According to the thermal transfer printer disclosed in the JP'578, there is no sensor provided for detecting whether or not the ink ribbon cassettes are attached to the stocker, i.e., for detecting the ink ribbon cassette holding states of the respective carriage and stocker. This causes to present the problem that no errors can be detected such as (1) the error that the changing operation is not appropriately carried out due to some error that the automatic changer fails to move the ink ribbon cassette from the carriage to the stocker for example or (2) the error that the ink ribbon cassette is detached in response to the externally applied shocks during printing. When the error is not detected, the stresses are concentrated on the element whose strength is weaker, thereby causing to present the problem that the printer becomes out of order or the elements are damaged.

The thermal transfer printer disclosed in the JP'578 is a color printer that can carry out the multiple color printing by automatically changing the three color ink ribbon cassettes, for example, Y (yellow)/M (magenta)/C (cyan) ink ribbon cassettes during the printing, although only a single ink ribbon cassette can be attached to the carriage at a time.

In general, when carrying out the color printing, it is required that (1) the data to be printed are divided into respective Y (yellow)/M (magenta)/C (cyan) components and (2) the Y component data are printed by the Y color ink ribbon cassette, the M component data are printed by the M color ink ribbon cassette, and the C component data are printed by the C color ink ribbon cassette. Accordingly, when the ink ribbon cassettes are not attached to respective appropriate positions in the stocker, the color printing can not appropriately be carried out.

The thermal transfer printer disclosed in the JP'578 has no sensor for detecting whether or not the ink ribbon cassettes have been attached to the stocker. So, the user can not judge whether or not each ink ribbon cassette has been appropriately attached to the stocker for each selected printing mode, thereby presenting the problem that the appropriate printing may not be carried out.

The thermal transfer recording apparatus disclosed in the JP'777 identifies each one of the ink ribbon cassettes stacked on the carriage based on the fact that the detection switches, provided in the cassette plate for identifying the types of the respective ink ribbon cassettes, detect the respective detection elements attached to the respective ink ribbon cassettes so that the respective ink ribbon cassettes have been appropriately attached.

However, since the ink ribbon cassettes are stacked on the carriage, the following problems (a) and (b) arise: (a) (1) the thickness of the carriage including the thickness of the cassette plate becomes thicker in proportion to the attachable number of the ink ribbon cassettes and (2) the entire thickness of the printer becomes so thick because the space on the upper side of the carriage for the sliding width by which the cassette plate elevates is further required; and (b) it is only judged whether or not the ink ribbon cassette is the one which should be held in its ink ribbon cassette holding position because only a single detection switch is provided in each ink ribbon cassette holding position in the cassette plate.

According to the ink ribbon cassette automatic changer printer disclosed in JP'578, the ink ribbon cassette is delivered between the stocker and the carriage based on the fact that the stocker is moved up and down by the changer, thereby enabling to attach and detach the ink ribbon cassette.

Accordingly, if the carriage is tried to be moved when (1) the stocker has been moved down by the changer or (2) the stocker has been down due to some reasons, the carriage can not be moved because the carriage collides with the stocker, thereby causing to excessively burden the carriage drive motor. So, to keep moving the carriage under such a condition causes the carriage drive motor to be heated up, thereby presenting the reasons of some faults and accidents.

According to the ink ribbon cassette automatic changer printer disclosed in JP'578, the ink ribbon cassette is delivered between the stocker and the carriage based on the fact that the stocker is moved up and down by the changer, thereby enabling to attach and detach the ink ribbon cassette.

Accordingly, in the case where the carriage is forcedly moved by the user when the stocker has been moved up by the changer, if the changer tries to move down the stocker, the carriage collides with the stocker, thereby causing to excessively burden the changer. So, if the changer keeps moving down the stocker under such a condition, it causes that the carriage drive motor is heated up, thereby presenting the reasons of some faults and accidents.

Alternatively, if the changer tries to move up the stocker when something is placed on the stocker, such a movement excessively burdens the changer, thereby presenting the problem similar to the foregoing case.

According to the ink ribbon cassette automatic change printer disclosed in JP'578, the ink ribbon cassette is delivered between the stocker and the carriage based on the fact that the stocker is moved up and down by the changer, thereby enabling to attach and detach the ink ribbon cassette.

So, if the user tries to set the printing paper when the stocker has been moved up by the changer, such operation presents the problem that the printing paper is caught by the lower end portion of the stocker (see FIG. 72(*a*)).

JP'276 discloses a technical method wherein the carriage is controlled so as to move to the center of the printing paper, thereby avoiding the paper jam. However, in the foregoing ink ribbon cassette automatic changer printer having the stocker, when the carriage is merely moved to the center of the printing paper, both ends of the printing paper are caught by the lower end portion of the stocker, thereby presenting the problem that it is not possible to smoothly feed the printing paper.

Therefore, in order to supply the printing paper to the foregoing ink ribbon cassette automatic changer printer having the stocker, it is required that the stocker is kept be down so that the printing paper is not caught by the lower end portion of the stocker. In other words, when the stocker is kept be down, the printing paper is not caught by the lower end portion of the stocker. Thus, the printing paper is guided by the front surface portion of the stocker so as to be fed (see FIG. 72(*b*)).

In the case where the user supplies the printing paper to the printer when the stocker is kept be up, it is required for the user to carry out the operation for moving down the stocker prior to supplying the printing paper, thereby requesting the user to have troublesome things.

According to the ink ribbon. cassette automatic changer printer disclosed in JP'578, the ink ribbon cassette is delivered between the stocker and the carriage based on the fact that the stocker is moved up and down by the changer, thereby enabling to attach and detach the ink ribbon cassette. Therefore, in the case where the changer moves up from the down state after setting the printing paper, when the stocker is moved up while the ink ribbon cassette is held by the carriage and the ink ribbon cassette which is first used after starting to print is different from that held by the carriage, it is required that the ink ribbon cassette of the carriage is once returned to the stocker and the ink ribbon cassette which is first used for the printing is attached to the carriage. Thus, the problem arises that another time is required for returning the ink ribbon cassette to the stocker, thereby requiring longer time for starting the printing operation.

In contrast, in the case where the stocker is moved up from the down state by the changer after setting the printing paper, when the stocker is moved up after removing the ink ribbon cassette from the carriage and the ink ribbon cassette which is first used after starting to print is coincident with that which has been originally held by the carriage, it is required that the same ink ribbon cassette must be attached to the carriage again, thereby causing dead time and dead operation in the entire printing operation.

According to the ink ribbon cassette automatic changer printer disclosed in JP'578, the ink ribbon cassette is delivered between the stocker and the carriage based on the fact that the stocker is moved up and down by the changer, thereby enabling to attach and detach the ink ribbon cassette. Therefore, it is judged, when the carriage is not provided with the ink ribbon cassette type detection device, what type of the ink ribbon cassette is attached to the carriage by judging that the ink ribbon cassette was removed from what position of the stocker.

The types (colors) of the respective ink ribbon cassettes which are held by the stocker are predetermined, i.e., for example, the colors of the respective ink ribbon cassettes of the stocker are B (black), Y (yellow), M (magenta) and C (cyan) respectively from the left end to the right end in this order. So, when the ink ribbon cassette is attached to the carriage during staying of the carriage in the left end of the stocker, it can be identified that the color of thus attached ink ribbon cassette is black.

However, generally, in the conventional printers, a sensor is provided which turns ON when the carriage moves to the left end of the stocker. The position of the carriage is identified in accordance with the moved distance of the carriage from the position in which the sensor turns ON. Thus, the position of the carriage can not be identified before carrying out the initialization of the printer.

The initialization is carried out, for example, just after turning on the power source. When the initialization of the printer is carried out, for example, the carriage is moved to the position in which the sensor turns ON. Accordingly, at that time, the type (color) of the ink ribbon cassette which has been attached to the carriage by the changer can not be identified. Even in the case where the ink ribbon cassette has already been attached to the carriage at turning on the power source, the type (color) of the ink ribbon cassette can not be identified.

As a result, even if the carriage has already held the ink ribbon cassette which is first used at the starting of the printing, it is required that (1) the ink ribbon cassette is once returned to the stocker, (2) the position of the carriage is identified, and thereafter (3) the ink ribbon cassette is again held by the carriage, thereby presenting the problem that the printer must do such vain operations.

SUMMARY OF THE INVENTION

The present invention is achieved in finding a way to solve the above-mentioned problems. Accordingly, a printer system with an automatic ink ribbon exchange function of the present invention permits the following objects to be achieved.

An object of the present invention is to provide a printer system which permits an ink ribbon cassette to be automatically delivered and an optimal ink ribbon cassette to be selected among available ink ribbon cassettes by detecting a used ink ribbon cassette when plural ink ribbon cassettes storing ink ribbons in the same color are set, thereby permitting a printing operation of a large volume to be performed continuously without using user's hands.

Another object of the present invention is to provide a printer system with an automatic ink ribbon cassette which prevents a used ink ribbon cassette from being mounted on the carriage again by storing a holding position of the used ink ribbon cassette and also permits the user to easily recognize which ink ribbon cassette to be exchanged by informing the user of the holding position of the used ink ribbon cassette.

A still another object of the present-invention is to provide a printer system with an automatic ink ribbon cassette exchange function which can determine whether an ink ribbon cassette in each position is used or new by detecting that the ink ribbon cassette has been exchanged when a printing operation is interrupted by the user in a continuous printing operation to exchange the used ink ribbon cassette for a new ink ribbon cassette, thereby permitting a continuous printing operation.

A still another object of the present invention is to provide a printer system with an automatic ink ribbon cassette exchange function which permits an effective use of the ink ribbon cassette by allowing a user to input the order according to the remaining amount of ink ribbon of the ink ribbon cassettes from that storing a least amount of ink ribbon, namely, prevents an occurrence of such problem that plural ink ribbon cassettes are used but not to the end in the case of performing a printing operation using ink ribbons in the same color;

In order to achieve the above-mentioned objects, the printer system in accordance with the present invention is characterized by comprising:

a carriage for holding thereon a single ink ribbon cassette;

a stocker for storing therein plural ink ribbon cassettes;

a changer for taking out an ink ribbon cassette held in a free position of the stocker to be mounted on the carriage or taking out the ink ribbon cassette held on the carriage to be stored in a free empty space in the stocker;

ink ribbon cassette end detection means for detecting that an ink ribbon in the ink ribbon cassette has been used to an end;

used ink ribbon cassette holding position memory means for storing therein information indicative of a holding position in the stocker of the used ink ribbon cassette when the ink ribbon end detection means detects that the ink ribbon has been used to the end; and cassette holding determining means for determining whether or not the ink ribbon cassette whose ink ribbon has not been used to the end is stored in the stocker based on the information indicative of the holding position, and controls means for controlling such that when the cassette holding determining means determines that an ink ribbon cassette A whose ink ribbon has not been used to the end is stored in the stocker, the ink ribbon cassette A is taken out and is mounted on the carriage of the stocker by the changer, while when the cassette holding determining means determines that the ink ribbon cassette A is not held in the stocker, a user is informed of that the used ink ribbon cassette is to be exchanged for a new ink ribbon cassette.

According to the described arrangement, the ink ribbon cassette stored in a free position of the stocker is taken out to be mounted on the carriage, and when the ink ribbon end detection means detects that the ink ribbon of the ink ribbon cassette has been used to the end in the middle of the printing operation, the ink ribbon cassette on the carriage is set in the stocker by the changer.

In this state, the used ink ribbon cassette holding position memory means stores the information indicative of the holding position in the stocker for holding therein used ink ribbon cassette.

When the cassette holding determining means determines that the ink ribbon cassette A whose ink ribbon has not been used to the end is stored in the stocker, the cassette A is taken out of the stocker by the changer to be mounted on the carriage. On the other hand, when it is determined that the cassette A is not stored in the stocker, the user is informed of that the used ink ribbon cassette is to be exchanged under the control of the control means.

According to the present invention, the ink ribbon cassette is mounted on the carriage or installed in the stocker by the changer, the used ink ribbon is detected, and the holding position of the used ink ribbon cassette is stored, and then an optimal ink ribbon cassette is selected among available ink ribbon cassettes, and in the case of storing plural ink ribbons in the same color, a printing operation of a large volume can be performed continuously without using the user's hands.

The printer system with an automatic ink ribbon cassette exchange function having the described arrangement may be characterized in that the stocker is provided with installation-removal detection means for detecting that the ink ribbon cassette being held has been exchanged, and when the control means determines that installation-removal detection means detects that the ink ribbon cassette has been exchanged, the control means deletes information indicative of a position of the ink ribbon cassette thus exchanged from the information indicative of the holding position of the used ink ribbon cassette in the stocker, the information being stored in the used ink ribbon cassette holding position memory means.

According to the described arrangement, when the installation-removal detection means detects that the ink ribbon cassette stored in the stocker has been exchanged, the control means deletes information indicative of the position of the exchanged ink ribbon cassette from the information indicative of the holding position of the used ink ribbon cassette whose ink ribbon has been used to the end, which is stored in the used ink ribbon cassette holding position memory means.

Therefore, when the printing operation is interrupted in the middle of the continuous printing operation by the user, to exchange the used ink ribbon cassette for a new ink ribbon cassette, it can be determined whether each ink ribbon cassette is the used ink ribbon cassette or the new ink ribbon cassette, thereby permitting the continuous printing operation.

Furthermore, since only the information indicative of the position of the used ink ribbon cassette at the position where the ink ribbon cassette is executed is deleted, when restarting the printing operation, the position of the used ink ribbon cassette can be seen.

Another printer system with an automatic ink ribbon cassette exchange function having the previously described arrangement is characterized by further including:

ink ribbon remaining amount input means for inputting an order according to the remaining amount of the ink ribbon of ink ribbon cassettes from that has a least amount of remaining ink ribbon; and control means controls so as to use plural ink ribbon cassettes from that stores the least amount of the ink ribbon inputted by the ink ribbon remaining amount input means when plural ink ribbon cassettes in a same color are stored in the stocker.

According to the described arrangement, the order according to the remaining amount of the ink ribbon of the ink ribbon cassettes is inputted by the ink ribbon remaining amount input means from that stores a least amount of the ink ribbon. Based on the inputted order, the control means controls so as to perform a printing operation by using from the ink ribbon cassette which has the least amount of remaining ink ribbon.

This arrangement enables the effective use of the ink ribbon cassettes. Namely, in the case of performing the printing operation using ink ribbon cassettes having the ink ribbons in the same color, the problem that plural ink ribbon cassettes in the color are used but not to the end can be prevented.

Another object of the present invention is to provide a printer system with an automatic ink ribbon cassette exchange function which prevents a printing operation from being executed by mistake in the open position of the stocker.

A still another object of the present invention is to provide a printer system with an automatic ink ribbon cassette exchange function which permits the ink ribbon cassette stored in the stocker to be exchanged for the ink ribbon cassette taken out of the carriage when an instruction for exchanging the ink ribbon cassette is inputted.

A still another object of the present invention is to provide a printer system with an automatic ink ribbon exchange function which prevents a printing operation from being executed in a wrong color by informing the user of that the ink ribbon cassette is taken out of the carriage to be reset in the proper position of the stocker before starting a printing operation in the case of directly placing the ink ribbon cassette on the carriage by the user.

Yet still another object of the present invention is to provide a printer system with an automatic ink ribbon exchange function which executes a printing operation after the kind of the ink ribbon cassette on the carriage is inputted so as to perform the printing operation in a mode switched according to the inputted kind of the ink ribbon cassette in the case of directly placing the ink ribbon cassette on the carriage by the user.

In order to achieve the above-mentioned objects, the printer system with an automatic ink ribbon cassette exchange function of the present invention is characterized by including:

a carriage for holding thereon a single ink ribbon cassette;

a stocker for storing therein plural ink ribbon cassettes;

a changer for taking out an ink ribbon cassette held in a free position of the stocker to be mounted on the carriage or taking out the ink ribbon cassette held on the carriage to be stored in a free empty space in the stocker;

stocker state detection means for detecting whether or not the stocker is set in a predetermined position for permitting a user to exchange the ink ribbon cassette; and control means for controlling operations of the carriage and the changer, wherein when the stocker state detection means detects that the stocker is set in the predetermined position, the control means controls the changer so as not to take out the ink ribbon cassette of the stocker nor install the ink ribbon cassette in the stocker (see FIG. 2).

In the described arrangement, the control means controls the changer so as to take out the ink ribbon cassette stored in a free position of the stocker to be mounted on the carriage, or to take out the ink ribbon cassette held on the carriage to be set in a free empty space of the stocker.

Here, when the stocker state detection means detects that the stocker is not set in a predetermined position for allowing the user to exchange the ink ribbon cassette, the control means controls the changer so as not to take out nor to set the ink ribbon cassette based on the detected information.

According to the described arrangement, by the described control by the control means, the problem that the printing operation is executed by mistake when the stocker is set in the state for allowing the user to exchange the ink ribbon cassette in the stocker can be prevented.

The printer system with an automatic ink ribbon cassette exchange function having the described arrangement may be characterized by further including:

stocker cassette detection means for detecting that the ink ribbon cassette is held in the stocker; and informing means for information the user of predetermined information, wherein the control means controls the carriage and the changer such that in exchanging the ink ribbon cassette, the changer takes out the ink ribbon cassette of the carriage to be installed in a free position of the stocker, the free position suggesting a position detected by the ink ribbon cassette detection means where the ink ribbon cassette is not stored, and that the stocker is moved to a predetermined position for allowing the user to exchange the used ink ribbon cassette for a new ink ribbon cassette.

When the ink ribbon cassette is to be exchanged, first, the control means determines if there is any empty space where the ink ribbon cassette is not held in the stocker by the stocker cassette detection means.

Next, the control means controls the carriage and the changer so as to take out the ink ribbon cassette of the carriage to be set in the empty space in the stocker where the ink ribbon cassette is not set.

Thereafter, the control means controls the changer so as to move the stocker to a predetermined state for allowing the ink ribbon cassette to be exchanged.

The control means also controls the informing means so as to inform of the exchangeable state of the ink ribbon cassette in the stocker.

According to the described arrangement, by the described control by the control means, the user can easily exchange the ink ribbon cassette in the stocker.

Another printer system with an automatic ink ribbon cassette exchange function having the described arrangement is characterized by further including:

carriage cassette detection means for detecting whether or not the ink ribbon cassette is held on the carriage, wherein when the stocker is held in the predetermined position for allowing the user to exchange the ink ribbon cassette stored in the stocker, the control means determines whether or not the ink ribbon cassette is mounted on the carriage based on information detected by the carriage cassette detection means, and when it is determined that the ink ribbon cassette is mounted on the carriage, the control means informs the informing means of so and controls the carriage and the changer so as not to perform a printing operation.

In the described arrangement, when the stocker is set in the state for allowing the user to exchange the ink ribbon cassette on the stocker, the control means performs the following operations.

First, the control means receives information detected by the carriage cassette detection means. Then, based on the detected information, the control means determines whether or not the ink ribbon cassette is mounted on the carriage.

As a result of this determination, if it is determined that the ink ribbon cassette is mounted on the carriage, the control means informs the informing means of so, in the meantime, controls the carriage and the changer so as not to perform the printing operation.

According to the described arrangement, by the described control by the control means, the printing operation is not performed using the ink ribbon cassette in a wrong color.

A still another printer system with an automatic ink ribbon cassette exchange function having the described arrangement is characterized by further including:

carriage cassette detection means for detecting whether or not the ink ribbon cassette is held on the carriage;

input means; and print mode setting means for setting a print mode based on a kind of an ink ribbon cassette stored in the stocker, wherein when the stocker is set in a predetermined position for allowing the user to exchange the ink ribbon cassette stored in the stocker, the control means determines whether or not the ink ribbon cassette is mounted on the carriage based on information detected by the carriage cassette detection means, and when it is determined that the ink ribbon cassette is mounted on the carriage, the control means informs the informing means of that the kind of the ink ribbon cassette mounted on the carriage is to be inputted, so as to set the print mode in the print mode set means based on the kind of the ink ribbon cassette inputted by the input means.

In the described arrangement, as a result of the determination by the control as to whether or not the ink ribbon cassette is mounted on the carriage, if it is determined that the ink ribbon cassette is mounted, the control means informs the informing means that the kind of the ink ribbon cassette mounted on the carriage is to be inputted.

Then, the control means sets the print mode in the print mode setting means based on the kind of the ink ribbon cassette inputted by the input means.

According to the described arrangement, by the control by the control means, even when the ink ribbon cassette is mounted on the carriage, the printing operation can be performed in a proper color, and the set print mode can be easily switched.

Another object of the present invention is to provide a printer system with an automatic ink ribbon cassette exchange function in which (1) the including the removing operation of an ink ribbon cassette during printing to thermo-sensible paper which does not necessitate the ink ribbon cassette so as to reduce the printing steps and so as to effectively carry out the printing with high speed and (2) the thickness of the printer is reduced and the printing is effectively carried out with high speed.

A still another object of the present invention is to reduce the burden of the printer by finding accidents such as the failure occurred during an ink ribbon cassette delivery of a changer between a carriage and a stocker.

A yet another object of the present invention is to realize a thin automatic changer printer and is to avoid that an ink ribbon cassette is mistakenly attached for a printing mode to be printed or the ink ribbon cassette fails to be attached.

A further object of the present invention is (1) to realize a thin automatic changer printer, is (2) not to concern about the order to be attached by judging the types of respective ink ribbon cassettes stored in a stocker and (3) is to make it easier to attach the ink ribbon cassettes required for a printing mode to be printed so as to realize to effectively.

An object of the present invention is, with low cost, (1) to realize a thin automatic changer, (2) to avoid that an ink ribbon cassette is mistakenly attached for a printing mode to be printed or the ink ribbon cassette fails to be attached about the order to be attached.

A still another object of the present invention is (1) to realize a thin automatic changer printer, is (2) not to concern about the order to be attached by judging the types of respective ink ribbon cassettes held in a stocker, and is (3) to make it easier to attach the ink ribbon cassettes required for a printing mode to be printed so as to realize to effectively operate with low cost.

In order to achieve the above objects, the printer system in accordance with the present invention is characterized by including:

a carriage, having a thermal head and cassette detection means for detecting whether or not an ink ribbon cassette is held thereon, the carriage being movable while holding the ink ribbon cassette, a stocker, having stocking detection means for detecting whether or not each ink ribbon cassette is held, the respective ink ribbon cassettes being detachable from the stocker, a changer for moving the carriage and the stocker between (1) a ribbon delivery state in which the carriage and the stocker come closer with each other so as to deliver the ink ribbon cassette therebetween and (2) a carriage movable state in which the carriage and the stocker are away from each other so that the carriage becomes movable, and cassette removing means for detecting during printing to a thermo-sensible paper whether or not the ink ribbon cassette is held by the carriage, and for attaching, when the ink ribbon cassette is held by the carriage, the ink ribbon cassette is taken out of the carriage to be mounted to a position of the stocker where no ink ribbon cassette is held after the changer removes the ink ribbon cassette held by the carriage (see FIG. 3).

According to the described arrangement, in the case of printing on the thermosensible sheet, when the ink ribbon cassette is not set on the carriage, the printing on the thermosensible sheet is initiated by the thermal head. On the other hand, when the ink ribbon cassette is set on the carriage, the cassette removing means activates the changer so as to take out the ink ribbon cassette set on the carriage. Then, the ink ribbon cassette is set in a space where the ink ribbon cassette has not been set, thereby starting the printing operation on the thermosensible sheet in the state where the ink ribbon cassette is not held on the carriage.

As a result, it is not required to take out the ink ribbon cassette of the carriage by hand when printing on the thermosensible sheet.

In order to achieve the above-mentioned objects, another printer system in accordance with the present invention is characterized by including:

a carriage, having a printing head and cassette detection means for detecting whether or not an ink ribbon cassette is held thereon, the carriage being movable while holding the ink ribbon cassette, a stocker, having stocking detection means for detecting whether or not each ink ribbon cassette is held, the respective ink ribbon cassettes being detachable from the stocker, a changer for moving the carriage and the stocker between (1) a ribbon delivery state in which the carriage and the stocker come closer with each other so as to deliver the ink ribbon cassette therebetween and (2) a carriage movable state in which the carriage and the stocker are away from each other so that the carriage becomes movable, and ink ribbon cassette judging means (1) for detecting holding states of the respective ink ribbon cassettes of the stocker before and after the movement of the changer, (2) checking whether or not the holding states of the respective ink ribbon cassettes of after the movement of the changer are coincident with target holding states to be after the movement of the changer, and (3) for carrying out error procedures when the both holding states are not coincident with each other.

According to the described arrangement, by the ink ribbon cassette judging means, the storage state of the ink ribbon cassette in the stocker is detected before and after the changer is moved. Then, it is determined whether or not the storage state of the ink ribbon cassette after the changer is moved is identical with the state according to the result of the movement of the changer. If they are not identical, error procedures are executed.

The described arrangement offer a prompt abnormality detection of the changing operation, and the burden incurred on each section of the printer can be lessen.

The printer system of the present invention having the described arrangement may further include:

ink ribbon cassette error detection means for detecting the holding states of the respective ink ribbon cassettes of the stocker prior to the printing and in a predetermined time interval during the printing, and for carrying out the error procedures when the holding states change.

According to the described arrangement, before starting the printing operation and also at every predetermined elapse of time during the printing operation, the ink ribbon cassette storage state of the stocker is detected, and when the storage state changes, it is considered that some abnormality condition has occurred, and the error procedures are carried out.

Therefore, an abnormality of the stocker, such as a cassette being displaced due to an impact, etc., during during the printing can be detected promptly, thereby reducing the burden incurred in a printer section by the abnormality operation.

In order to achieve the described objects, another printer system of the present invention is characterized by including:

a carriage, having a printing head and cassette detection means for detecting whether or not an ink ribbon cassette is held thereon, the carriage being movable while holding the ink ribbon cassette;

a stocker, having stocking detection means for detecting whether or not each ink ribbon cassette is held, the respective ink ribbon cassettes being detachable from the stocker;

a changer for moving the carriage and the stocker between (1) a ribbon delivery state in which the carriage and the stocker come closer with each other so as to deliver the ink ribbon cassette therebetween and (2) a carriage movable state in which the carriage and the stocker are away from each other so that the carriage becomes movable; and ink ribbon cassette holding state informing means (1) for detecting holding states of the respective ink ribbon cassettes of the stocker prior to printing, (2) for judging whether or not the detected holding states are suitable for a printing mode to be printed, and (3) for informing of suitable holding states of the ink ribbon cassette.

According to the described arrangement, when a printing is executed, depending on a selected print mode among the print mode, thermosensible printing or black printing, a color printing by Y/M/C, or two-color printing, the ink ribbon cassette to be set in the stocker differs. Therefore, before the printing operation is started, the ink ribbon cassette storage state of the stocker is detected. Then, it is determined whether or not the storage state is appropriate for the print mode to be executed, and an appropriate ink ribbon cassette storage state is informed.

Since the confirming operation for setting the ink ink ribbon cassette is performed, the cassette can be set more accurately, and the printing error due to the erroneous setting of the ink ribbon cassette can be prevented.

The printer system in accordance with the present invention having the described arrangement may further include:

stocker ribbon type identifying means for identifying types of the respective ink ribbon cassettes in the stocker; and control means (1) for detecting holding states of the respective ink ribbon cassettes of the stocker prior to printing, (2) for judging whether or not the detected holding states are suitable for a printing mode to be printed, and (3) for informing of suitable holding states when the detected holding states are not suitable while for identifying the types of the respective ink ribbon cassettes in the stocker when the detected holding states are suitable so as to appropriately carry out the printing for the printing mode to be printed.

According to the described arrangement, the control means detects the storage stage of the ink ribbon cassette of the stocker before starting the printing operation. Then, it is determined whether or not the detected storage state is appropriate for the print mode to be executed. If not, an appropriate storage state of the ink ribbon cassette is informed. If it is appropriate, the kind of the ink ribbon cassette stored in the stocker is recognized, and the printing is executed in a corrected proper mode for the desired printing operation.

Therefore, an improved accuracy of the installation and removable of the ink ribbon cassette can be achieved, and an occurrence of the erroneous printing operation due to the erroneous setting of the ink ribbon cassette can be prevented, thereby offering an easy handing.

In order to achieve the above objects, another printer system of the present invention is characterized by including:

a carriage, having a printing head and cassette detection means for detecting whether or not an ink ribbon cassette is held thereon, the carriage being movable while holding the ink ribbon cassette, a stocker for holding the ink ribbon cassettes, the respective ink ribbon cassettes being detachable from the stocker, a changer for moving the carriage and the stocker between (1) a ribbon delivery state in which the carriage and the stocker come closer with each other so as to deliver the ink ribbon cassette therebetween and (2) a carriage movable state in which the carriage and the stocker are away from each other so that the carriage becomes movable, and changer movement cassette detection means for detecting holding states of the respective ink ribbon cassettes of the stocker based on the fact that the cassette detection means of the carriage detects the ink ribbon cassettes during the ink ribbon cassette delivery of the changer.

According to the described arrangement, the changer movement cassette detection means sets the changer in the ribbon delivery state, and the ink ribbon cassette is detected by the cassette detection mans of the carriage. As a result, the storage state of the ink ribbon cassette in the stocker is detected, thereby executing a printing operation.

According to the described arrangement, since the storage detection means for detecting the storage state of the ink ribbon cassette is not required, thereby achieving an improved accuracy in setting the ink ribbon cassette at low cost, and the printing error due to the erroneous setting of the ink ribbon cassette can be prevented.

In order to achieve the described objects, the printer system in accordance with the present invention is characterized by including:

a carriage, having a printing head and carriage ribbon type identifying means for identifying type of the ink ribbon cassette held by the carriage, the carriage being movable while holding the ink ribbon cassette, a stocker for holding the ink ribbon cassettes, the respective ink ribbon cassettes being detachable from the stocker, a changer for moving the carriage and the stocker between (1) a ribbon delivery state in which the carriage and the stocker come closer with each other so as to deliver the ink ribbon cassette therebetween and (2) a carriage movable state in which the carriage and the stocker are away from each other so that the carriage becomes movable, and changer movement cassette detection means for detecting the types of the respective ink ribbon cassettes of the stocker based on the fact that the carriage ribbon type identifying means identifies the ribbon type of the ink ribbon cassette held by the carriage during the ink ribbon cassette delivery of the changer.

According to the described arrangement, the changer movement cassette detection means sets the changer in the ribbon delivery state, and the kind of the ribbon of the ink ribbon cassette is recognized by the carriage ribbon type identifying means. As a result, the kind of the ink ribbon cassette stored in the stocker is recognized, thereby executing a printing.

Therefore, it is not required to pay an attention to the installation order to the ink ribbon cassettes, thereby permitting an improved handling. Moreover, the stocker ribbon type identifying means for identifying the kind of the ink ribbon cassette stored in the stocker can be eliminated, thereby achieving an improved accuracy in installing the ink ribbon cassettes at low cost, and preventing an occurrence of a print error due to an erroneous installation of the ink ribbon cassette.

An object of the present invention is to provide a printer system with an automatic ink ribbon cassette exchange function, provided with a sensor for detecting a current position of a stocker, i.e., whether an upper position raised by a changer or a lower position lowered by the changer, for controlling such that the carriage is not activated when the stocker is not set in the upper position, thereby preventing a printer from breaking down.

If the sensor for detecting the current position of the stocker is not provided, for example, a stepping motor for measuring an accurate amount of rotations is required in order to raise or lower the stocker, thereby presenting the problem that a high cost is incurred. In order to solve this problem, the sensor for detecting the current position of the stocker is adopted. This permits a motor (DC motor, etc.) which is not provided with a function for measuring the accurate amount of rotations to be used. Since such motor can be obtained at a reasonable price, the cost can be reduced.

Another object of the present invention is to provide a printer system with an automatic ink ribbon cassette exchange function, which prevents a motor from overheating when abnormality has occurred by stopping the operation of the changer if the operation of the changer is not completed within a predetermined time period.

A still another object of the present invention is to provide a printer system with an automatic ink ribbon cassette exchange function, which permits a print sheet to be set immediately when the next printing operation is to be started by controlling the stocker to be lowered upon completing a current printing operation.

The convention printer system with an ink ribbon cassette automatic exchange function is associated with the problem that for the distance the stocker is raised, the cabinet for housing the printer must be made higher. The present invention has succeed in preventing this problem. Therefore, a still another object of the present invention is to provide a printer system with an ink ribbon cassette automatic exchange function, which enables the height of the cabinet for housing the printer to be reduced (the height of the cabinet is adjusted to the height of the printer in which the stocker is lowered) by controlling the stocker to be lowered upon completing the printing operation, i.e., controlling the stocker to be always set in the lower position except when printing.

Yet still another object of the present invention is to provide a printer system with an automatic ink ribbon cassette exchange function, which permits a print sheet to be set immediately when the next printing operation is to be started by controlling the stocker to be lowered if it is determined that the stocker is not set in the lower position upon turning on the power switch (for example, by turning off the power switch during the printing operation). To reduce the height of the cabinet for housing the printer is also an object of the present invention.

When an instruction is given for starting a printing operation, if a print sheet is not set, the user is informed of so, and it is controlled such that the stocker is not raised until the print sheet is set, thereby achieving another object of the present invention that an occurrence of sheet jamming is prevented.

A still another object of the present invention is to provide a printer system with an automatic ink ribbon cassette exchange function, which permits a shorter time required before starting the printing operation which can be achieved by controlling as follows.

When the stocker is raised by the changer after the print sheet is set, it is determined whether or not the kind (color) of the ink ribbon cassette on the carriage is identical with the kind (color) of the ink ribbon cassette to be used first after starting the printing operation. If so, the stocker is raised by the changer with the ink ribbon cassette remaining on the carriage. If not, or if a determination cannot be made, on the other hand, the stocker is raised by the changer after storing therein the ink ribbon cassette on the carriage.

Yet still another object of the present invention is to provide a printer system which permits the kind (color) of the ink ribbon cassette held on the carriage to be recognized by confirming the position in the stocker at which the ink ribbon cassette is taken out.

In order to achieve the described objects, the printer system of the present invention is characterized by including:

a carriage provided with a print head, for holding thereon an ink ribbon cassette, the carriage being movable;

a stocker for storing the ink ribbon cassette so as to be detachable;

a changer for moving the stocker and the carriage closer from one another to be set in a ribbon delivery state for delivering the ink ribbon cassette and moving the stocker and the carriage away from one another to be set in a carriage movable state for allowing the carriage to move;

changer state detection means for detecting whether the changer is set in the ribbon delivery state or the carriage movable state; and control means for stopping a movement of the carriage when the changer is not in the carriage movable state (see FIG. 4).

In the described arraignment, it is preferable that the print head provided on the carriage is a thermal head for miniaturization. However, a print head of a needle dot impact type may be used as well.

According to the described arrangement, when moving the carriage, the changer state detection means detects whether the changer is set in the ribbon delivery state or in the carriage movable state. As a result of this detection, if the changer is not set in the carriage movable state, the movements of the carriage is prevented by the control means.

Therefore, the described arrangement offers the effect that a collision between the carriage and the stocker can be avoided, thereby preventing the carriage driving motor from overheating.

It is preferable that the stocker stores plural ribbon cassettes in different colors, for example, four colors of Y (yellow)/ M(magenta)/ C(cyan)/ B(black) so as to be detachable. The stocker may be of a lateral type for storing the ink ribbon cassettes two-dimensionally, or may be of a vertical type for storing the ink ribbon cassettes by stacking them.

It is preferable that the changer can move the stocker and the carriage between the ribbon delivery state and the carriage movable state by rotating a cam. However, other driving system may be adopted as well. For the control means, it is convenient to use the microprocessor.

Another printer system with an automatic ink ribbon cassette exchange function having the described arrangement, is characterized by further including:

print-end state changer automatic moving means for automatically moving the changer from the carriage movable state to the ribbon delivery state after the printing operation by the carriage is completed.

Upon completing the printing operation, the changer is automatically moved from the carriage movable state to the ribbon delivery state.

Therefore, a print sheet for the next printing operation can be inserted smoothly, and the height of the cabinet can be made shorter.

The printer system of the present invention having the described arrangement may be characterized by further comprising:

power-on state changer automatic moving means for automatically moving the changer to the ribbon delivery state when the state of the changer detected by the changer state detection means is not the ribbon delivery state.

In the described arrangement, upon turning on the power switch, if the detected state of the changer by the changer state detection means is not the ribbon delivery state, the changer is automatically moved to the ribbon delivery state.

Therefore, upon turning on the power switch, even if the state of the changer is not the ribbon delivery state, print sheets for the following printing operation can be inserted smoothly, and the height of the cabinet can be made shorter.

The printer system of the present invention having the described arrangement may be characterized by further comprising:

sheet detection means for detecting a set state of a print sheet;

print start instruction means for instructing to start a printing operation; and sheet state determination means for detecting the set state of the print sheet after the instruction to start the printing operation is given and moving the changer from the ribbon delivery state to the carriage movable state when the print sheet has been set, while when the print sheet has not been set, informing the user of that the print sheet has not been set.

According to the described arrangement, upon the instruction for starting the print operation is given, the set state of the print sheet is detected, and after the print sheet has been set, the changer is moved from the ribbon delivery state to the carriage movable state. On the other hand, if the print sheet has not been set, the user is informed of so.

Therefore, since the movement of the changer can be prevented when the print sheet has not been set, the print sheet can be inserted smoothly (preventing an occurrence of sheet jamming). Moreover, it is possible to urge the user to insert the print sheet.

The printer system of the present invention having the described arrangement may be characterized by further including:

carriage ribbon kind recognition means for recognizing a kind of an ink ribbon cassette held on the carriage;

print ribbon kind memory means for storing therein a kind of the ink ribbon cassette to be used first in the printing operation; and ribbon switching means which recognizes the kind of the ink ribbon cassette held on the carriage when the instruction to start the printing operation is given, the ribbon switching means being arranged so as to move the changer from the ribbon delivery state to the carriage movable state with the ink ribbon cassette remaining on the carriage if a recognized kind of the ink ribbon cassette is identical with the kind of the ink ribbon cassette stored in the print ribbon kind memory means, while move the changer from the ribbon delivery state to the carriage movable state after storing therein the ink ribbon cassette taken out of the carriage if the recognized kind of the ink ribbon cassette is not identical with the kind of the ink ribbon cassette stored in the print ribbon kind memory means or the kind of the ink ribbon cassette held on the carriage cannot be recognized.

According to the described arrangement, when the instruction to start the printing operation is given, the kind of the ink ribbon cassette held on the carriage is recognized. As a result, if the recognized kind of the ink ribbon cassette is identical with the kind of the ink ribbon cassette stored in the print ribbon kind memory means, the changer is moved from the ribbon delivery state to the carriage movable state with the ink ribbon cassette remaining on the carriage. On the other hand, when the recognized kind of the ink ribbon cassette is not identical with the ink ribbon cassette stored in the ribbon kind memory means, or when the kind of the ink ribbon cassette held on the carriage cannot be recognized, the changer is moved from the ribbon delivery state to the carriage movable state with the ink ribbon cassette being taken out of the carriage.

According to the described arrangement, if the ink ribbon cassette held on the carriage is the ink ribbon cassette to be used first, the exchange of the ink ribbon cassette is not performed, thereby permitting a shorter time required before starting the printing operation.

Another printer system of the present invention is characterized by including:

a carriage provided with a print head for holding thereon an ink ribbon cassette, the carriage being movable, a stocker for storing therein ink ribbon cassettes so as to be detachable;

a changer for moving the stocker and the carriage closer from one another to be set in a ribbon delivery state for delivering the ink ribbon cassette and moving the stocker and the carriage away from one another to be set in a carriage movable state for allowing movements of the carriage;

changer state detection means for detecting whether the changer is set in the ribbon delivery state or in the carriage movable state;

time measuring means for measuring a time required for moving the changer from the ribbon delivery state to the carriage movable state and a time required for moving the changer from the carriage movable state to the ribbon delivery state; and changer stopping means for stopping the movement of the changer when a desired state of the changer is not detected by the changer state detection means after the time measuring means measures a predetermined time elapsed.

According to the described arraignment, when moving the changer, a predetermined time is measured by the time measuring means. As a result, if the desired state of the changer is not achieved after the time measuring means measures the predetermined time elapsed, the movement of the changer is stopped by the changer stopping means.

Therefore, the changer can be prevented from breaking down, and the changer driving motor can be prevented from overheating.- .

In order to achieve the aforementioned objects, the printer system of the present invention may be characterized by including:

a carriage provided with a print head, for holding thereon an ink ribbon cassette, the carriage being movable;

a stocker for storing therein plural ink ribbon cassettes so as to be detachable, the stocker including storage detection means for detecting whether or not each in ribbon cassette is stored;

a changer for moving the stocker and the carriage closer from one another to be set in a ribbon delivery state for delivering the ink ribbon cassette and moving the stocker and the carriage away from one another to be set in a carriage movable state for allowing movements of the carriage;

stocker ribbon kind memory means for storing therein kinds of the plural ink ribbon cassettes set in the stocker based on a stored position of each ink ribbon cassette; and stocker position ribbon kind determining means for detecting by the storing detection means the position of the ink ribbon cassette taken out of the stocker so as to determine the kind of the ink ribbon cassette stored in the stocker ribbon kind memory means.

According to the described arrangement, the kind of the ink ribbon cassette stored in the carriage can be determined based on the position of the stocker from which the ink ribbon cassette is taken out.

Therefore, even if the kind of the ink ribbon cassette held on the carriage cannot be recognized, the kind of the ink ribbon cassette can be identified from the state of the stocker. Therefore, such troublesome operation that the ink ribbon cassette held on the carriage is set back to the stocker, and is mounted on the carriage again, thereby permitting a shorter time required before starting the printing operation.

For a fuller understanding of the nature and advantages of the invention, reference should be made to the ensuing detailed description taken in conjunction with the accompanying drawings.

BRIEF DESCRIPTION OF THE DRAWINGS

FIG. 18 is a view illustrating one example wherein the user inputs the order in which the remaining amount of the ink ribbon cassette becomes less.

FIG. 19 is an explanatory view showing information of the remaining amounts of the respective ink ribbons which are stored in a memory device.

FIG. 20 is an explanatory view illustrating information of the holding positions of the respective ended ink ribbon cassettes which are stored in a memory device.

FIG. 21 is a view illustrating one example of displayed screen for informing the user of the holding positions of the respective ended ink ribbon cassettes.

FIG. 27 is a view illustrating one example of displayed screen for requesting the user to input the colors of the ink ribbon cassette.

FIG. 30 is an explanatory view showing the relation between the positions of the respective identification holes and the ribbon types of the respective ink ribbon cassettes.

FIG. 34 is an explanatory view showing the relation between the positions of the respective identification holes and the ribbon types of the respective ink ribbon cassettes.

FIG. 41 is an explanatory view showing one example of the holding states of the respective ink ribbon cassettes.

FIG. 42 is another explanatory view showing one example of the holding states of the respective ink ribbon cassettes.

FIG. 43 is an explanatory view showing one example of the ink ribbon cassettes required for the printing mode stored in the memory device.

FIG. 44 is an explanatory view showing one display example of the suitable holding state data of the respective ink ribbon cassettes stored in the memory device.

FIG. 45 is an explanatory view showing one display example of the screen for inputting the types of the respective ink ribbon cassettes of the stocker.

FIG. 46 is an explanatory view showing one storing example of the holding states of the ribbon types of the respective ink ribbon cassettes.

FIG. 49 is an explanatory view showing the states where the existence and non-existence of each ink ribbon cassette of the stocker is stored in the memory device.

FIG. 50 is an explanatory view showing one storing example of the holding states of the ribbon types of the respective ink ribbon cassettes.

FIG. 51 is an explanatory view showing a table for judging the up and down positions of the stocker according to the on and off states of the respective changer upper end and lower end sensors.

FIG. 59 is an explanatory view showing the storing state wherein the types of the respective ink ribbon cassettes which are held by the stocker.

FIGS. 60(*a*) and 60(*b*) are explanatory views showing the storing state wherein the respective ink ribbon cassettes holding states of the stocker.

FIG. 61 is an explanatory view illustrating one example of a conventional color ink ribbon.

FIG. 62 is another explanatory view illustrating one example of a conventional color ink ribbon.

FIG. 73 is an explanatory view illustrating a conventional printer.

FIG. 74 is an explanatory view illustrating another conventional printer.

FIG. 75 is an explanatory view illustrating a still another conventional printer.

DESCRIPTION OF THE EMBODIMENTS

[FIRST EMBODIMENT]

The following descriptions will discuss the first embodiment of the present invention in reference to FIG. 5 through FIG. 21. However, the present invention is not limited to this preferred embodiment.

Figure 1:
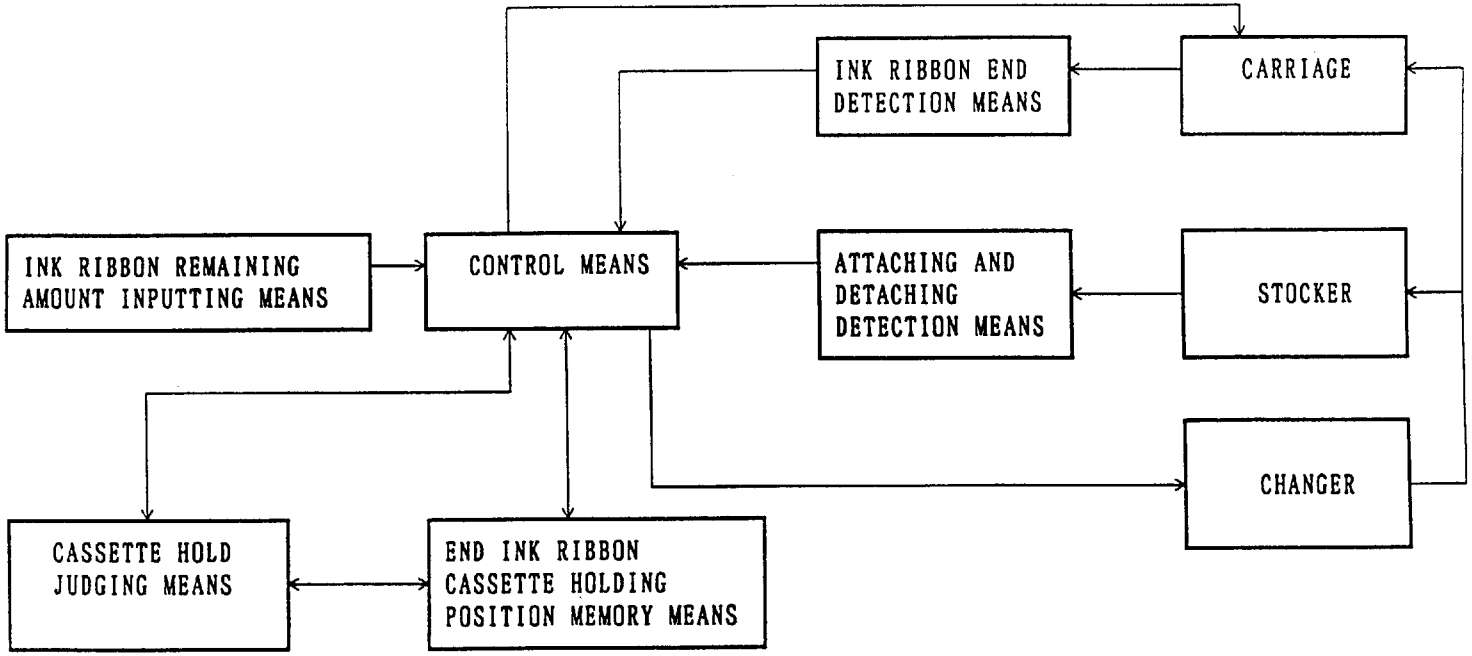
FIG. 1 is a view corresponding to a claim of a printer system in accordance with the present invention.
Figure 2:
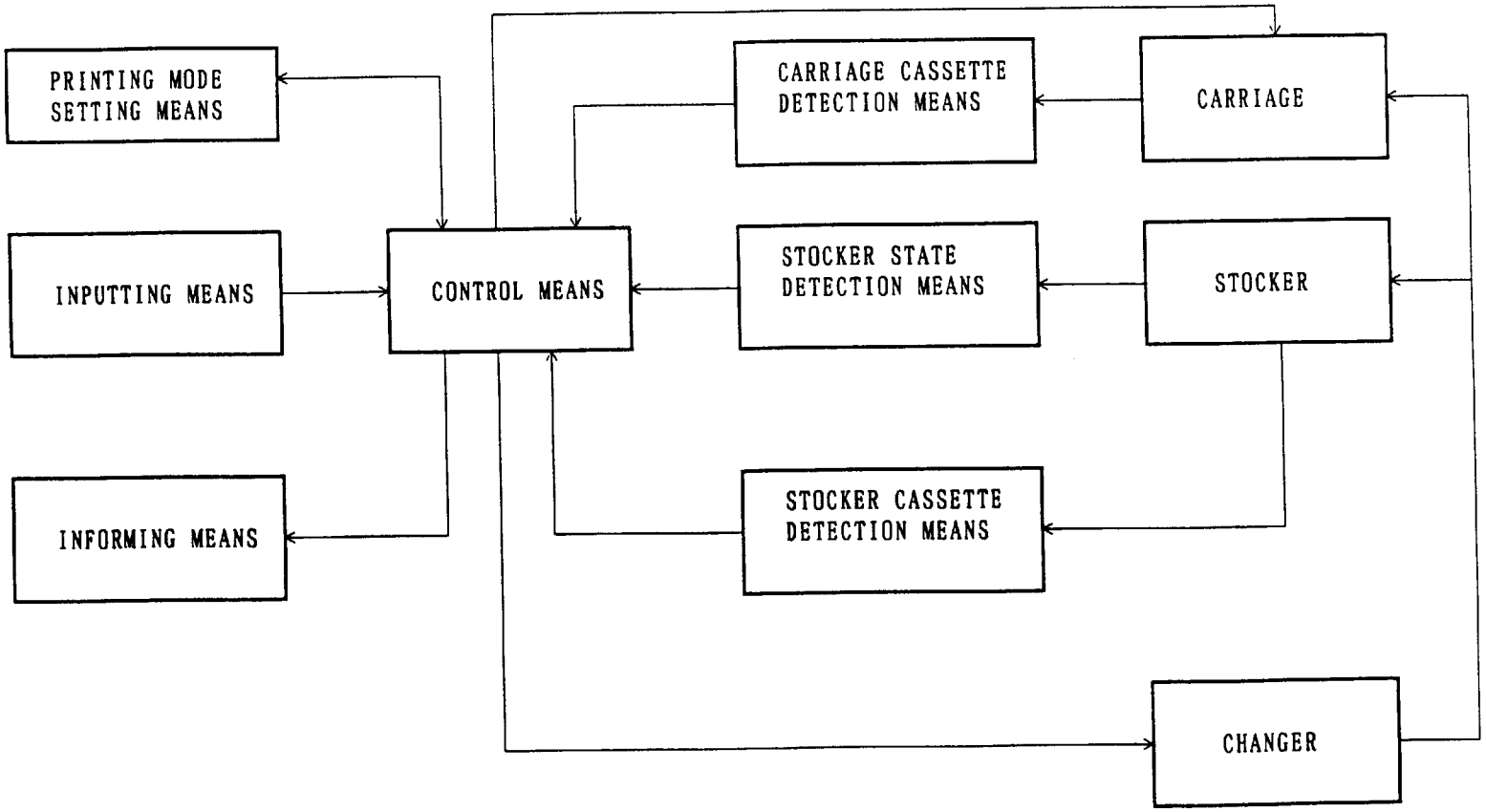
FIG. 2 is a view corresponding to a claim of another printer system in accordance with the present invention.
Figure 3:
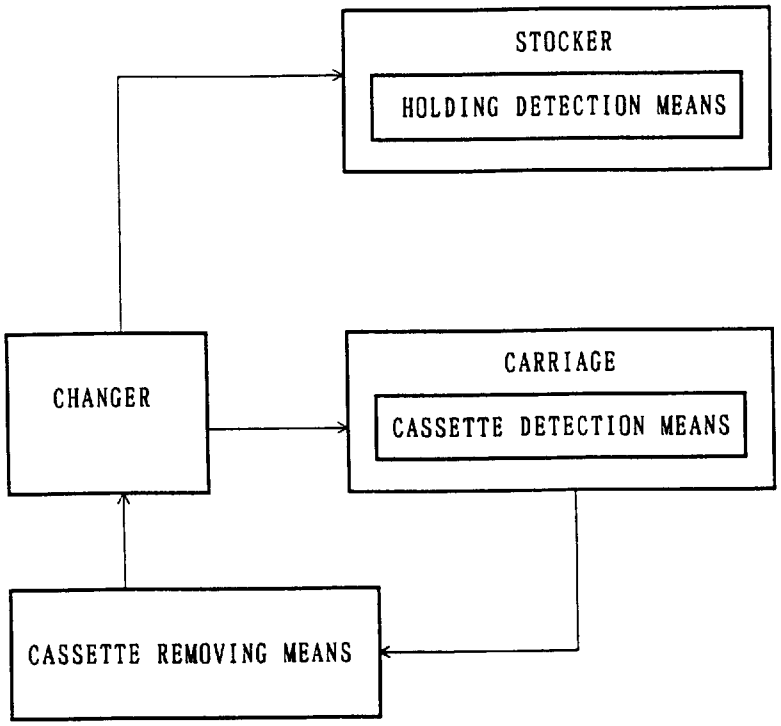
FIG. 3 is a view corresponding to a claim of a still another printer system in accordance with the present invention.
Figure 4:
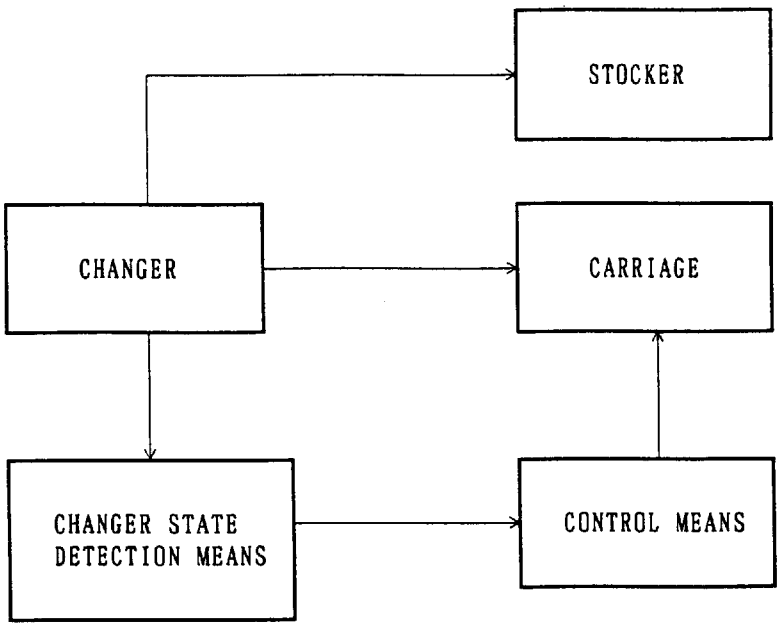
FIG. 4 is a view corresponding to a claim of a yet another printer system in accordance with the present invention.
Figure 5:
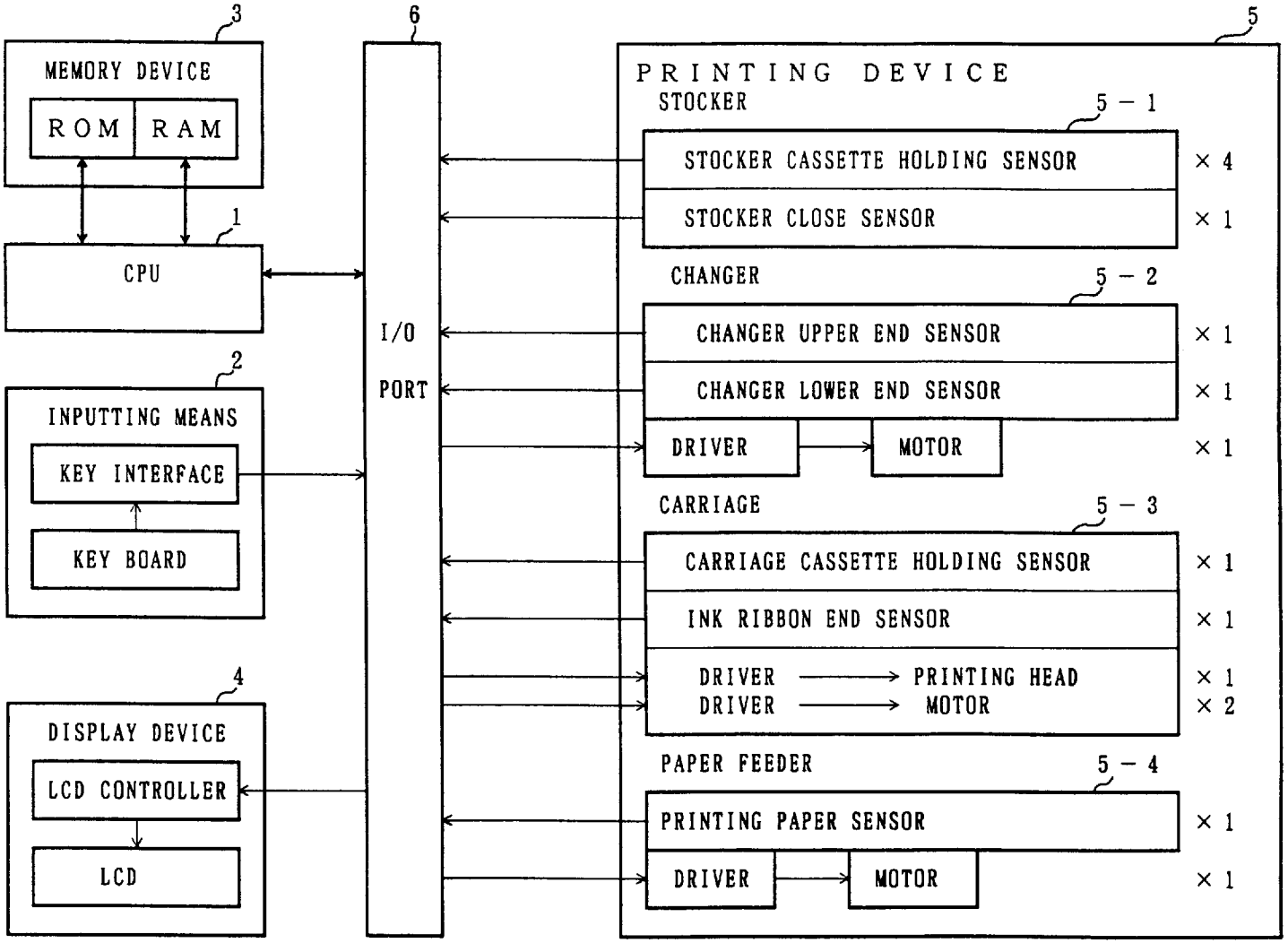
FIG. 5 is a block diagram illustrating the basic structure of an ink ribbon cassette automatic changer printer.

FIG. 5 is a block diagram showing a basic configuration of a computer system such as a word processor including a printer, a personal computer, etc.

The ink ribbon cassette automatic changer printer system in accordance with the present invention, as illustrated in FIG. 5, is provided with a control and operation (hereinafter referred to as CPU (Central Processing Unit)) 1 for carrying, out (1) the control of each operation of the constituent elements and (2) a variety of calculations.

A memory device 3 is connected with the CPU 1. An input device 2, a display device 4, and a print device 5 are respectively connected with the CPU 1 through an I/O port 6.

The memory device 3 is composed of (1) a RAM (Random Access Memory) to and from which document data, image data and a variety of variable data can be stored and can be read out (2) a ROM (Read Only Memory) in which control programs for operating the CPU 1 and other programs are stored.

The input device 2 is a key board, for inputting the document data and the user's instructions, which is connected with the CPU 1 through a key interface. The input device 2 may be connected to a color image scanner (not illustrated) for inputting color image data.

An LCD (Liquid Crystal Display) for displaying the document data, image data or the massages for the user is connected with the CPU 1 as the display device 4 through an LCD controller.

The print device 5 is a print device (ink ribbon cassette automatic changer printer) for printing the document data and the image data. The print device 5 is provided with (1) a carriage 5-3, which is movable in a direction parallel to the platen, has a thermal head, and can hold one ink ribbon cassette, (2) a stocker 5-1 which can hold, above the carriage 5-3 in parallel, four ink ribbon cassettes in a direction parallel to the moving direction of the carriage 5-3, (3) a changer 5-2 which can remove the ink ribbon cassette held in an arbitrary position of the stocker 5-1 so as to attach it onto the carriage 5-3 or which can remove the ink ribbon cassette held by the carriage 5-3 so as to attach it to an arbitrary position of the stocker 5-1, the arbitrary position being the position where no ink ribbon cassette is held, and (4) a paper feeder 5-4 for feeding the printing paper.

The stocker 5-1 is provided with (a) four stocker cassette holding sensors for detecting whether or not the respective four ink ribbon cassettes are held, and (b) a stocker close sensor for detecting whether or not the stocker 5-1 is opened so that the user can easily change the ink ribbon cassette.

The changer 5-2 is provided with a changer upper end sensor and a changer lower end sensor. The changer upper end sensor is provided for judging whether or not the stocker 5-1 is in a raised state while the changer lower end sensor is provided for judging whether or not the stocker 5-1 is in a descendent state. The changer 5-2 is further provided with a motor for elevating the changer 5-2 and a driver for driving the motor. The carriage 5-3 is provided with (1) a carriage cassette holding sensor for detecting whether or not the ink ribbon cassette is held on the carriage 5-3, (2) an ink ribbon end sensor for detecting whether or not the ink ribbon is ended during the printing, (3) a printing head for carrying out the printing, (4) a driver for applying a voltage to the printing head, (5) a motor for driving the carriage 5-3, (6) a motor for making the printing head come into contact with the printing paper and for rewinding the ink ribbon and (7) two drivers for driving the respective motors (5) and (6).

The paper feeder 5-4 is provided with a printing paper sensor for judging whether or not the printing paper is set, a motor for feeding the printing paper and a driver for driving the motor.

Note that the outputs of the respective sensors are inputted to the CPU 1 through an I/O port 6, the drivers are driven by the CPU 1 through the I/O port 6.

FIGS. 6 through 15 are explanatory views illustrating the ink ribbon cassette automatic changer printer 5.

Figure 6:
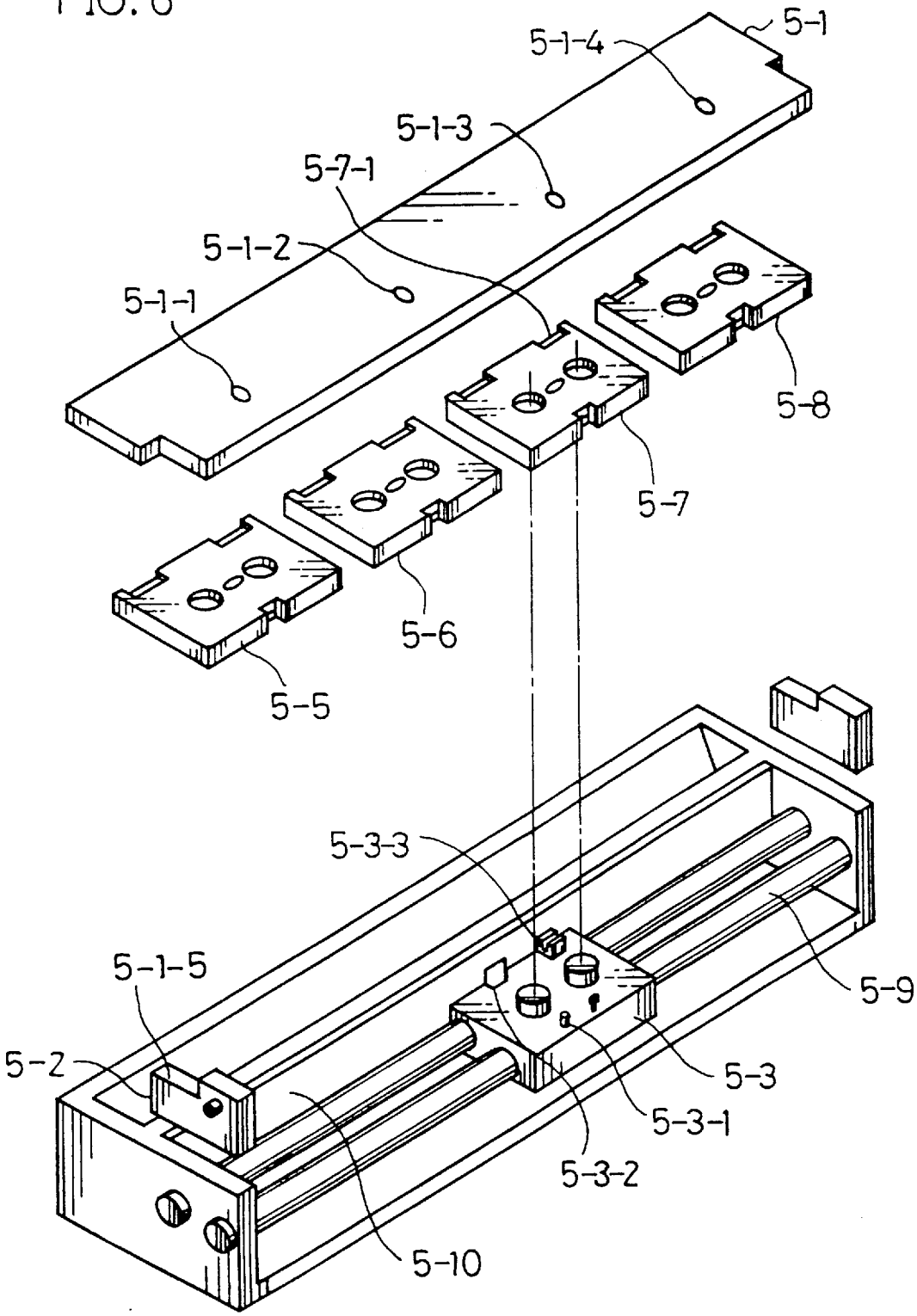
FIG. 6 is an explanatory view illustrating how ink ribbon cassettes are held by a stocker.

In FIG. 6, the stocker 5-1 can hold the ink ribbon cassettes 5-5 through 5-8, and is provided with stocker cassette holding sensors 5-1-1 through 5-1-4 for detecting whether or not the respective ink ribbon cassettes are held.

Figure 7A:
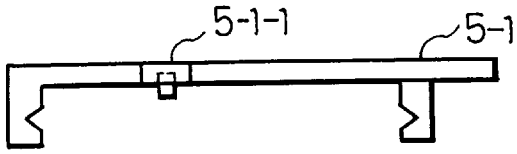
FIGS. 7(*a*) and 7(*b*) are explanatory views illustrating a holding state of the stocker.
Figure 7B:
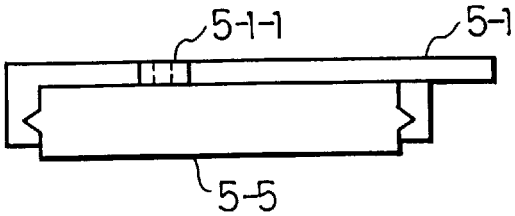

FIGS. 7(*a*) and 7(*b*) are explanatory views illustrating the stocker cassette holding sensor 5-1-1 (the other stocker cassette holding sensors 5-1-2 through 5-1-4 have the same structure as the stocker cassette holding sensor 5-1-1).

The stocker cassette holding sensor 5-1-1 uses a switch which turns on when a projection is pushed down. According to FIG. 7(*a*), the stocker cassette holding sensor 5-1-1 is in the off state because no ink ribbon cassette is held by the stocker 5-1. According to FIG. 7(*b*), the stocker cassette holding sensor 5-1-1 is in the on state because the projection is pushed down based on the fact that the ink ribbon cassette 5-5 is held by the stocker 5-1.

Figure 8A:
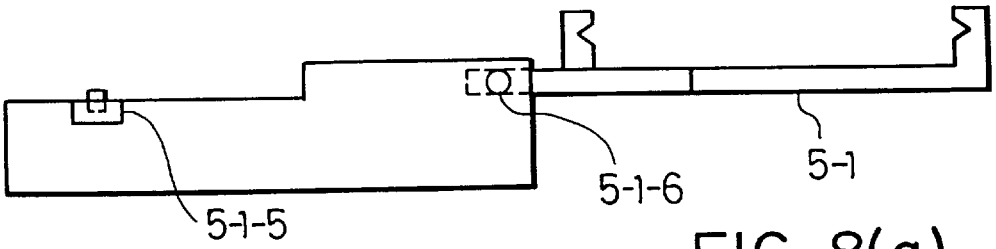
FIGS. 8(*a*) and 8(*b*) are explanatory views illustrating how the stocker is opened.
Figure 8B:
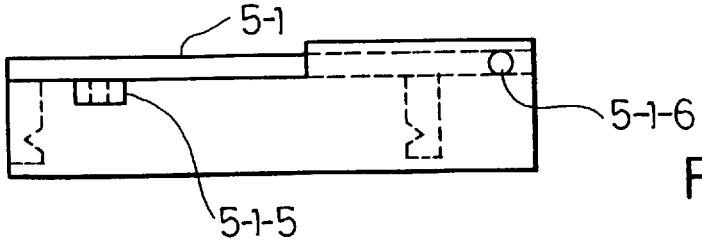
Figure 9A:
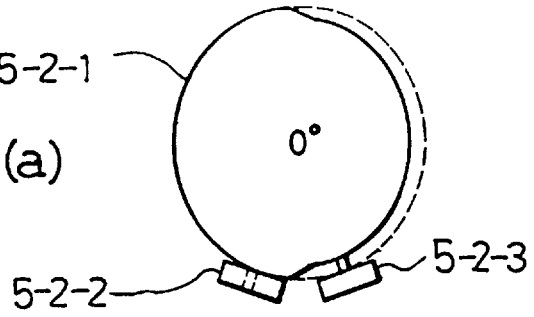
FIGS. 9(*a*) through 9(*d*) are explanatory views illustrating a changer upper end sensor and a changer lower end sensor.
Figure 9B:
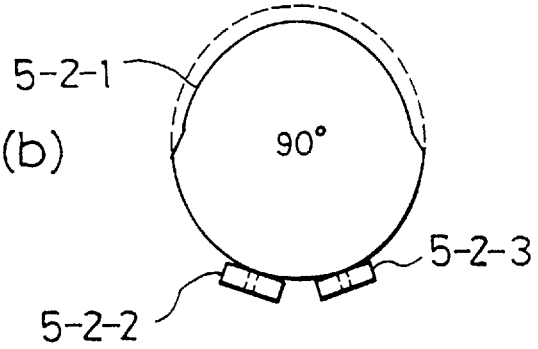
Figure 9C:
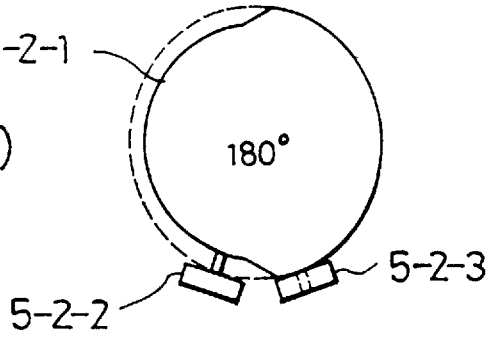
Figure 9D:
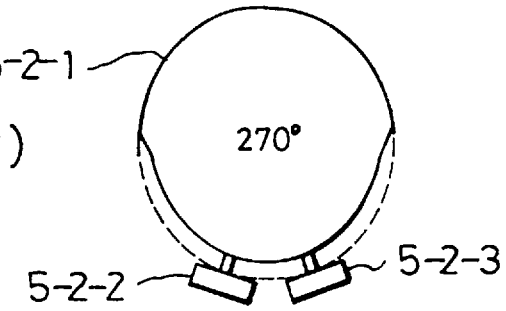

The stocker 5-1 can be opened, as illustrated in FIG. 8(*a*), so that the user can change the ink ribbon cassette with ease, and is provided with a stocker close sensor 5-1-5 for detecting whether or not the stocker 5-1 is opened.

FIGS. 8(*a*) and 8(*b*) are explanatory views illustrating the stocker close sensor 5-1-5. The stocker close sensor 5-1-5 uses a switch which turns on when a projection is pushed down. According to FIG. 8(*a*), the stocker 5-1 is in the open state, so the stocker close sensor 5-1-5 is in the off state. According to FIG. 8(*b*), the stocker close sensor 5-1-5 changes into the on state because the projection is pushed down based on the fact that the stocker 5-1 is closed.

The changer 5-2 can move up and down the stocker 5-1, and is arranged so that the ink ribbon cassette is delivered between the stocker 5-1 and the carriage 5-3. The changer 5-2 has a changer upper end sensor 5-2-2 and a changer lower end sensor 5-2-3.

FIGS. 9(*a*) through 9(*d*) are explanatory views illustrating the changer upper end sensor 5-2-2 and the changer lower end sensor 5-2-3. As illustrated in the Figures, a cam 5-2-1 rotates in synchronism with the changer 5-2. More specifically, the cam 5-2-1 rotates by 180 degrees in accordance with the movement of the stocker 5-1 from an upper end position to a lower end position.

When the stocker 5-1 is in the upper end position (corresponding to zero degree), its state becomes like FIG. 9(*a*). In such a state, the changer upper end sensor 5-2-2 changes into the on state, while the changer lower end sensor 5-2-3 changes into the off state. When the stocker 5-1 is in the lower end position (corresponding to 180 degrees), its state becomes like FIG. 9(*c*). In such a state, the changer upper end sensor 5-2-2 changes into the off state, while the changer lower end sensor 5-2-3 changes into the on state.

The states illustrated in FIGS. 9(*b*) and 9(*d*) where in the changer upper end sensor 5-2-2 and the changer lower end sensor 5-2-3 are both in the on state or both in the off state indicate the state wherein the stocker 5-1 is between the upper and lower end positions.

As illustrated in FIG. 6, the carriage 5-3 is guided by a shaft 5-9 and is moved by a carriage drive mechanism (not illustrated) in parallel to a platen 5-10 so that the printing is carried out by a printing head 5-3-2. Note that the printing head 5-3-2 is a thermal head.

The carriage 5-3 is provided with a carriage cassette holding sensor 5-3-1 by which it can be judged whether or not the carriage 5-3 holds an ink ribbon cassette. The carriage cassette holding sensor 5-3-1 also uses the switch similar to those of the stocker cassette holding sensors 5-1-1 through 5-1-4.

The carriage 5-3 is provided with an ink ribbon end sensor 5-3-3 by which it can be detected that the ink ribbon has been ended during the printing.

Figure 10:
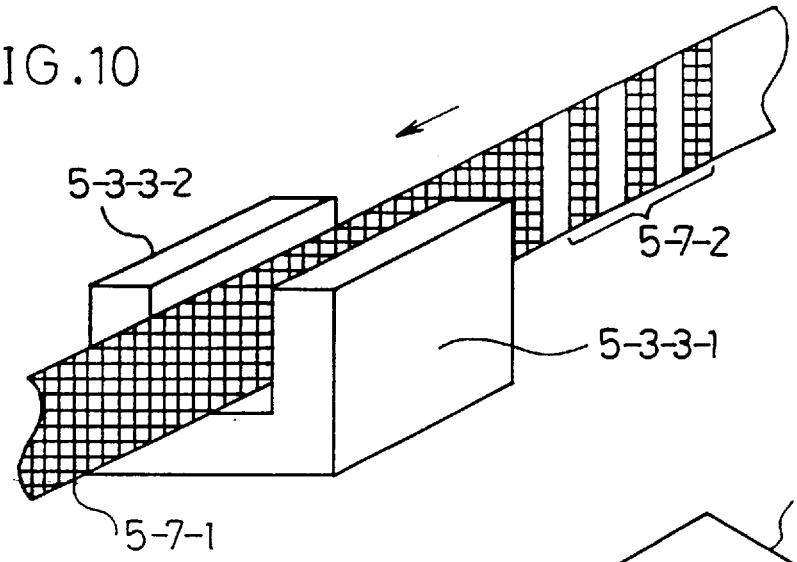
FIG. 10 is an explanatory view illustrating an ink ribbon end sensor.

FIG. 10 is an explanatory view illustrating the ink ribbon end sensor 5-3-3. FIG. 10 illustrates the state where an ink ribbon 5-7-1 is sandwiched between a light emitting section 5-3-3-1 and a light receiving section 5-3-3-2 of the ink ribbon end sensor 5-3-3.

There is provided with an ink ribbon end mark 5-7-2 near an end portion of the ink ribbon 5-7-1, the end portion having alternate transparent portion and non-transparent portion.

In ordinary, the ink ribbon scarcely transmits the incident light, so the light does not reach the light receiving section 5-3-3-2. However, when the ink ribbon 5-7-1 is wound up in an arrow direction and the ink ribbon end mark 5-7-2 passes through the ink ribbon end sensor 5-3-3, then the light receiving section 5-3-3-2 receives light pulses and converts it into electric pulses so as to output, thereby enabling to detect that the ink ribbon has been exhausted.

Figure 11:
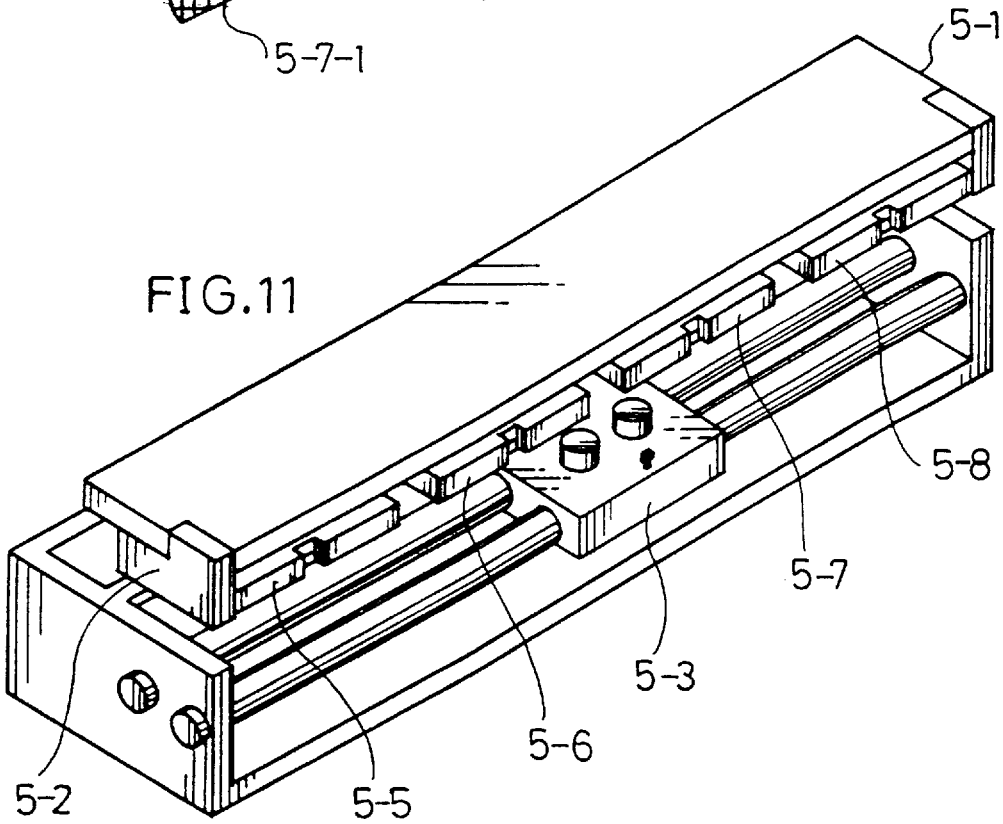
FIG. 11 is an entire view illustrating an ink ribbon cassette automatic changer printer in accordance with one embodiment of the present invention.

FIG. 11 is a view illustrating the state where the changer 5-2 moves up the stocker 5-1. The carriage 5-3 is movable in a direction parallel to a platen 5-10 only when the stocker 5-1 is in the upper end position.

Figure 12:
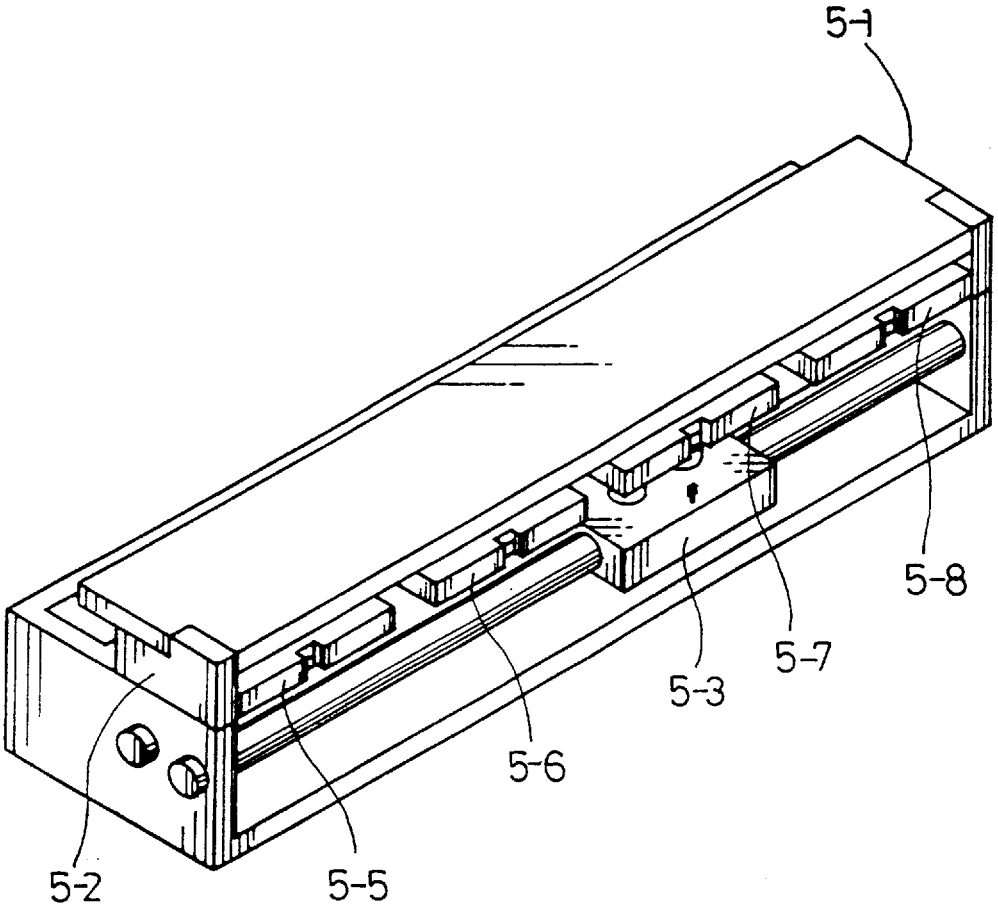
FIG. 12 is an entire view illustrating another ink ribbon cassette automatic changer printer in accordance with one embodiment of the present invention.

In FIG. 11, the stocker 5-1 holds the ink ribbon cassettes 5-5 through 5-8, while the carriage 5-3 holds no ink ribbon cassette. In order to attach the ink ribbon cassette 5-7 to the carriage 5-3, as illustrated in FIG. 12, it is required (1) to move the carriage 5-3 beneath the ink ribbon cassette 5-7, (2) to move down the stocker 5-1 by the changer 5-2, and (3) to move up the stocker 5-1 after the carriage 5-3 has held the ink ribbon cassette 5-7.

Figure 13:
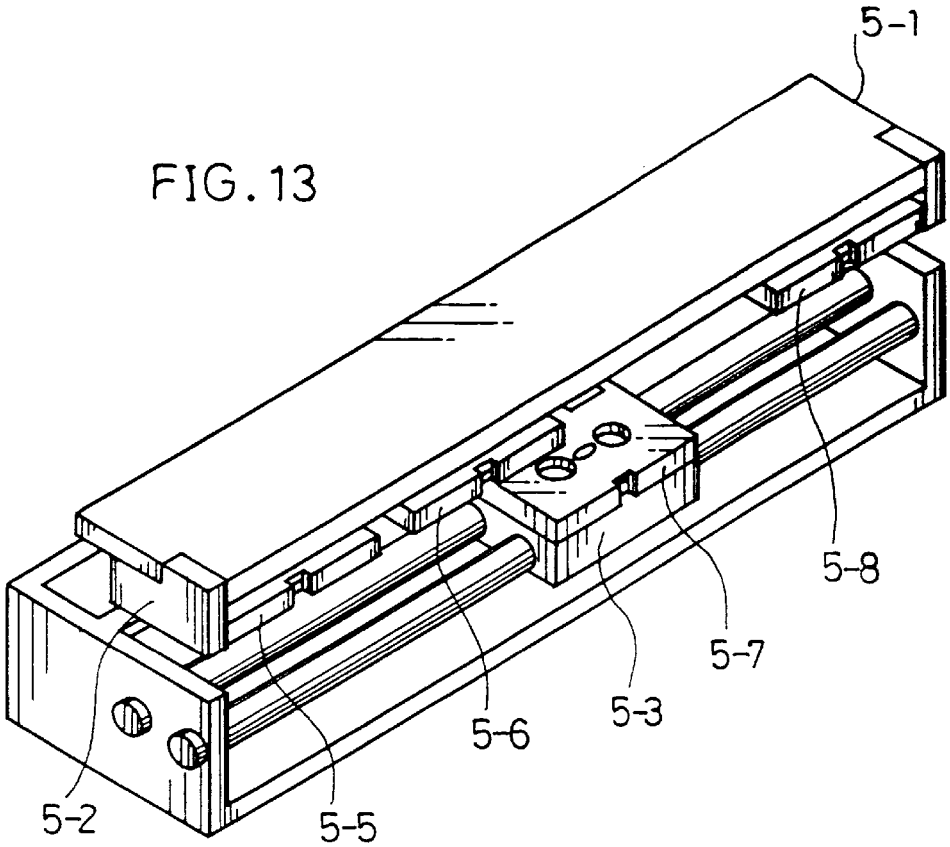
FIG. 13 is an entire view illustrating a still another ink ribbon cassette automatic changer printer in accordance with one embodiment of the present invention.

FIG. 13 is a view illustrating the state where the stocker 5-1 is again moved up by the changer 5-2 after the ink ribbon cassette 5-7 is attached to the carriage 5-3. In such a state, the carriage 5-3 can carry out the printing with the use of the ink ribbon cassette 5-7.

When attaching one of the other ink ribbon cassettes to the carriage 5-3, it is required (1) to move the carriage 5-3 beneath a vacant position in the stocker 5-1, (2) to move down the stocker 5-1 by the changer 5-2, and (3) to move up the stocker 5-1 after the carriage 5-3 has held the ink ribbon cassette 5-7. This causes the ink ribbon cassette 5-7 to return to the original position of the stocker 5-1, thereafter, the above-mentioned other ink ribbon cassette can be attached to the carriage 5-3 in accordance with the foregoing manner. Note that the detail explanation how to deliver the ink ribbon cassette between the stocker 5-1 and the carriage 5-3 will be later described.

Figure 14:
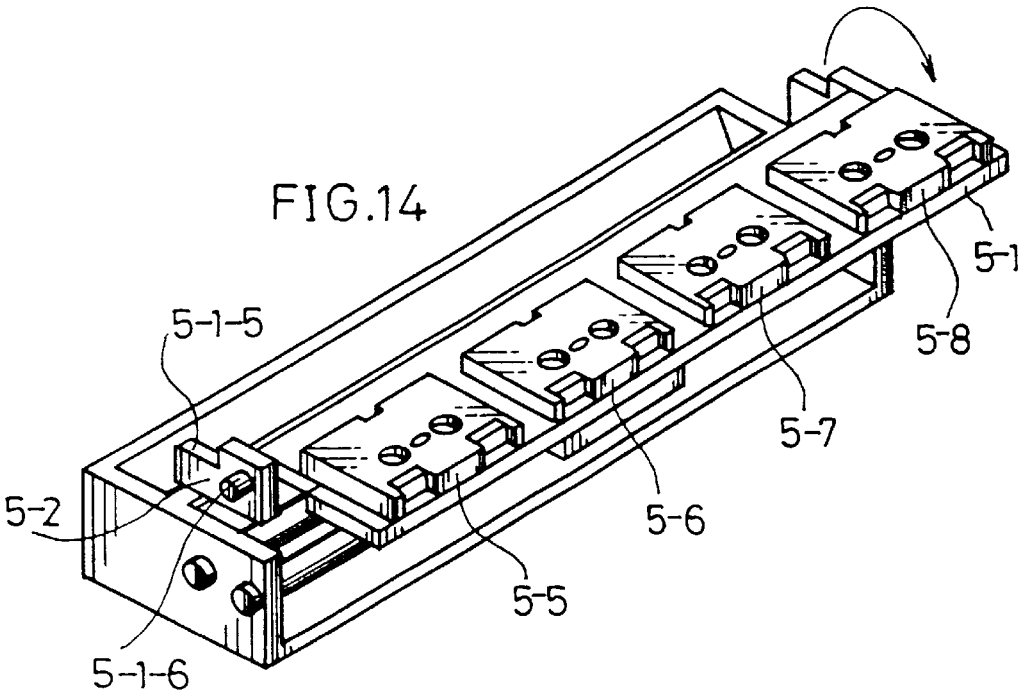
FIG. 14 is an entire view illustrating a still another ink ribbon cassette automatic changer printer wherein the stocker is opened.
Figure 15A:
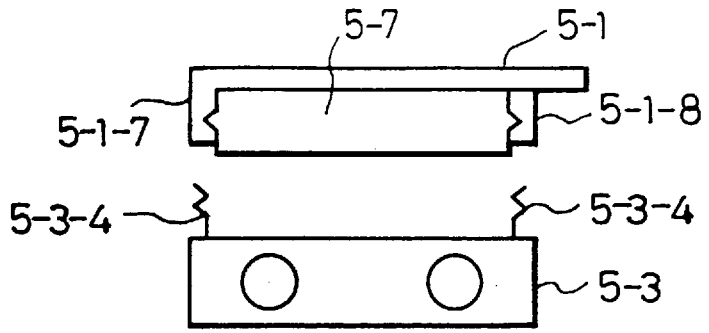
FIGS. 15(*a*) through 15(*d*) are explanatory views illustrating how an ink ribbon cassette is delivered between the stocker and a carriage.
Figure 15B:
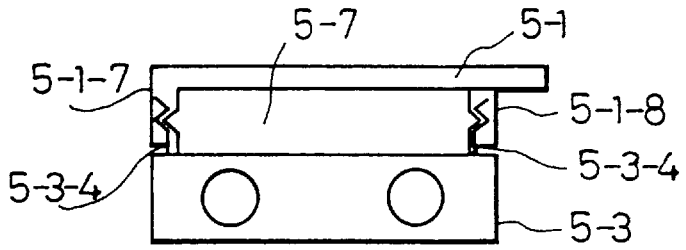
Figure 15C:
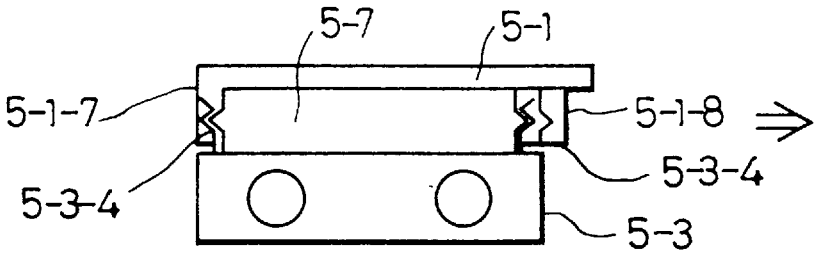
Figure 15D:
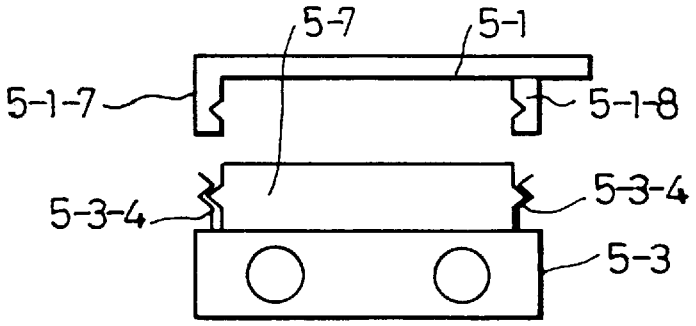

FIG. 14 is a view illustrating the state where the stocker 5-1 is opened. The stocker 5-1 can rotate around a stocker rotation shaft 5-1-6 so as to be opened when the stocker 5-1 remains in the upper end position as illustrated in FIG. 13, thereby ensuring that the user can change the ink ribbon cassettes 5-5 through 5-8. Since the stocker 5-1 is further provided with the stocker close sensor 5-1-5, it can be Judged in accordance with the stocker close sensor 5-1-5 whether the stocker is in the opened state. Note that the stocker close sensor 5-1-5 has already been explained before with reference to FIG. 8(*a*).

FIGS. 15(*a*) through 15(*d*) are explanatory views illustrating the delivery of the ink ribbon cassette 5-7 between the stocker 5-1 and the carriage 5-3. Note that since the outlines of the respective ink ribbon cassettes 5-5 through 5-8 are coincident with each other, the respective ways to deliver are the same accordingly.

In FIG. 15(*a*), the ink ribbon cassette 5-7 is held by the stocker 5-1 through a stocker fix holding claw 5-1-7 and a stocker movable holding claw 5-1-8. The carriage 5-3 is provided with a plurality of carriage fix holding claws 5-3-4 for holding the ink ribbon cassette.

When the ink ribbon cassette 5-7 held by the stocker 5-1 is attached to the carriage 5-3, the changer 5-2 (not illustrated in FIG. 15) moves down the stocker 5-1 as illustrated in FIG. 15(*b*).

FIG. 15(*b*) illustrates that the ink ribbon cassette 5-7 is held by both (1) the stocker 5-1 (the stocker fix holding claw 5-1-7 and the stocker movable holding claw 5-1-8) and (2) the carriage 5-3 (the carriage holding claw 5-3-4). Next, the changer 5-2 moves the stocker movable holding claw 5-1-8 in an arrow direction of FIG. 15(*c*), thereby resulting in that the ink ribbon cassette 5-7 is released from the stocker 5-1.

Then, the changer 5-2 moves up the stocker 5-1. With the movement, the ink ribbon cassette 5-7 is held by the carriage 5-3, thereby causing the stocker 5-1 not to hold the ink ribbon cassette 5-7 (see FIG. 15(*d*)).

In contrast, when the ink ribbon cassette 5-7 held by the carriage 5-3 returns to the stocker 5-1 (see FIG. 15(*d*)), the changer 5-2 moves the stocker movable holding claw 5-1-8 in an arrow direction of FIG. 15(*c*) so that the stocker 5-1 moves down. Then, the changer 5-2 returns the stocker movable holding claw 5-1-8 as it was as illustrated in FIG. 15(*b*), i.e., holds the ink ribbon cassette 5-7 so that the stocker 5-1 moves up. The holding force exerted on the ink ribbon cassette 5-7 is enough greater in the case where it is held by the stocker fix holding claw 5-1-7 and the stocker movable holding claw 5-1-8 than;in the case where it is held by the carriage holding claw 5-3-4. So, this causes that the ink ribbon cassette 5-7 is taken out from the carriage 5-3 (see FIG. 15(*a*)) so as to be attached to the stocker 5-1.

When the changer 5-2 raises and lowers the stocker 5-1, whether or not the stocker movable holding claw 5-1-8 to be moved is determined by a cam (not shown) which rotates by the changer motor for raising or lowering the stocker 5-1.

The cam is allowed to rotate by 180° to move the stocker 5-1 from the lower end to the upper end. When the cam rotates 180° in a clockwise direction, the stocker movable holding claw 5-1-8 is moved, while when the cam rotates 180° in a counterclockwise direction, the stocker movable holding claw 5-1-8 stops moving.

In the present embodiment, the stocker 5-1 has the stocker movable holding claw 5-1-8 in the same number (four in this embodiment) as the number of ink ribbon cassettes that can be stored.

The stocker movable holding claw 5-1-8 in each position includes a claw (not shown) to be pushed up by being in contact with the carriage 5-3 when lowering the stocker 5-1. Here, since only the claw being pushed up is moved by the cam which rotates by the changer motor (not shown), only the stocker movable holding claw 5-1-8 placed right above the carriage 5-3 can be moved.

As described, the ink ribbon cassette can be delivered between the stocker 5-1 and the carriage 5-3, a continuous printing operation is performed without using an assistance of the user.

Figure 16A:
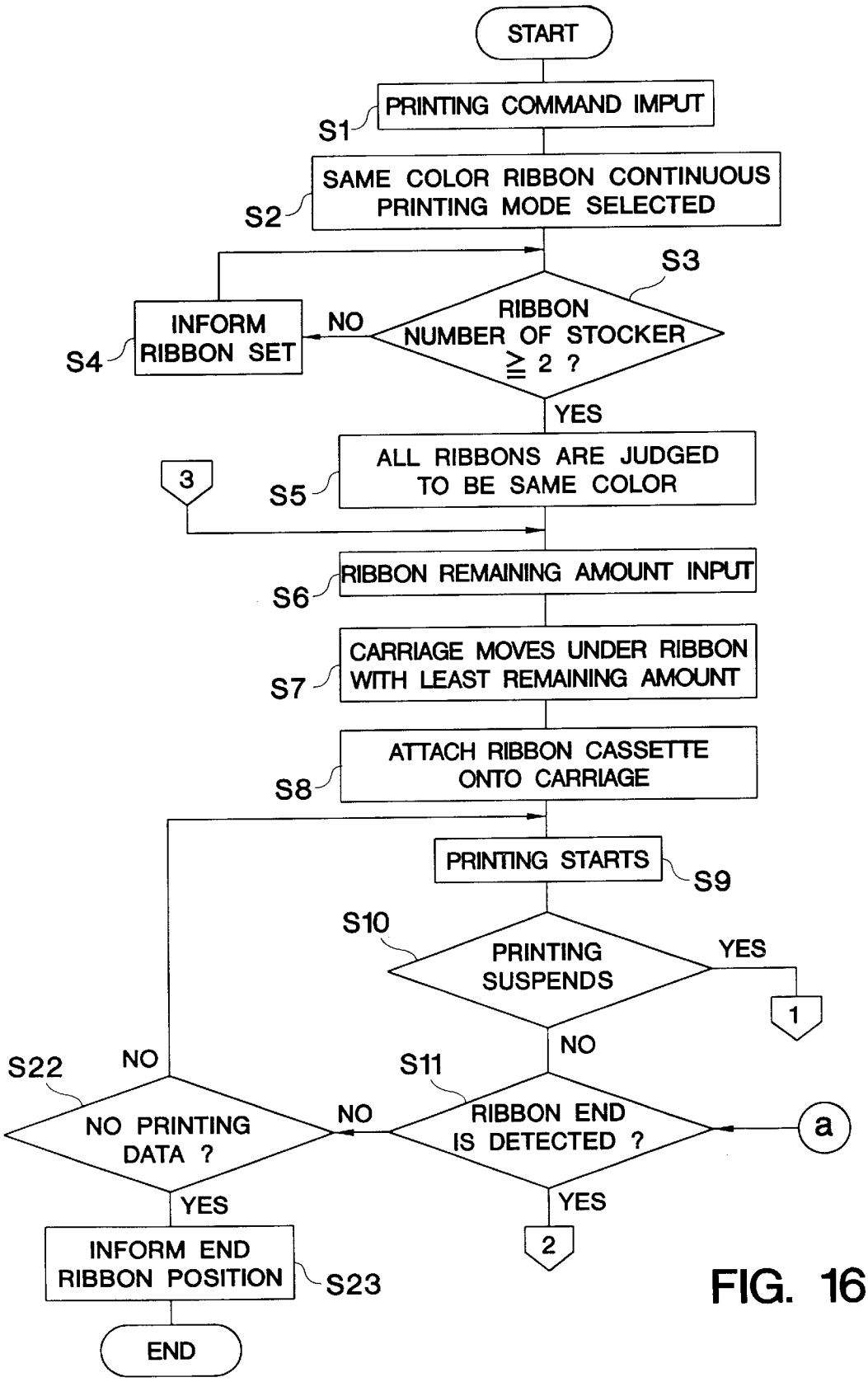
FIGS. 16*a* and 16*b* illustrate a flow chart for controlling of the changing of the ink ribbon cassette during the continuous printing.
Figure 16B:
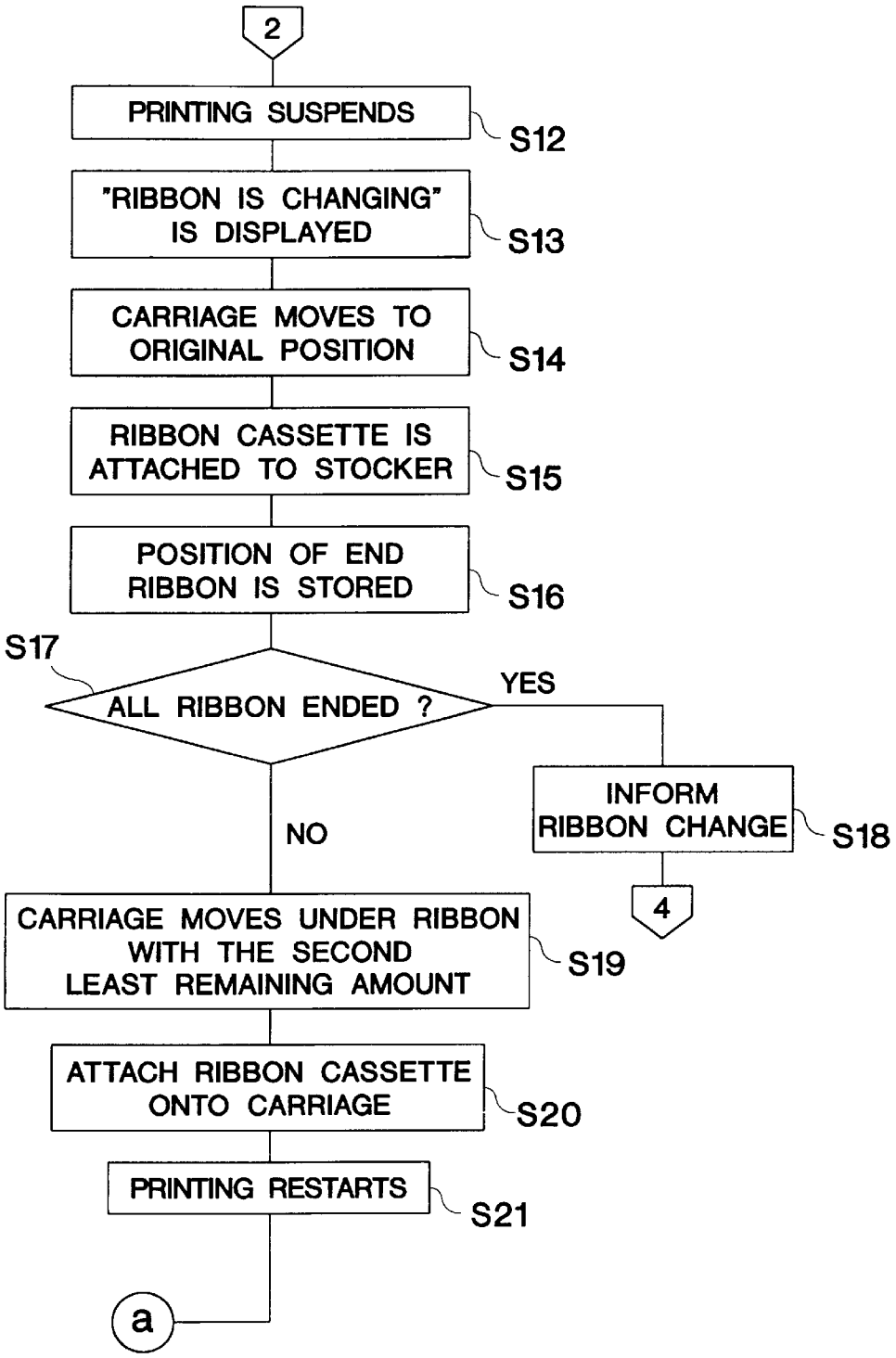

The control system for automatically exchanging the ink ribbon cassette exchange control system of the printer of the present invention will be explained below in reference to the flowchart of FIGS. 16*a* and 16*b*.

In S1, the user inputs a command for printing through the input device 2 (keyboard).

In S2, the user selects the continuous printing mode using the ribbon of one color by the input device 2 (keyboard). Other possible modes include a color printing mode, two colors printing mode, etc. However, since this is not specifically related to the present invention, explanations thereof shall be omitted here.

In S3, it is determined whether or not at least two ink ribbon cassettes are stored in the stocker 5-1 by the stocker cassette holding sensors 5-1-1 through 5-1-4. If only one ink ribbon cassette is stored, it is recognized as an error, and a message for setting additional ink ribbon cassette is displayed on the display device 4 (S4).

In S3, if it is determined that at least two ink ribbon cassettes are stored in the stocker 5-1, it is determined that all of the ink ribbon cassettes are in the same color (S5). Here, it may be arranged so as to determined the color by color detection means provided in the stocker 5-1. Alternatively, the user may indicates which of the ink ribbon cassette is in the same color.

The following explanations will be given in the case of storing four ink ribbon cassettes in the stocker 5-1.

Next, in S6, among the ink ribbon cassette stored in the stocker, the arranged order from the least mount of ink ribbon cassette is inputted by the user through the input device 2 (keyboard).

The described input is displayed on the display device 4 as shown in FIG. 18, and the number of the kink ribbon cassette is inputted from that has the least amount of ink ribbon. For example, in the case where the ink ribbon cassette set in the middle left position (second ink ribbon cassette from the left) of the stocker 5-1 has the least amount of the ink ribbon, the ink ribbon cassette set in the middle right position (third ink ribbon cassette from the left) of the stocker 5-1 has the second least amount of the ink ribbon, the ink ribbon cassette set in the left end position has the second largest amount of the ink ribbon cassette, and the ink ribbon cassette set in the right end position has the largest amount of the ink ribbon cassette, the numbers are inputted through the input device 2 (keyboard) in the order of 2, 3, 1 and 4.

The information indicative of the remaining amount of ink ribbon cassette inputted in S6 is stored in predetermined addresses of the memory device 3 as shown in FIG. 19. For example, when the numbers are inputted in the described order, as shown in FIG. 19, numbers are stored in the order of 3, 1, 2 and 4 from the address of +0.

Here, if the order of the ink ribbon cassettes from the least amount of the ink ribbon is not inputted by the user, for example, when the cancel key is operated in S6, the numbers are stored from the address of +0 in the order of 1, 2, 3 and 4 in the memory device 3.

In this embodiment, the order indicating the remaining amount of ink ribbon is inputted by the user through the input device 2 to be stored in the memory device 3. However, the percentage of the remaining amount of the ink ribbon cassette may be detected automatically by providing an ink ribbon remaining amount detecting device. The described method of detecting the ink ribbon remaining amount is a known technique as disclosed by Japanese Laid-Open Patent Application No. 187779/1991 (Tokukaihei 3-187779).

In the next stage, the ink ribbon cassette which has the least remaining amount of the ink ribbon is determined based on the information indicating the ink ribbon remaining amount (see FIG. 19) stored in the memory device 3. Then, the ink ribbon cassette is take out of the stocker 5-1 by the changer 5-2 to be set on the carriage 5-3 (S8), and a printing operation is executed (S9).

In S10, it is determined whether or not an input is made for stopping a printing operation from the input device 2 (keyboard) by the user. If so, the sequence goes onto S31, and if not, the sequence moves onto S11.

In S11, it is determined that the ink ribbon is used to the end by the ink ribbon end sensor 5-3-3 during the printing operation, the printing operation is temporarily stopped (S12), and a message "ink ribbon cassette being exchanged"

is displayed on the display device 4 in S13, so as to inform the user of the fact that the case of the stoppage of the printing operation is not the operation error.

The ink ribbon cassette which is used up is taken out of the carriage 5-3 by the changer 5-2 and is set at the initial position of the stocker 5-1 (step S14 and S15). Here, the set position of this cassette is stored in a predetermined address of he memory device 3 as the information indicative of the used-up ink ribbon cassette holding position (=1) as shown in FIG. 20 (S16).

In the example shown in FIG. 20, the information "1" is stored in the address of +5 and the address of +6, while information of "0" is stored in other addresses. Therefore, the respective ink ribbon cassettes stored in the middle left position (second ink ribbon cassette from the left end) and the ink ribbon cassette stored in the middle right position (the third ink ribbon cassette from the left end) are used up, while the other ink ribbon cassettes have not being used up.

In S17, it is determined whether or not all of the ink ribbon cassettes stored in the stocker 5-1 have being used up based on information indicative of the end of the ink ribbon cassette holding position stored in the memory device 3 as shown in FIG. 20. If so, i.e., all of the information indicative of the end of ink ribbon cassette holding position are "1", the user is informed of the exchange of the ink ribbon cassette, for example, by displaying it on the display device (S18).

In the case where the described condition is not satisfied, i.e., at least two information indicating the ink ribbon cassette holding position exist, the ink ribbon cassette having the second least amount of the ink ribbon cassette is determined based on: the information indicating the remaining amount of ink ribbon and the information indicating the end of ink ribbon cassette holding position. Then, the ink ribbon cassette is take out of the stocker 5-1 by the changer 5-2 to be mounted on the carriage 5-3 (S19 and S20).

In the case shown in FIG. 19 and FIG. 20, the ink ribbon cassette in the left end position is set. Thereafter, the interrupted printing operation is restarted (S21).

After the printing operation has been completed, the user is informed of the message of exchanging the ink ribbon cassette stored in the position corresponding to the position where the information indicating the used ink ribbon cassette holding position of the stocker 5-1 is 1, and is displayed on the display device 4, for example, as shown in FIG. 21 (S23). FIG. 21 shows that the ink ribbon cassette set in the middle left position (second ink ribbon cassette from the left end) and the ink ribbon cassette to be stored in the middle right position (third ink ribbon cassette from the left end) are used up.

Figure 17:
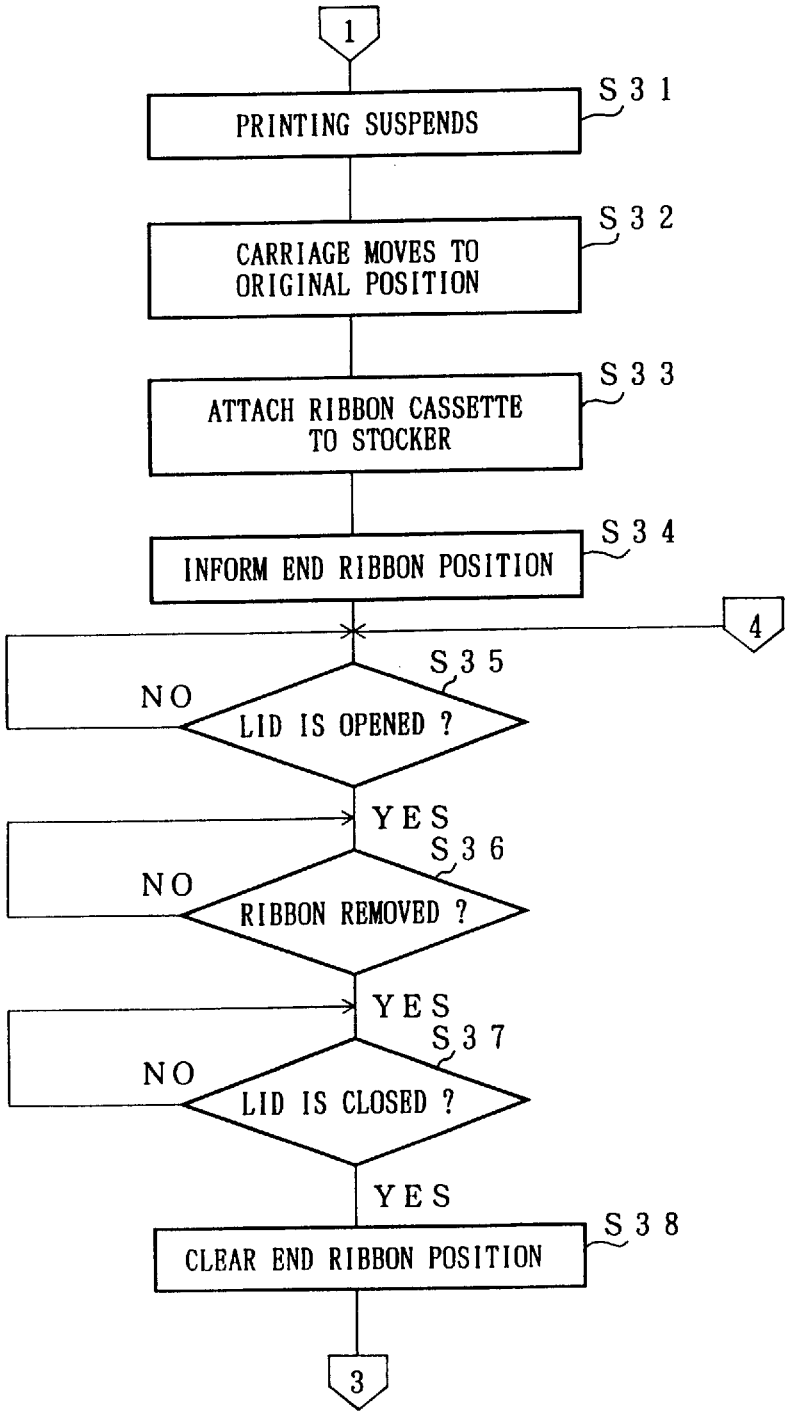
FIG. 17 is a flow chart for a case where an instruction for stopping the printing is entered during the continuous printing.

On the other hand, in S10, when the user inputs an instruction for stopping the printing operation through the input device 2 (keyboard), as shown in FIG. 17, the printing operation is interrupted in S31, and the ink ribbon cassette being used is taken out of the carriage 5-3. by the changer 5-2 to be set in the initial position of the stocker 5-1 (S32 and S33).

Next, in S34, the ink ribbon cassette which has been used up is determined based on the information indicative of the end of ink ribbon holding position (FIG. 20), and inform the user of the used up ink ribbon cassette using the display device 4 as shown in FIG. 21.

When installing and taking out the ribbon in and of the stocker 5-1, the stocker 5-1 is set in the open position. Here, the stocker closing sensor 5-1-5 determines that the stocker 5-1 is set in the open position (S35), and the installation and removal of the ink ribbon cassette are determined by the stocker cassette holding sensors 5-1-1 through 5-1-4 (S36). Moreover, when the stocker closing sensor 5-1-5 determines that the stocker 5-1 is closed (S37), the information indicative of the end of ink ribbon cassette position memory is cleared to "0" after the removal and the installation of the ink ribbon cassette are performed (S38), and the sequence goes back to S6.

Here, it may also arranged so as to determine that the used up ink ribbon cassette is taken out and is exchanged with new ink ribbon cassette, and to automatically renew the stored number for the information indicative of the remaining amount of the ink ribbon cassette to have the information "1" indicative of the ink ribbon remaining amount in the position where the removal and the installation of the ink ribbon are performed.

Here, as shown in FIG. 20, the information related to the middle left ink ribbon cassette (second from the left) and the information related to the middle right ink ribbon cassette (third from the left) are "1" indicating that theses cassettes are used up as shown in FIG. 20, after the stocker closing sensor 5-1-2 (middle left—second sensors from the left) detects the installation and the removal of the ink ribbon cassette, the values of the information are stored in the order of 0, 0, 1 and 0 from the left end in FIG. 20.

The ink ribbon cassette exchange control by the CPU is performed in accordance with the described flowchart.

[SECOND EMBODIMENT]

The second embodiment of the present invention will be explained below in reference to FIG. 22 through FIG. 27. However, the present invention is not limited to this preferred embodiment.

In the present invention, the basic configuration of the computer system such as a word processor, a personal computer including a printer, etc., is the same as the described first embodiment. Therefore, for convenience in explanations, members having the same functions as those shown in the previous embodiment will be designated by the same reference numerals, and the descriptions thereby shall be omitted here.

Figure 22:
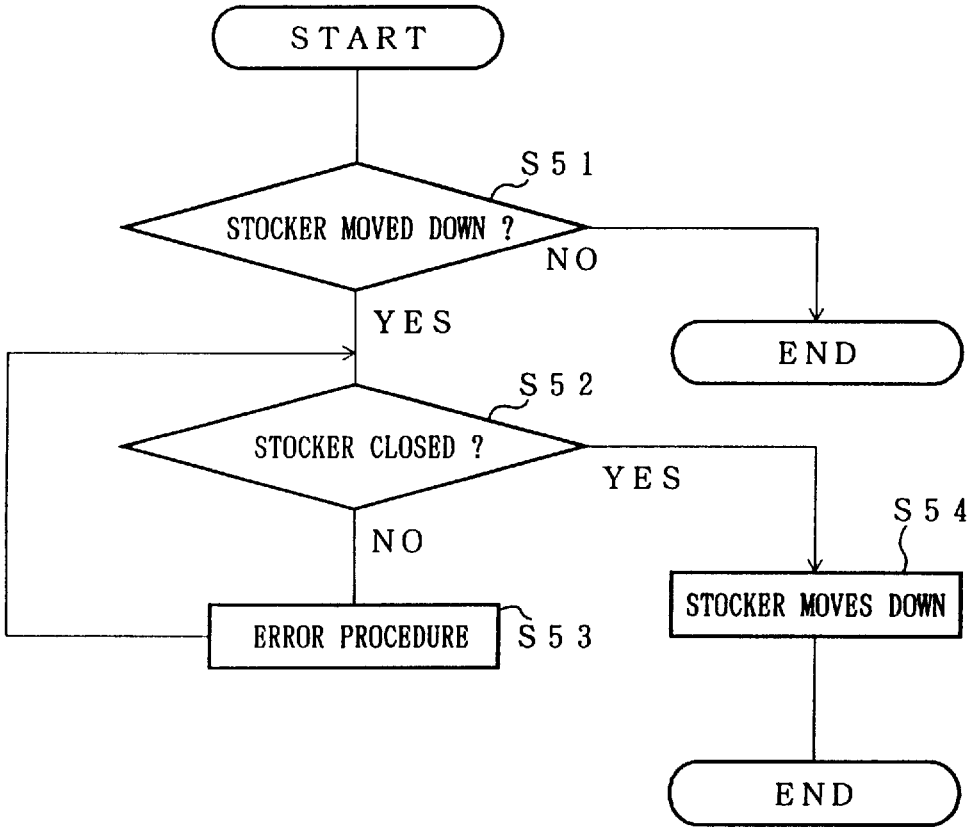
FIG. 22 is a flow chart how the stocker is controlled so as to be moved down.

FIG. 22 is a flowchart showing the controlling process for lowering the stocker by the CPU 1.

While a printing operation is being executed using an ink ribbon cassette in one color, if it is required to exchange with an ink ribbon cassette in another color, it is required to lower the stocker 5-1.

For example, after performing a printing operation using an ink ribbon cassette in yellow, if a printing operation using a black ink ribbon is required, the CPU 1 recognizes a necessity of lowering the stocker 5-1.

In S51, it is determined whether or not it is necessary to lower the stocker 5-1. If so, the sequence goes onto the step S52. If not, the process is terminated.

In S52, it is determined whether or not the stocker 5-1 is closed based on the output from the stocker closing sensor 5-1-5. If so, the sequence goes onto S54, and if not, the sequence moves onto S53. In the determination, the opening and closing information of the stocker, i.e., output information from the stocker closing sensor is stored in the RAM of the memory device 3. For example, the CPU 1 alters the opening and closing information by reading out an output from the stocker closing sensor 5-1-5.

In S54, the process is completed when the stocker 5-1 is lowered. The process of lowering the stocker is performed by the CPU 1 by controlling an operation of a stocker according to the program prepared beforehand.

On the other hand, in S53, an error handling such as displaying a message such as "close a stocker", etc., for example, on the display device 4, and the sequence goes back to S52.

By the described control, an occurrence of such an inconvenience that the changer is operated in spite of the fact that the stocker is opened can be prevented.

Figure 23:
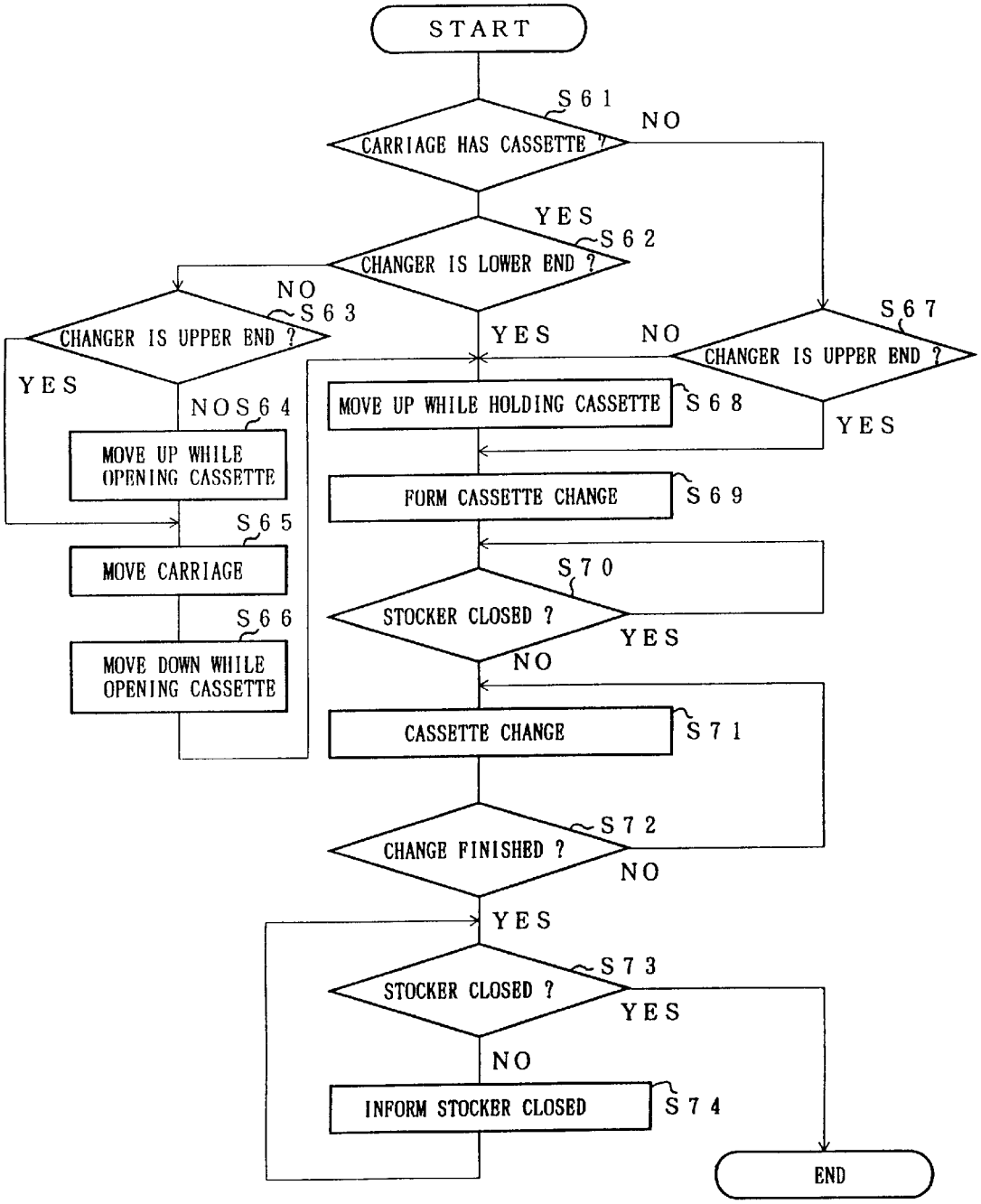
FIG. 23 is a flow chart how the ink ribbon cassette is controlled so as to be changed.

The flowchart showing a control process for exchanging an ink ribbon cassette will be shown in Fig. 23.

The following process is performed also under the control of the CPU 1.

When the user gives an instruction for exchanging an ink ribbon cassette by an input device 2 (keyboard), etc., if the ink ribbon cassette in the same color as the ink ribbon cassette used in the current printing operation is not stored in the stocker 5-1, the following process is executed.

Here, the ink ribbon use-up sensor 5-3-3 is provided for detecting the used up ink ribbon.

In S61, it is determined whether or not the ink ribbon cassette is stored in a carriage 5-3 by a carriage cassette holding sensor 5-3-1. If so, the sequence goes back to S62, and if not, the sequence goes onto S67.

In S67, it is determined whether or not a changer 5-2 raises the stocker 5-1 to an upper limit position by a changer upper limit sensor 5-2-2 and a changer lower limit sensor 5-2-3. If so, the sequence goes onto S69, and if not the sequence moves onto S68.

In S62, it is determined whether or not the changer 5-2 lowers the stocker 5-1 to the lower limit position by the changer lower limit sensor 5-2-3 and the changer upper limit sensor 5-2-2. If so, the sequence goes onto S68. If not, the sequence goes onto S63.

In S63, it is determined whether or not the changer 5-2 raises the stocker 5-1 to the upper limit position by the changer upper limit sensor 5-2-2 and the changer lower limit sensor 5-2-3. If so, the sequence directly goes to S65, and if not, the sequence moves onto S64.

The sequence moves to the S64 only when the abnormal condition has occurred where the stocker 5-1 is not at the lower limit position nor the upper limit position. This may occur when the user forces the stocker to be raised or lowered.

In S64, the changer 5-2 raises the stocker 5-1 to the upper limit position by cancelling the holding of the ink ribbon cassette.

In S65, the carriage 5-3 is moved to the position where the ink ribbon cassette of the stocker 5-1 is not held. Here, the position where the ink ribbon cassette of the stocker 5-3 is not held is determined by the stocker cassette holding sensor 5-1-1 through 5-1-4.

In S66, the changer 5-2 lowers the stocker 5-1 to the lower limit position by cancelling the holding of the ink ribbon cassette of the stocker 5-1, and the sequence moves onto S68.

In S68, the changer 5-2 raises the stocker 5-1 to the upper limit while holding the ink ribbon cassette of the stocker 5-1. As a result, the holding of the ink ribbon cassette is switched from the carriage 5-3 to the stocker 5-1, and the stocker 5-1 is held at the upper limit position.

In S69, a message such as "exchange ribbon cassette in the stocker", etc., is displayed on the display device 4 so as to urge the user to exchange the ink ribbon cassette in the stocker 5-1. Reading the message, the user rotates (opens) the stocker 5-1 to exchange the ink ribbon cassette in the stocker 5-1 with a new ink ribbon cassette.

In S70, the user determines whether or not the stocker 5-1 is set in the open position by the stocker closing sensor 5-1-5. If so, the sequence moves onto S71.

The exchange of the cassette in S71 is required when the user sets the ink ribbon cassette in the carriage 5-3 by mistake while exchanging the ink ribbon cassette. The process in S71 will be explained later.

In S72, it is determined whether or not the ink ribbon cassette has been exchanged by the user.

The determination may be carried out by the completion instructing method by the user through the input device 2 (keyboard), or by the method for detecting that the ink ribbon cassette is set in the stocker 5-1 by the stocker cassette holding sensors 5-1-1 through 5-1-4.

In S73, it is determined whether or not the stocker 5-1 is set in the close position by the user using the stocker closing sensor 5-1-5. If not, the sequence moves onto S74.

In S74, a message such as "close a stocker", etc., is displayed on the display device 4 so as to urge the user to close the stocker 5-1, and the sequence goes back to S73.

If it is determined in S73 that the stocker 5-1 is closed, the sequence is terminated.

Figures 24, 25:
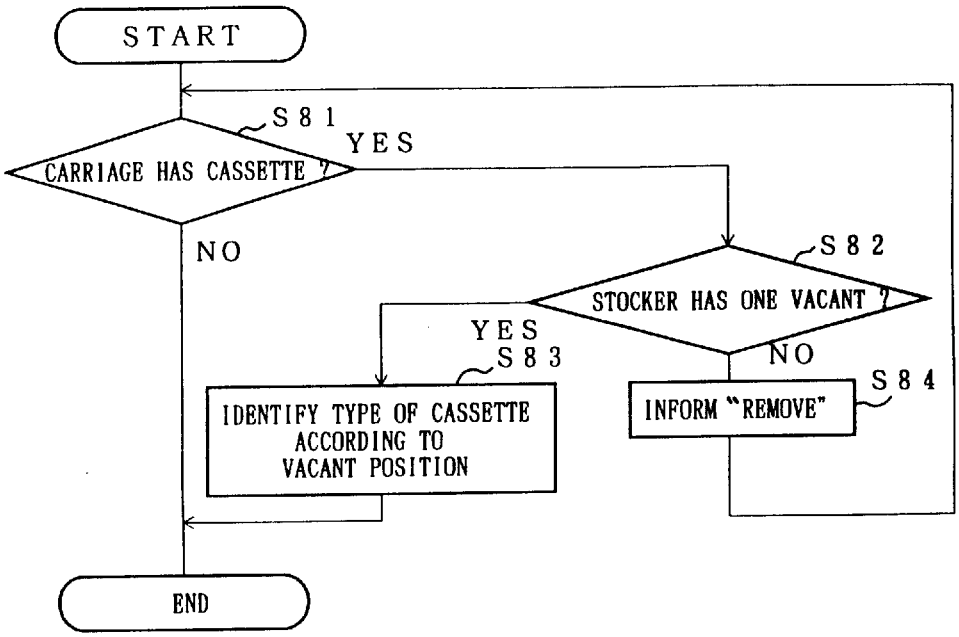
FIG. 24 is a flow chart showing the detail of the step S71 of FIG. 23.
FIG. 25 is an explanatory view illustrating color information of the respective ink ribbon cassettes which are stored in the memory device of the holding positions.

FIG. 24 is a flowchart which explained the process in S71 in FIG. 23 in detail.

In the arrangement of the present embodiment, a device for determining the type of the ink ribbon cassette such as color, etc., is not provided. Therefore, it is arranged such that the color of the ink ribbon cassette is determined by the holding position of the ink ribbon cassette of the stocker 5-1. If not specified, the color is set in the order of black, yellow, magenta and cyan from the left, and the color information of the holding position is stored in the memory device 3 as shown in FIG. 25.

In the memory position having the address of +0 of the memory device 3, the color of the ink ribbon cassette to be held in the left end of the stocker 5-1 is stored, and in FIG. 25, the name of the color "black" is stored. Similarly, in the memory position having an address +1, the name of the second color from the left, is stored, in the memory position having the address of +2, the name of the second color from the right is stored, and in the memory position having the address of +3, the name of the color to be stored in the right end position of the stocker 5-1 is stored.

For example, when the user sets the ink ribbon cassette to the left end of the stocker, the CPU 1 recognizes that the stock cassette holding sensor 5-1-1 is turned ON, and it is recognized that the ink ribbon cassette is in black based on the information stored in the address of +0 in FIG. 25 in the memory device 3.

In the present embodiment, the color of the ink ribbon cassette is determined in the described manner, if the user stores the ink ribbon cassette directly in the carriage 5-3, the CPU 1 cannot determine the color of the ink ribbon cassette.

As a note, even if the ink ribbon cassette is stored in the carriage 5-3 by the user, if an empty space, i.e., a space where the ink ribbon cassette is not set in the stocker 5-1 is only one, the CPU 1 can recognize that the ink ribbon cassette set on the carriage 5-3 is in a color corresponding to the empty space.

In S70 of FIG. 23, after it is determined that the stocker 5-1 rotates (open position), the sequence moves onto S71, i.e., the process in the flowchart of FIG. 24.

In S81 of FIG. 24, it is determined whether or not the ink ribbon cassette is held in the carriage 5-3 by the cassette holding sensor 5-3-1 of the carriage. If so, the sequence moves onto S82. If not, on the other hand, the process is terminated.

In S82, it is determined whether or not a single empty space where the ink ribbon cassette is not held in the stocker 5-1 by the stocker cassette holding sensors 5-1-1 through 5-1-4. If so, the sequence moves onto S83. If not on the other hand, the sequence moves onto the step S84.

In S83, the empty position of the stocker 5-1 detected in S82 and the information shown in FIG. 25 stored in the memory device 3, the kind of the ink ribbon cassette set on the carriage 5-3, the name of the color in this example are recognized, thereby terminating the process.

On the other hand, in S84, the color of the ink ribbon cassette on the carriage 5-3 cannot be recognized, a message "remove the ribbon cassette from the carriage", etc., is displayed on the display device so as to urge the user to remove the ink ribbon cassette from the carriage 5-3. Then, the sequence goes back to S81.

The processes in S81-S84 are repeated, and the process will not be terminated until it is detected that the ink ribbon cassette is taken out from the carriage 5-3, or a space is formed in the stocker 5-1. Namely, the printing operation will not be started.

The above-mentioned process is an inform processing in the case where the ink ribbon is set on the carriage by mistake.

Figure 26:
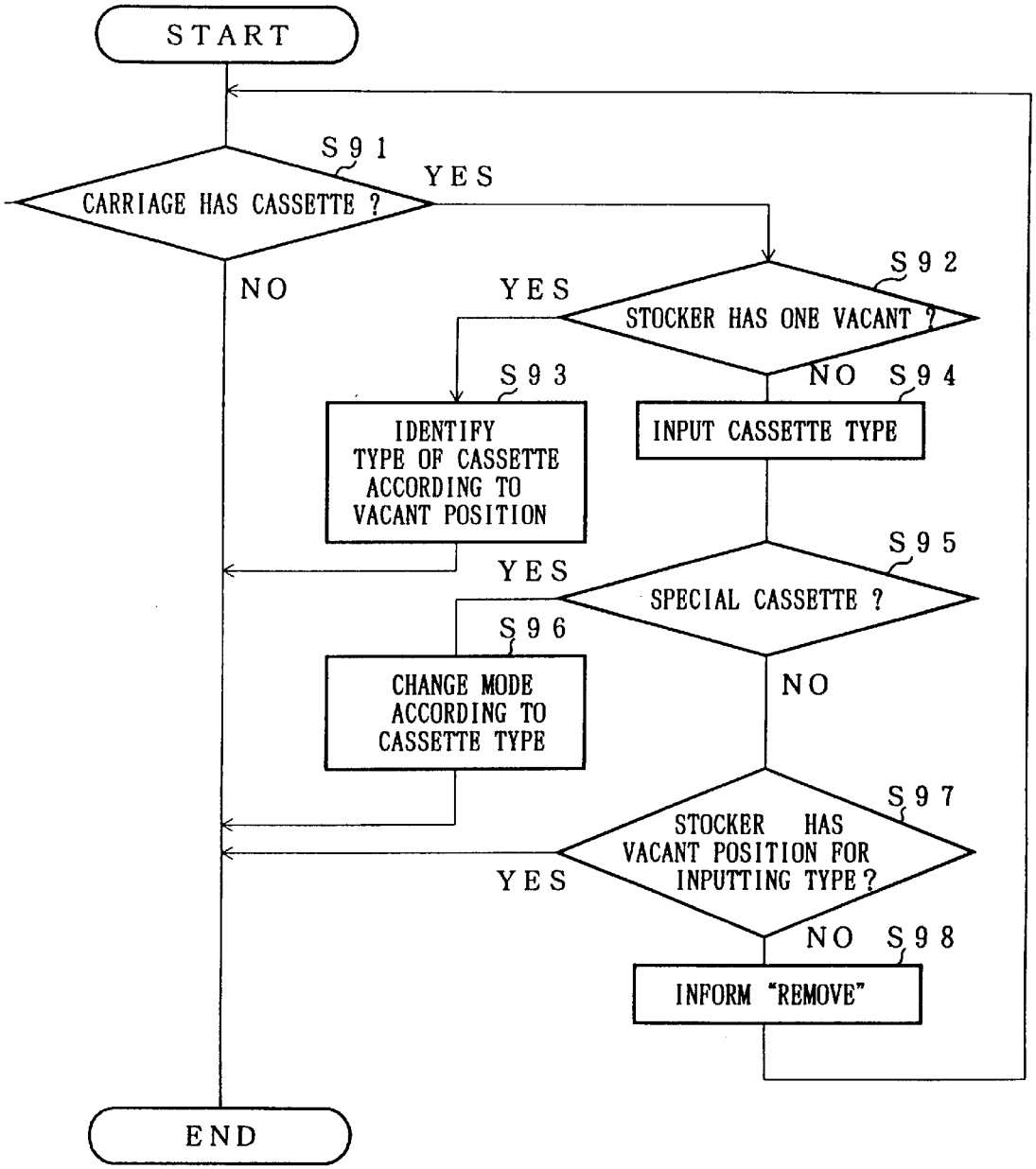
FIG. 26 is a flow chart showing the detail of the step S71 of FIG. 23.

FIG. 26 shows another detained flowchart of S71 in FIG. 23.

In the flowchart of FIG. 24, the user sets the ink ribbon cassette directly to the carriage 5-3, and if multiple empty spaces are formed in the stocker 5-1, the color of the ink ribbon cassette cannot be determined. Therefore, either the ink ribbon cassette is taken out of the. carriage 5-3, or set such that the printing operation is not started until a single empty space is left in the stocker.

In the flowchart of FIG. 26, as in the case of the if flowchart of FIG. 24, by the inputs of the name of the color, i.e., the type of the ribbon cassette made by the user, the CPU recognizes the type of the ink ribbon cassette.

After it is determined in S70 in FIG. 23 that the stocker is rotated, i.e., the stocker is held in the open position, the sequence moves onto S71 in the flowchart of FIG. 26.

In S91 of FIG. 26, it is determined whether or not the ink ribbon cassette is stored in the carriage 5-3 by the carriage cassette holding sensor 5-3-1. If so, the sequence moves onto S92. If not, the process is terminated.

In S92, it is determined whether or not only a signal empty space is left in which the ink ribbon cassette is stored in the stocker 5-1 by the stocker cassette holding sensors 5-1-1 through 5-1-4. If so, the sequence goes onto the step S93, and otherwise, the sequence moves onto S94.

In S93, the kind (color in this example) of the ink ribbon cassette mounted on the carriage 5-3 is recognized based on the empty position of the stocker 5-1 detected in S92 and information shown in FIG. 25, thereby terminating the process.

On the other hand, in S94, the color of the ink ribbon cassette on the carriage 5-3 is not recognized. Therefore, the user is informed to input the color of the set ink ribbon cassette. The user may input in the manner shown in FIG. 27, the kind of the ink ribbon cassette is displayed, and the input device 2 is selected among them.

In S95, it is determined whether or not the ink ribbon cassette inputted in S94 is of a special kind. If so the sequence goes onto S96. If not, the sequence moves onto S97.

A special color for the ink ribbon cassette suggests a color which is not stored in the memory device 3 beforehand as shown in FIG. 25 (such as black, yellow, magenta, cyan). Examples of such special color includes: red, blue, gold, silver, etc., or a label cassette (an ink ribbon and a paper ribbon are stored in the ink ribbon cassette, and a print is made on the paper ribbon).

In S96, the printing mode is switched according to the kind of the ink ribbon cassette inputted in S95.

In general, for example, in the color printing mode, i.e., the seven color printing is performed using the ink ribbon cassettes in black, yellow, magenta and cyan, however, if an input is made to indicate that the red ink ribbon cassette is mounted, the printing mode is switched to the two color printing mode (for performing two color printing using the ink ribbon cassettes in black and red), or if an input is made to indicate that label cassette is set, the printing mode is switched to the label cassette printing mode (for the restriction in the number of characters which can be printed in one time or for altering the width of a voltage pulse to be applied to the thermal head).

On the other hand, in S97, based on the kind of the ink ribbon cassette inputted in S94 and the information stored in the memory 3 shown in FIG. 25, it is determined whether or not the corresponding position in the stocker 5-1 is empty, i.e., the ink ribbon cassette is not held. If so, the sequence is terminated, and if not the sequence moves onto S98.

In S98, since it is determined that the ink ribbon cassette of the same type (in the same color) as that mounted on the carriage 5-3 is already set in the stocker 5-1, the user is informed of taking out the ink ribbon cassette on the carriage 5-3. Namely, a message such as "remove the ribbon cassette from the carriage" is displayed on the display device 4. As a result, the sequence goes back to S91.

This is because when the ink ribbon cassette on the carriage 5-3 is to be exchanged with an other ink ribbon cassette held in the stocker 5-1 by the changer 5-2, the ink ribbon cassette on the carriage 5-3 would not be moved back to the stocker 5-1.

The above-mentioned process is the control and informing process to be performed when the ink ribbon cassette is set on the carriage. Here, even if the ink ribbon cassette is mounted on the carriage, the printing operation would be performed in an appropriate color, thereby easily switching the set printing mode.

[THIRD EMBODIMENT]

The following description deals with the third embodiment in accordance with the present invention with reference to FIGS. 28 through 50. Note that the present invention is not restricted to the present embodiment.

The present embodiment deals with an ink ribbon cassette automatic changer printer system as one example wherein the printing is carried out by automatically changing four ink ribbon cassettes whose ink ribbon colors are respectively Y (yellow)/M (magenta)/C (cyan)/B (black). Note that the basic structure of the system of the present embodiment is the same as the first embodiment except for the following points. So, for convenience sake, the members having the same functions as those of the first embodiment have the same reference numerals as those of the first embodiment, and the explanations thereof are omitted here.

Figure 28:
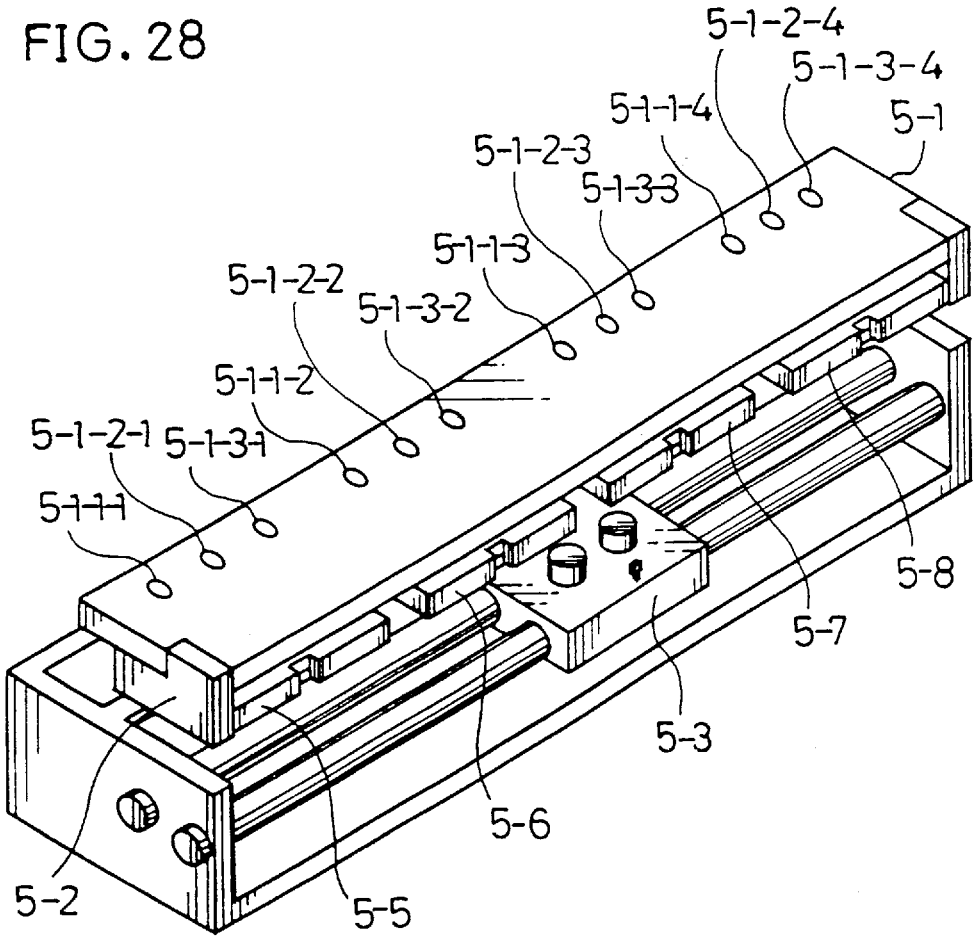
FIG. 28 is an entire view illustrating an ink ribbon cassette automatic changer printer wherein a stocker is provided with a stocker cassette type identification sensor.
Figure 29A:
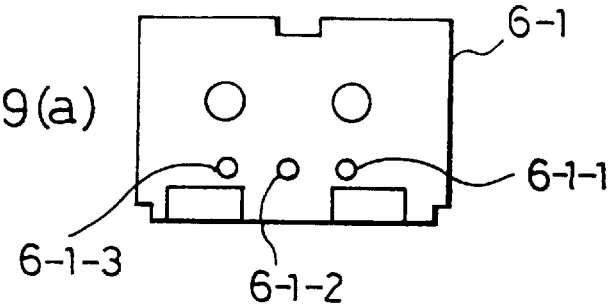
FIGS. 29(*a*) through 29(*d*) are explanatory views illustrating the identification holes for identifying the types of the respective ink ribbon cassettes.
Figure 29B:
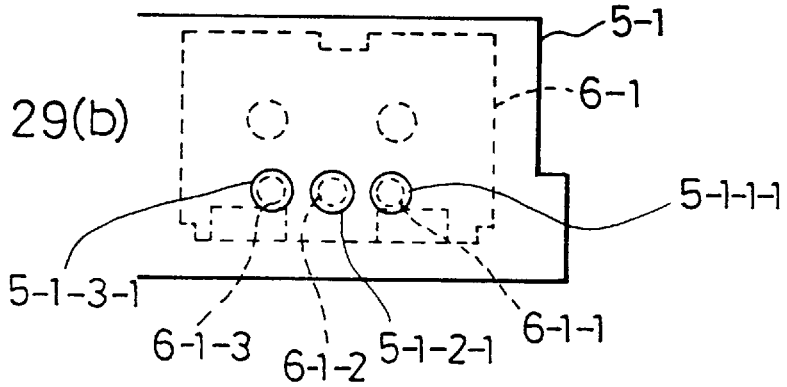
Figure 29C:
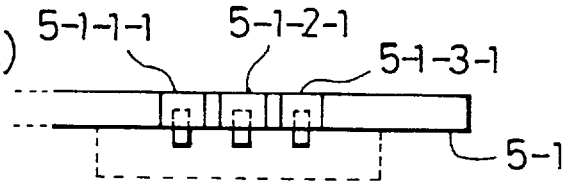
Figure 29D:
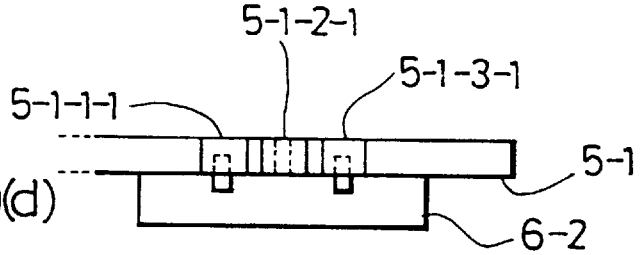

A printer system in accordance with the present embodiment, as illustrated in FIG. 28, has, in the respective four ink ribbon cassette holding positions of the stocker 5-1, three sensors A through C, which are substituted for the foregoing stocker cassette holding sensors 5-1-1 through 5-1-4, for detecting what types of the ink ribbon cassettes are attached to the stocker 5-1. The sensor A has totally 4 stocker cassette type identification sensors 5-1-1-1 through 5-1-1-4. The sensor B has totally 4 stocker cassette type identification sensors 5-1-2-1 through 5-1-2-4. The sensor C has totally 4 stocker cassette type identification sensors 5-1-3-1 through 5-1-3-4. The sensors A through C are totally composed of 12 stocker cassette type identification sensors.

According to the combinations of the sensor A (the stocker cassette type identification sensors 5-1-1-1 through 5-1-1-4, the sensor B (the stocker cassette type identification sensors 5-1-2-1 through 5-1-2-4) and the sensor C (the stocker cassette type identification sensors 5-1-3-1 through 5-1-3-4), it is identified (1) whether or not the ink ribbon cassettes are held in the respective ink ribbon cassette holding positions of the stocker 5-1 and (2) what types (colors) of the respective ink ribbon cassettes are held.

FIGS. 29(*a*) through 29(*d*) are explanatory views illustrating identification holes for identifying the types of the respective ink ribbon cassettes. An ink ribbon cassette 6-1, as illustrated in FIG. 29(*a*), is provided with three identification holes 6-1-1 through 6-1-3 in respective predetermined positions.

As illustrated in FIG. 29(*b*), when the ink ribbon cassette 6-1 is held by the stocker 5-1, (1) the stocker cassette type identification sensor 5-1-1-1 of the sensor A is located in the position of the identification hole 6-1-1, (2) the stocker cassette type identification sensor 5-1-2-1 of the sensor B is located in the position of the identification hole 6-1-2, and (3) the stocker cassette type identification sensor 5-1-3-1 of the sensor C is located in the position of the identification hole 6-1-3.

FIGS. 29(*c*) and 29(*d*) are detail explanatory views illustrating the stocker cassette type identification sensor 5-1-1-1 of the sensor A, the stocker cassette type identification sensor 5-1-2-1 of the sensor B, and the stocker cassette type identification sensor 5-1-3-1 of the sensor C. Note that the stocker cassette type identification sensors 5-1-1-2 through 5-1-1-4 of the sensor A, the stocker cassette type identification sensors 5-1-2-2 through 5-1-2-4 of the sensor B, and the stocker cassette type identification sensors 5-1-3-2 through 5-1-3-4 of the sensor C, these sensors being provided in other ink ribbon cassette holding position of the stocker 5-1, are similar to the foregoing.

The stocker cassette type identification sensor 5-1-1-1 of the sensor A, the stocker cassette type identification sensor 5-1-2-1 of the sensor B, and the stocker cassette type identification sensor 5-1-3-1 of the sensor C are the switches which become the on state upon pushing down respective projections.

According to FIG. 29(*c*), the stocker cassette type identification sensor 5-1-1-1 of the sensor A, the stocker cassette type identification sensor 5-1-2-1 of the sensor B, and the stocker cassette type identification sensor 5-1-3-1 of the sensor C are all in the off state since no ink ribbon cassette is held by the stocker 5-1. In contrast, according to FIG. 29(*d*), when an ink ribbon cassette 6-2 in which identification holes 6-2-1 and 6-2-3 are opened is attached, the stocker cassette type identification sensor 5-1-1-1 of the sensor A and the stocker cassette type identification sensor 5-1-3-1 of the sensor C are in the off state, while the stocker cassette type identification sensor 5-1-2-1 of the sensor B is the on state.

Figure 35:
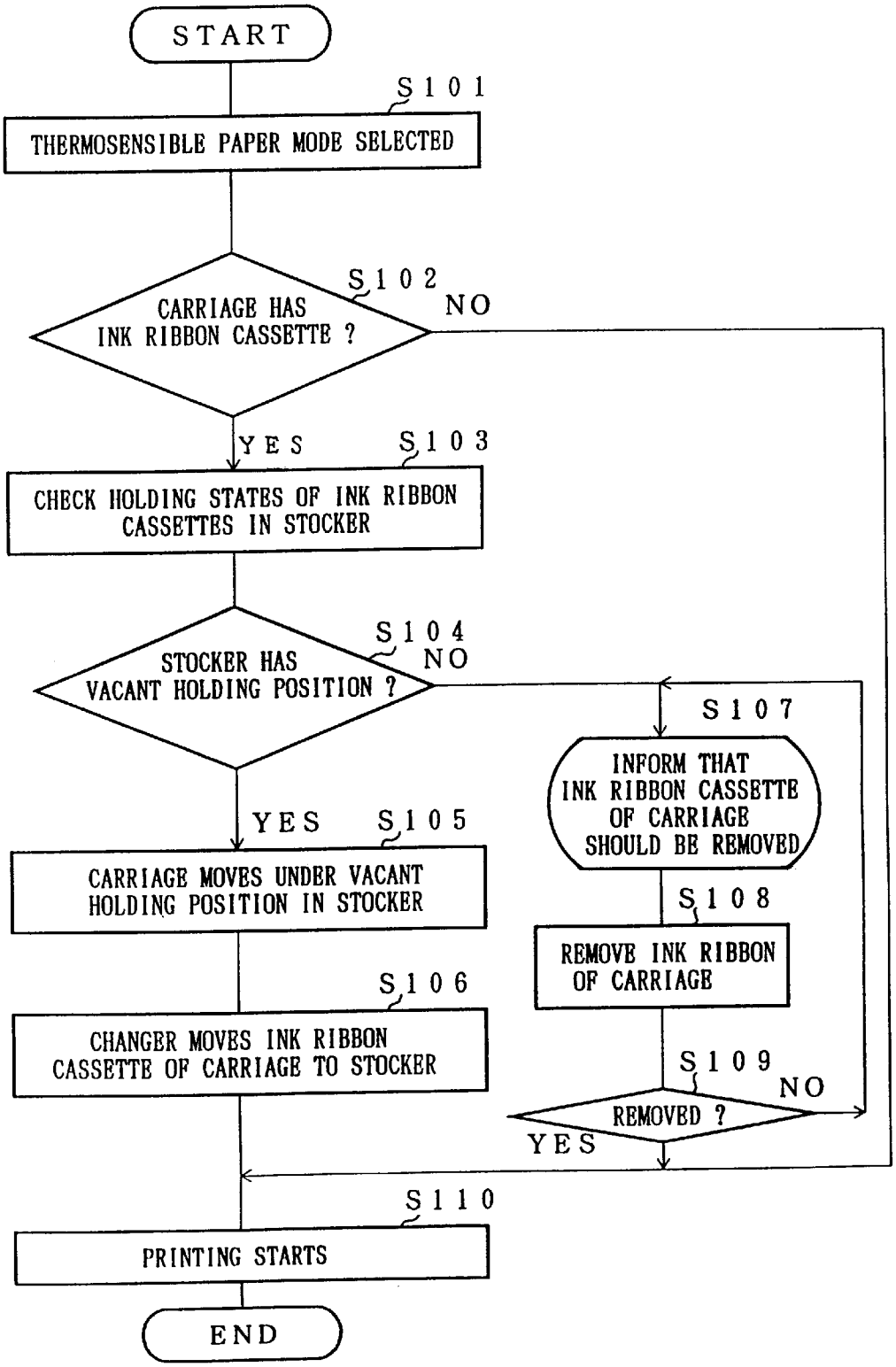
FIG. 35 is a flow chart showing what procedures are made for printing to the thermosensible paper.

FIG. 30 is an explanatory view illustrating the relation between the identification hole and the ribbon type of the ink ribbon cassette. Thus, the identification holes which are provided in the respective ink ribbon cassettes beforehand in accordance with the types thereof are detected by the stocker cassette type identification sensors of the sensors A through C, and it is identified in accordance with the combinations of the detected results whether or not the ink ribbon cassettes exist and what types of the attached respective ink ribbon cassettes. FIG. 35 is a flow chart showing what procedures are made for printing to the thermosensible paper. According to the procedures, when the printing is carried out with respect to the thermosensible paper which does not need the ink ribbon cassette, the ink ribbon cassette 5-7 is controlled so as to be automatically taken out from the carriage 5-3.

First, in S101, when the printing mode in which the printing is carried out with respect to the thermosensible paper is selected, S102 is proceeded so that it is detected by the carriage cassette holding sensor 5-3-1 whether the ink ribbon cassette 5-7 is not held by the carriage 5-3. If not, S110 is proceeded so as to start the printing.

In S102, if the ink ribbon cassette 5-7 is held by the carriage 5-3, S103 is proceeded so that the stocker cassette holding sensors 5-1-1 through 5-1-4 detect what ink ribbon cassettes are held by the stocker 5-1. Then, S104 is proceeded, and it is judged whether or not the stocker 5-1 has a vacant ink ribbon cassette holding position. If the vacant ink ribbon cassette holding position exists, S105 is proceeded so that the carriage 5-3 moves under the vacant ink ribbon cassette holding position. The changer 5-2 moves the ink ribbon cassette 5-7 held by the carriage 5-3 to the vacant ink ribbon cassette holding position of the stocker 5-1 (S106). Thus, the carriage 5-3 holds no ink ribbon cassette, then the printing starts in S110.

If the stocker 5-1 has no vacant ink ribbon cassette holding position in S104, S107 is proceeded. More specifically, in S107, the message for the user such as "Please take out the ink ribbon cassette from the carriage" is displayed by the display device 4, thereby alarming and informing the user that it is requested to take out the ink ribbon cassette 5-7 from the carriage 5-3. Thus, the user takes out the ink ribbon cassette 5-7 from the carriage 5-3 in accordance with the request (S108). It is detected by the carriage cassette holding sensor 5-3-1 provided in the carriage 5-3 whether or not the ink ribbon cassette 5-7 has been taken out in S109.

If not, returning to S107, it is requested again that the user should take out the ink ribbon cassette 5-7 from the carriage 5-3. If it is confirmed that the ink ribbon cassette 5-7 has been taken out from the carriage 5-3 in S109, then the printing starts in S110. Thus, the printing with respect to the thermosensible paper is carried out in accordance with the foregoing steps.

Figure 36A:
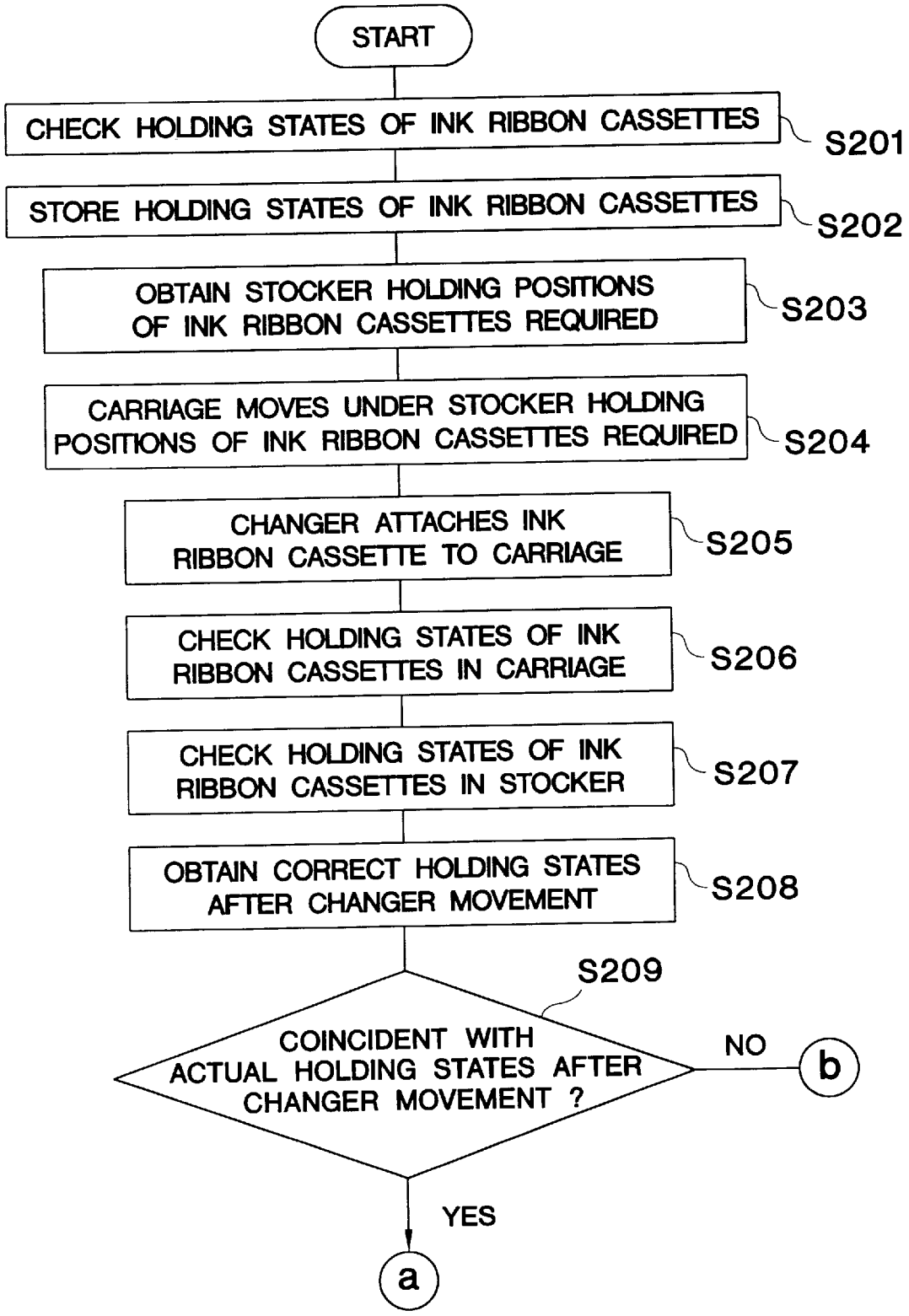
FIGS. 36*a* and 36*b* illustrate a flow chart showing what procedures are made for checking the holding states of the respective ink ribbon cassettes of the stocker before and after the movement of changer.
Figure 36B:
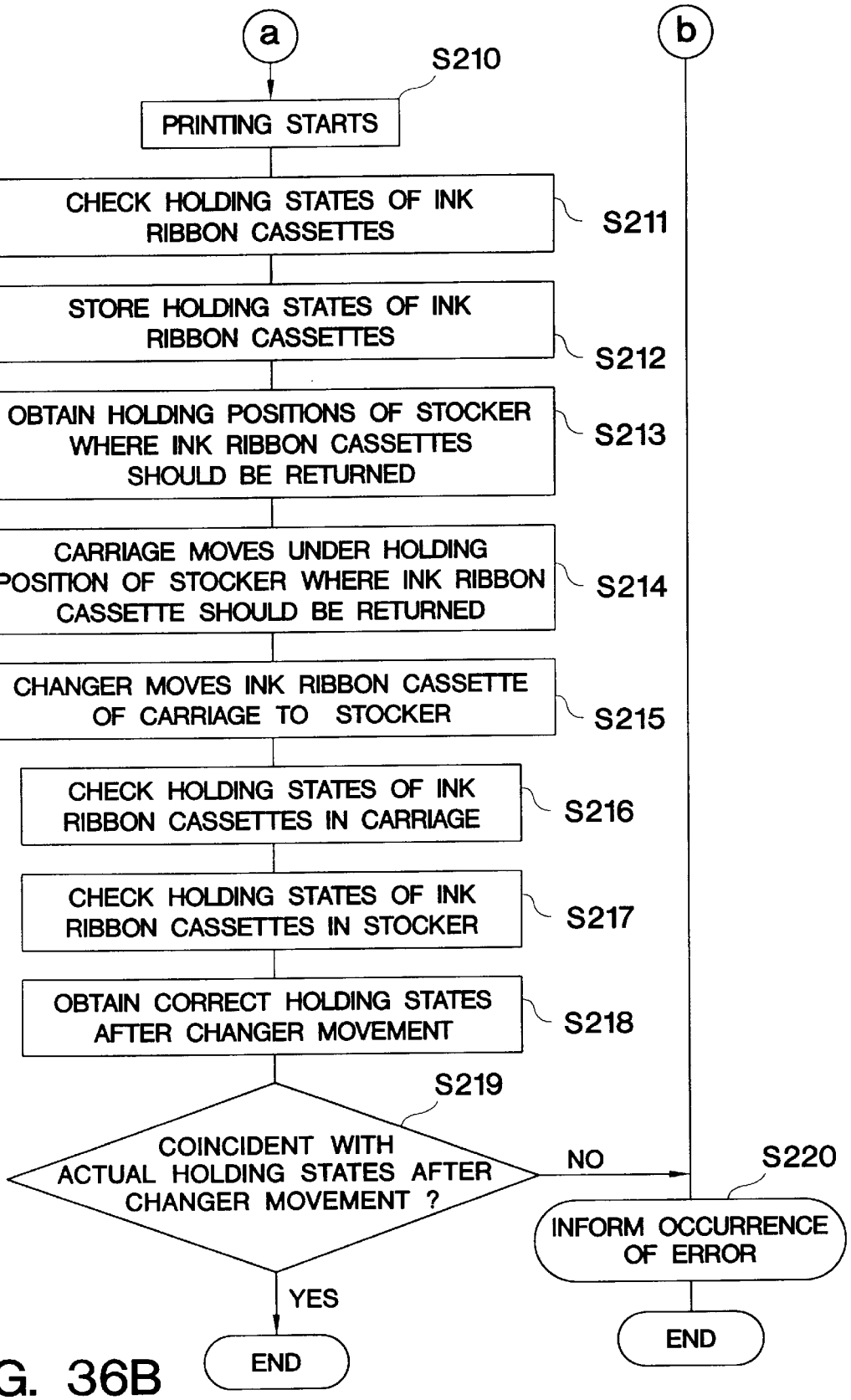

FIGS. 36*a* and 36*b* illustrate a flow chart showing what procedures are made for checking what ink ribbon cassettes are held by the stocker before and after the movement of the changer. Such a procedure is for promptly detecting the printer operating error such as the error of the changer 5-2 based on the fact that (1) the holding state of the ink ribbon cassettes of the. respective stocker 5-1 and carriage 5-3 after the changer 5-2 operation is foreseen in accordance with those before the changer 5-2 operation, and (2) the foreseen holding state is compared with the actual holding state after the changer 5-2 operation.

More specifically, the holding state of the ink ribbon cassettes of the stocker 5-1 and carriage 5-3 is detected by the stocker cassette holding sensors 5-1-1 through 5-1-4 and by the carriage cassette holding sensor 5-3-1 (S201). Then, the detected results are stored in the RAM of the memory device 3 (S202). The position, in which the stocker 5-1 having the ink ribbon cassette required for the printing is held, is identified (S203). After the identification, the carriage 5-3 is moved under the identified position (S204). The ink ribbon cassette 5-7 is attached to the carriage 5-3 by the changer 5-2 (S205).

After the changer 5-2 operation, the holding state of the ink ribbon cassettes of the carriage 5-3 is detected by the carriage cassette holding sensor 5-3-1 (S206). The holding states of the respective ink ribbon cassettes of the stocker 5-1 are detected by the stocker cassette holding sensors 5-1-1 through 5-1-4 (S207).

In S208, the holding states of the respective ink ribbon cassettes of the case where the changer 5-2 have appropriately operated obtained based on those which are stored in the memory device 3 in S208 and are before the changer 5-2 operation. For example, in the case where (1) the stored holding states of the respective ink ribbon cassettes that are stored in the memory device 3 in S208 before the changer 5-2 operation are shown in FIG. 41 and (2) the ink ribbon cassette in the left end position of the ink ribbon cassette holding positions of the stocker 5-1 is moved to the carriage 5-3 by the changer 5-2, (a) the holding state of the ink ribbon cassette in the left end position of the ink ribbon cassette holding positions of the stocker 5-1 changes into "non-existence" and (b) the holding state of the ink ribbon cassette in the carriage 5-3 changes into "existence" provided that the changer 5-2 have appropriately operated (see FIG. 42).

In S209, it is confirmed by the comparison whether or not the actual holding states detected in S207 and S208 are coincident with those which should be after the changer 5-2 operation. If not, it is judged that some error occurs in the changer 5-2 operation, and S220 is proceeded. In S220 , the display device 4 displays the message such as "The changing of the ink ribbon cassette has been mistakenly carried out, so please check the printer", thereby alarming and informing the user that some error has occurred and thereby suspending the printing operation.

On the contrary, when it is confirmed that the ink ribbon cassette holding states are coincident with each other and the changer 5-2 operation is correctly carried out in S209, S210 is proceeded. In S210, the printing is carried out by the ink ribbon cassette attached to the carriage 5-3.

When the the printing is finished by the ink ribbon cassette held by the carriage 5-3, the ink ribbon cassette holding states of the stocker 5-1 and the holding state of the carriage 5-3 are detected (S211). Then, the detected results are stored in the memory device 3 as the ink ribbon cassette holding state of before the changer 5-2 operation (S212).

A holding position is obtained in S213 so as to return, the ink ribbon cassette which has been used during the printing and is held by the carriage 5-3, to the original holding position of the stocker 5-1. The carriage 5-3 is moved under the original holding position of the ink ribbon cassette in the stocker 5-1 (S214). The ink ribbon cassette of the carriage 5-3 is returned by the changer 5-2 to the original ink ribbon cassette holding position of the stocker 5-1 (S215).

After the changer 5-2 operation, the ink ribbon cassette holding state of the carriage 5-3 is detected by the carriage cassette holding sensor 5-3-1 (S216). The ink ribbon cassette holding states of the stocker 5-1 are detected by the stocker cassette holding sensors 5-1-1 through 5-1-4 (S217). In S218, the ink ribbon holding states of the case where the changer 5-2 has appropriately operated are obtained in accordance with the ink ribbon holding states of before the changer 5-2 operation which has been stored in the memory device 3 in S212. The way to obtain the ink ribbon holding states is similar to that of S208.

The correct holding states, obtained in S218, of after the changer 5-2 operation are compared with the actual ink ribbon holding states obtained in S216 and S217 (S219). If both holding states are coincident with each other, it is judged that the changer 5-2 operation has been appropriately carried out, thereby ending the procedure.

On the contrary, in S219, when the actual ink ribbon holding states are not coincident with the due holding states, S220 is proceeded. In S220, the display device 4 displays the message such as "The changing of the ink ribbon cassette has been mistakenly carried out, so please check the printer.", thereby alarming and informing the user that some error has occurred and thereby suspending the procedure.

In accordance with the foregoing manner, it is checked, each time the ink ribbon cassette is attached to the carriage 5-3 or each time the ink ribbon cassette is returned to the stocker 5-1, whether or not some errors occur.

With the foregoing procedures, the holding states of the respective ink ribbon cassettes are checked after and before the changer movement.

Figure 37:
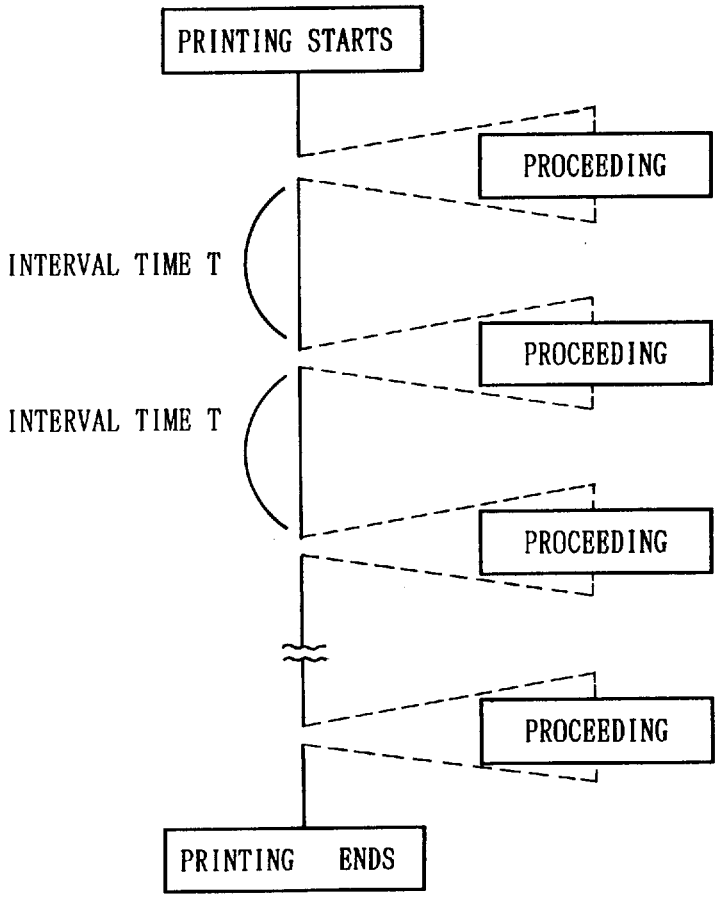
FIG. 37 is a flow chart showing what procedures are made for checking the holding states of the respective ink ribbon cassettes of the stocker in a predetermined time interval during the printing.
Figure 38:
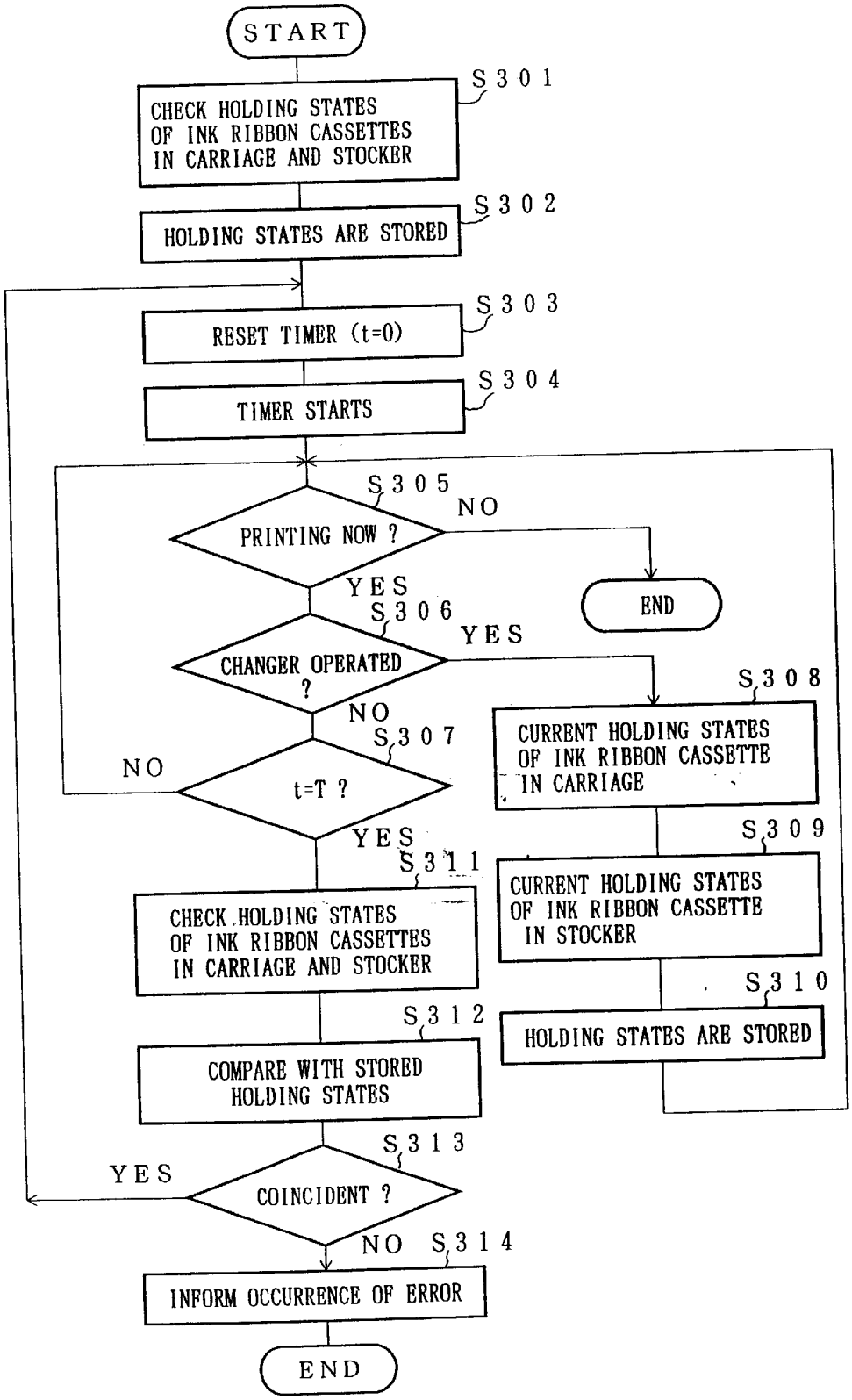
FIG. 38 is a flow chart showing what procedures are made for checking the holding states of the respective ink ribbon cassettes of the stocker in a predetermined time interval during the printing.

FIGS. 37 and 38 are flow charts showing what procedures are made for checking the ink ribbon cassette holding states of the stocker for a predetermined time interval during the printing. Such procedures are made for earlier detecting the printer errors, such as the error in which the ink ribbon cassette is separated from the stocker 5-1 during the printing, based on the checking whether or not some errors occur in accordance with the ink ribbon cassette holding states detected in time interval T during the printing (see FIG. 37).

As illustrated in FIG. 38, the ink ribbon cassette holding states of the carriage 5-3 and the stocker 5-1 are detected by the carriage cassette holding sensor 5-3-1 and by the stocker cassette holding sensors 5-1-1 through 5-1-4 (S301). The detected ink ribbon cassette holding states are stored in the RAM of the memory device 3 (S302).

A timer by which the checking is carried out in the time interval T is reset (t=0) in S303. Note that the timer is included in the CPU 1. Then, the timer starts (S304).

It is first checked whether or not the printing is being carried out (S305). If not, the procedure is ended.

If it is judged to be in the printing operation in S305, S306 is proceeded for checking whether or not the changer 5-2 has been operated. If so, there occurs some difference from the ink ribbon cassette holding states stored in S302. Therefore, the ink ribbon cassette holding state of the carriage 5-3 is detected in S308 and the ink ribbon cassette holding states of the stocker 5-1 are detected in S309. The ink ribbon cassette holding states stored in S302 are replaced with the detected ink ribbon cassette holding states in S309 (S310), thereafter returning to S305.

When the changer 5-2 has not operated in S306, S307 is proceeded for checking whether or not the time interval T has been elapsed. If not yet elapsed, S305 is again proceeded.

If the time has been elapsed in S307, S311 is proceeded. In S311, the current ink ribbon cassette holding states of the carriage 5-3 and the stocker 5-1 are detected by the carriage cassette holding sensor 5-3-1 and by the stocker cassette holding sensors 5-1-1 through 5-1-4. Such detected results are compared with the ink ribbon cassette holding states stored in the memory device 3 (S312). If the states are not coincident with each other (S313), S314 is proceeded. In S314, the display device 4 displays the message such as "Some errors occur in the printer, so please check the printer", thereby alarming and informing the user thereof.

In contrast, if the states are coincident with each other in S312, it is judged that the printer operation has been appropriately carried out, thereby returning to S303 from S313. Then, the timer is again reset and the timer starts again so as to prepare the next checking which is carried out after time interval T has elapsed.

Thus, during over the printing operations, (1) the stored ink ribbon holding states stored in the memory device 3 are updated each time the changer 5-2 is operated and (2) the ink ribbon cassette holding states are checked in the time interval T, thereby checking whether or not some error occurs.

Note that the time interval T is not always constant. For instance, without using the timer, the ink ribbon cassette holding states can be detected each time the printing by one line is carried out.

In accordance with the foregoing procedures, the ink ribbon cassette holding states of the stocker in every the predetermined period of time are checked during the printing.

Figure 39:
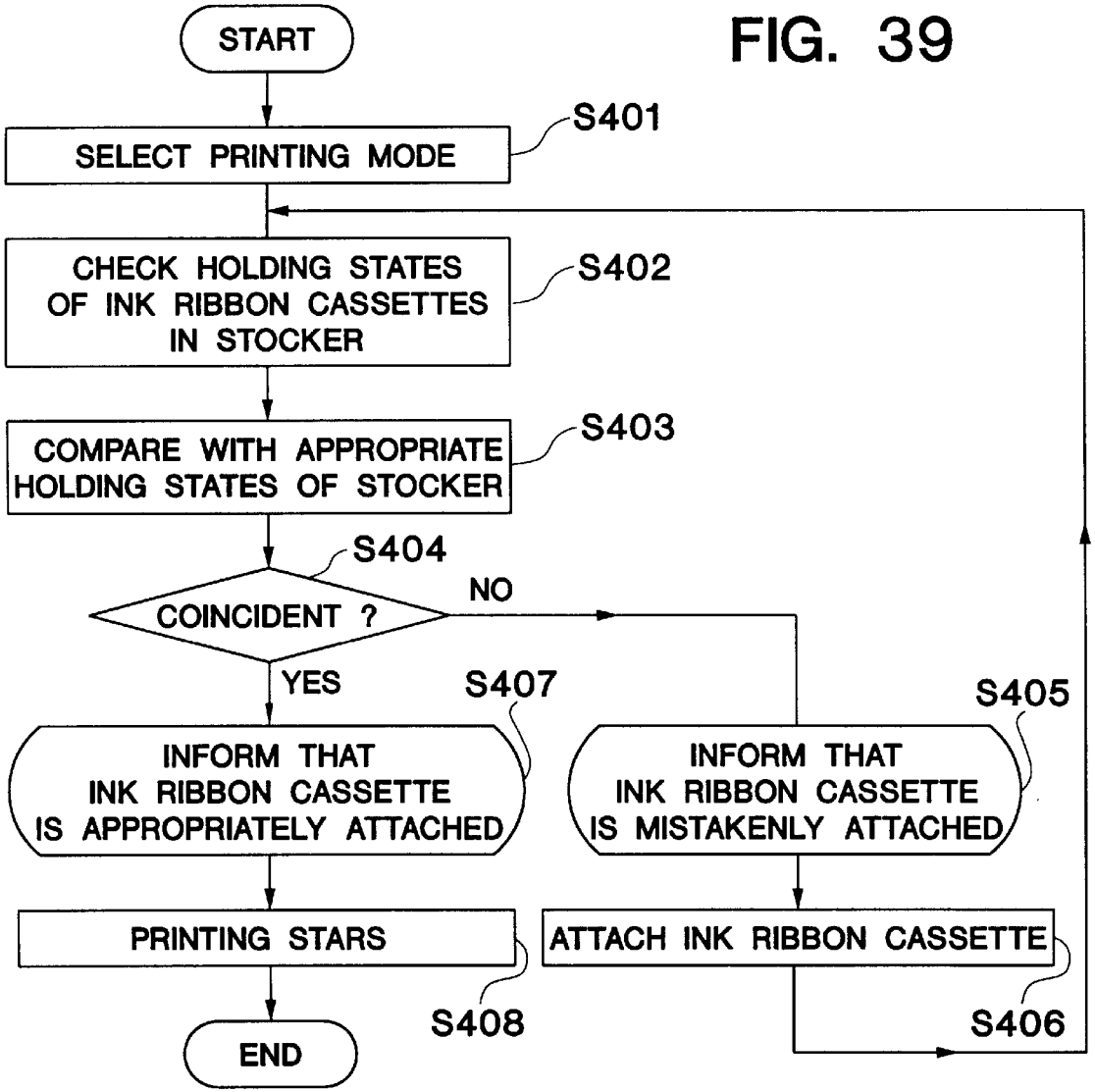
FIG. 39 is a flow chart showing what procedures are made for checking the holding states of the respective ink ribbon cassettes of the stocker prior to the printing.

FIG. 39 is a flow chart showing what procedures are made for checking the ink ribbon cassette holding states of the stocker prior to the printing.

Such procedures are made to confirm the user whether or not the ink ribbon cassettes are attached to the stocker 5-1 prior to the printing so as to identify (1) the types of the ink ribbon cassettes required for the printing and (2) the positions of the stocker 5-1 for holding the respective ink ribbon cassettes.

Since the required number and types of the ink ribbon cassettes vary depending on the printing mode, the data of FIG. 43 relating to appropriate ink ribbon cassette holding states are stored in the memory device 3 beforehand. Note that no ink ribbon cassette is necessary to be held in the position represented as "arbitrary" in FIG. 43.

First, the printing mode is selected (S401). The ink ribbon cassette holding states of the stocker 5-1 are detected by the stocker cassette holding sensors 5-1-1 through 5-1-4 (S402). Such detected results are compared with the ink ribbon cassette holding states stored in the memory device 3 which correspond to the printing mode (S403).

If the ink ribbon cassettes are not attached to the holding positions of the stocker 5-1 to which the respective ink ribbons should be attached (S404), S405 is proceeded. In S405, the display device 4 alarms and informs the user that the ink ribbon cassette is mistakenly attached. After the user attached the ink ribbon cassette to the correct holding position (S406), S402 is proceeded for checking again the ink ribbon cassette holding states of the stocker 5-1.

In contrast, in S404, the ink ribbon cassette holding states of the stocker 5-1 are coincident with the ink ribbon cassette holding states stored in the memory device 3 which correspond to the selected printing mode, S407 is proceeded. In S407, the display device 4 displays (1) the types of the ink ribbon cassettes required for the printing and (2) the positions of the stocker 5-1 for holding the respective ink ribbon cassettes as shown in FIG. 44 by referencing to the appropriate ink ribbon cassette holding states data (see FIG. 43) stored in the memory device 3, thereby informing and confirming the user thereof. Thereafter, S408 is proceeded for starting the printing.

Thus, the ink ribbon cassette holding states of the stocker are checked prior to the printing.

Figure 40:
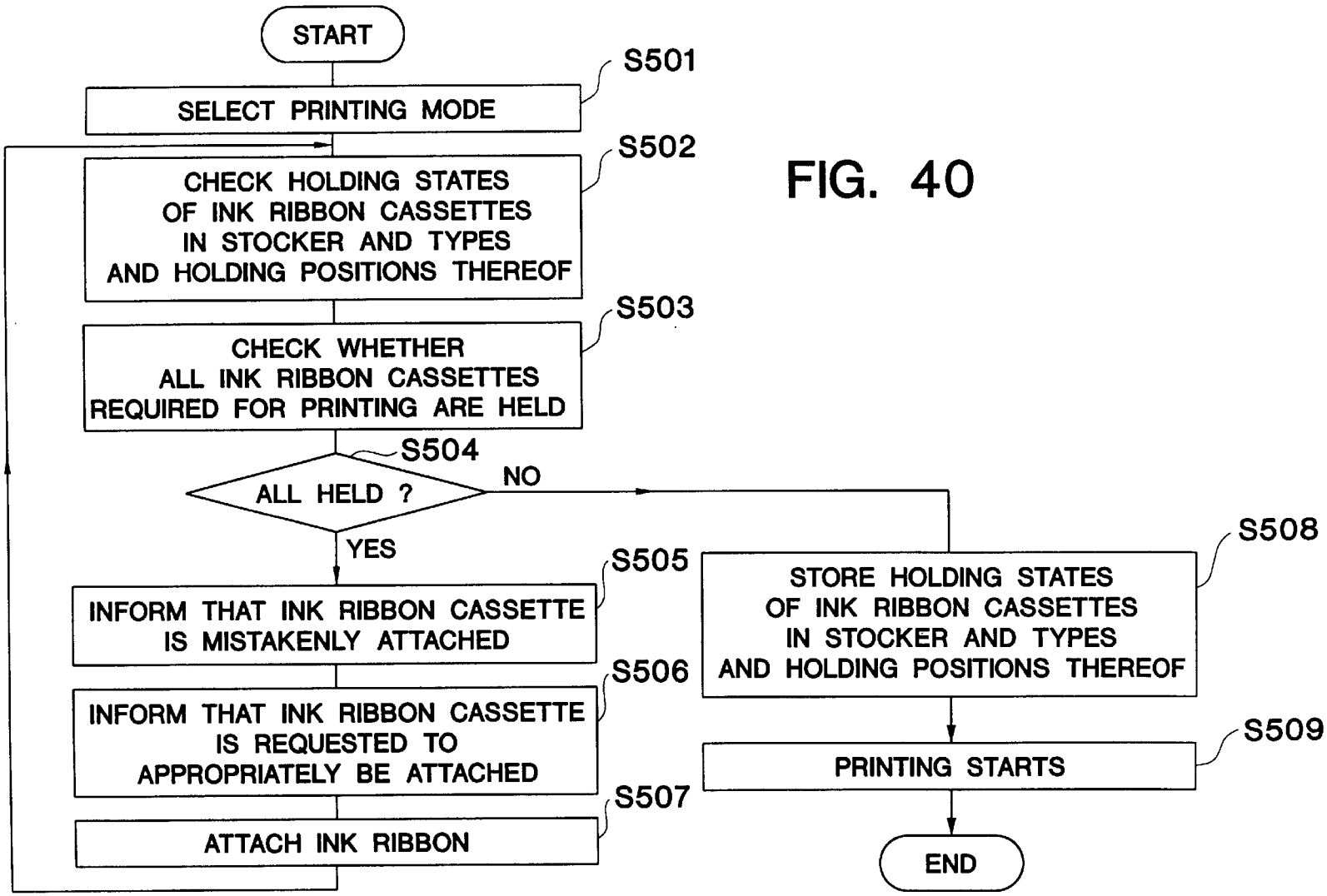
FIG. 40 is a flow chart showing what procedures are made for checking the holding states of the respective ink ribbon cassettes of the stocker prior to the printing so as to appropriately carry out the printing.

FIG. 40 is a flow chart showing what procedures are made for correctly printing by checking the ink ribbon cassette holding states of the stocker prior to the printing.

Such procedures are made for correctly printing irrespective of the holding positions of the stocker 5-1 in the case where it is judged that the required ink ribbon cassettes are all prepared upon checking prior to the printing whether or not the ink ribbon cassettes required for the selected printing mode are attached to the stocker 5-1.

Here, it is only necessary to identify what color ink ribbon cassettes are attached to the respective positions of the stocker 5-1. In the case where no stocker cassette type identification sensors are provided, it may be arranged so that the user inputs the types of the respective ink ribbon cassettes attached to the stocker 5-1 so as to be inputted from the ink ribbon cassette on the left side end to the ink ribbon cassette on the right side in order.

More specifically, the printing mode is first selected (S501). The holding states and types of the ink ribbon cassettes in the stocker 5-1 are detected by the sensor A (the stocker cassette type identification sensors 5-1-1-1 through 5-1-1-4), the sensor B (the stocker cassette type identification sensors 5-1-2-1 through 5-1-2-4) and the sensor C (the stocker cassette type identification 5-1-3-1 through 5-1-3-4).

In accordance with the detected results, it is checked whether or not all the types of the ink ribbon cassettes required for the printing mode selected in S501 are attached to the stocker 5-1 (S503). The types of the ink ribbon cassettes required for the printing mode have been stored in the memory device 3 as illustrated in FIG. 43. In S503, it is judged whether or not the results of S502 are coincident with the stored ones. Note that the coincidence of the holding positions is not necessary but the coincidence of the types and number is necessary. When one type of the ink ribbon cassettes is not coincident, the step proceeds from S504 to S505. In S505, the display device 4 alarms and informs the user that the ink ribbon is mistakenly attached. The display device 4 displays so as to alarm and inform the user that (1) ink ribbon cassette required for the printing which has been judged not to be attached in S502 and (2) its holding position in which the ink ribbon cassette should be held in the stocker 5-1 (S506).

In accordance with the alarmings and informings of S505 and S506, the ink ribbon cassette is attached by the user in S507. Thereafter, returning to S502, it is checked whether or not all the types of the ink ribbon cassettes required for the printing are attached to the stocker 5-1 again. When it is judged that all the types of the ink ribbon cassettes required for the printing are attached to the stocker 5-1 in S502 and S503, the step proceeds from S504 to S508 so that the types and the holding positions of the ink ribbon cassettes attached to the stocker 5-1 are stored in the RAM of the memory device 3 (S508). Then, the printing is carried out in accordance with the types and the holding places of the ink ribbon cassettes attached to the stocker 5-1 which have been stored in the RAM of the memory device 3 in S508 (S509).

For example, there are four holding places, i.e., a holding place 1 (located in the left end) through a holding place 4 (located in the right end) in the stocker 5-1. When the color printing mode is selected in S501, it is identified based on the data stored in the memory device 3 (see FIG. 43) that the four types of the ink ribbon cassettes required for the selected printing mode are black, yellow, magenta and cyan ink ribbon cassettes respectively.

It is assumed in S502 that (1) the cyan ink ribbon cassette is attached to the holding position 1, (2) the black ink ribbon cassette is attached to the holding position 2, (3) the magenta ink ribbon cassette is attached to the holding position 3 and (4) the blue ink ribbon cassette is attached to the holding position 4. In S503, since it is judged that the stocker 5-1 does not have the yellow ink ribbon cassette required for the printing. So, in S505 and S506, (1) "the blue ink ribbon cassette has been mistakenly attached to the stocker" and (2) "the yellow ink ribbon cassette should be attached to the holding position 4" are alarmed and informed to the user.

The user attaches the yellow ink ribbon cassette to the holding position 4 in accordance with the foregoing alarming and informing. Thus, when it is judged that all the ink ribbon cassettes required for the printing are prepared, the holding states and the types of the ink ribbon cassettes in the stocker 5-1, i.e., the data that (1) the cyan ink ribbon cassette is attached to the holding position 1, (2) the black ink ribbon cassette is attached to the holding position 2, (3) the magenta ink ribbon cassette is attached to the holding position 3 and (4) the yellow ink ribbon cassette is attached to the holding position 4 are stored in the memory device 3 as illustrated in FIG. 46.

The ink ribbon cassette changing of the changer 5-2 is carried out with reference to the data stored in the memory device 3. For instance, when the black ink ribbon cassette is required, the ink ribbon cassette in the holding position 2 is used. When the yellow ink ribbon cassette is required, the ink ribbon cassette in the holding position 4 is used. When the magenta ink ribbon cassette is required, the ink ribbon cassette in the holding position 3 is used. When the cyan ink ribbon cassette is required, the ink ribbon cassette in the holding position 1 is used.

As mentioned above, after the holding states of the ink ribbon cassettes in the stocker are checked prior to the printing, the printing is appropriately carried out.

Figure 31:
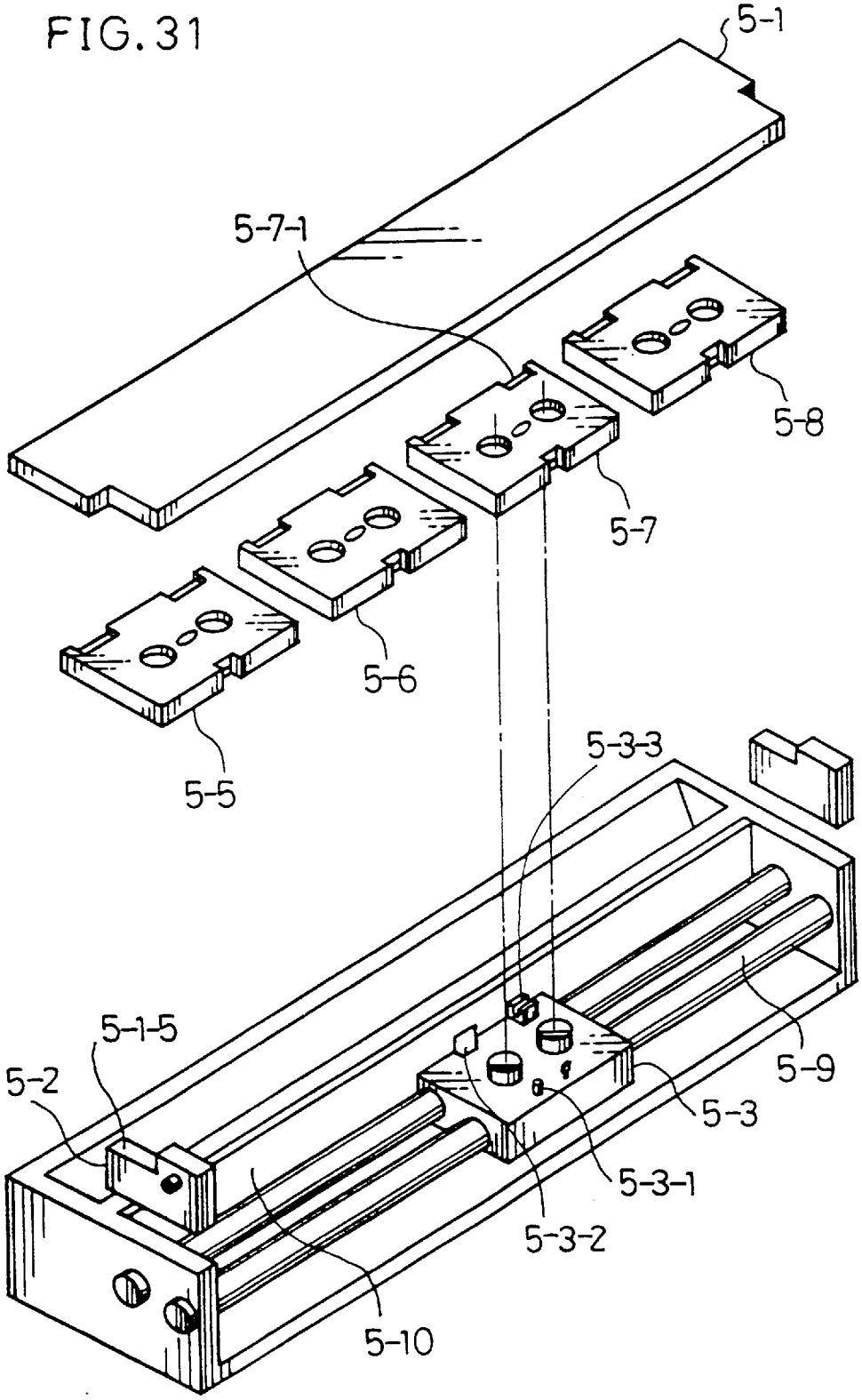
FIG. 31 is an explanatory view showing a case where it is judged on the carriage side whether or not the ink ribbon cassettes exist with the use of the stocker having no stocker cassette holding sensor.

With reference to FIG. 31, the following description deals with the case where it is judged on the carriage side whether or not the ink ribbon cassettes exist with the use of the stocker having no stocker cassette holding sensor.

As illustrated in FIG. 31, the stocker cassette holding sensors 5-1-1 through 5-1-4, which were provided in the stocker 5-1, are not provided for judging the ink ribbon cassette holding state of the stocker, i.e., for detecting whether or not the ink ribbon cassette exists.

Figure 32:
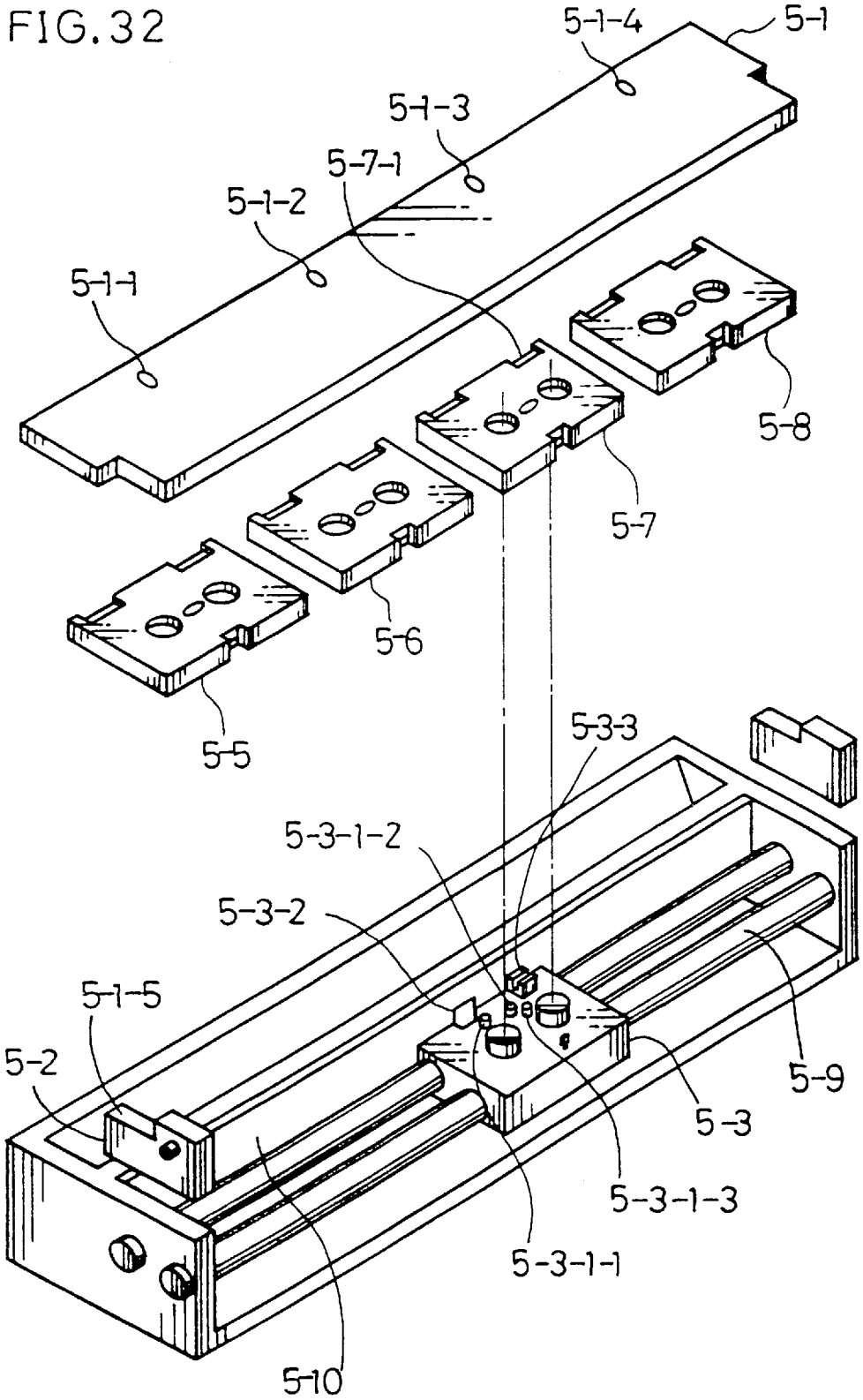
FIG. 32 is an explanatory view showing a case where it is judged on the carriage side whether or not the ink ribbon cassettes exist and the kind of the ink ribbon cassette with the use of the stocker having no stocker cassette type identification sensor.
Figure 33A:
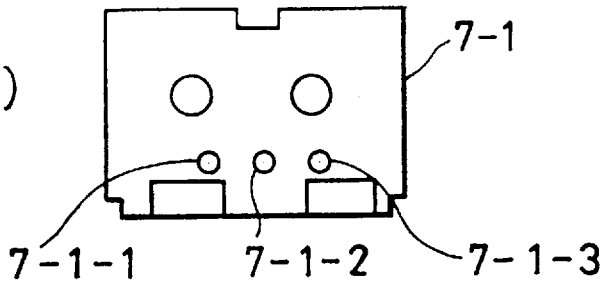
FIGS. 33(*a*) through 33(*d*) are explanatory views illustrating the identification holes for identifying the types of the respective ink ribbon cassettes.
Figure 33B:
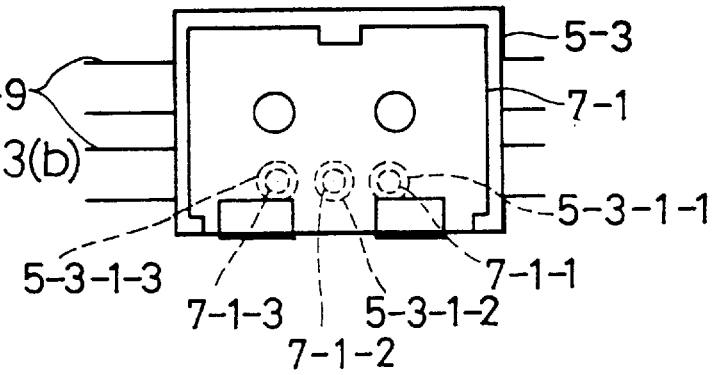
Figure 33C:
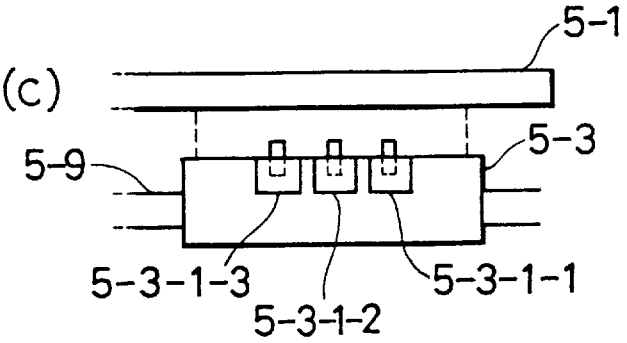
Figure 33D:
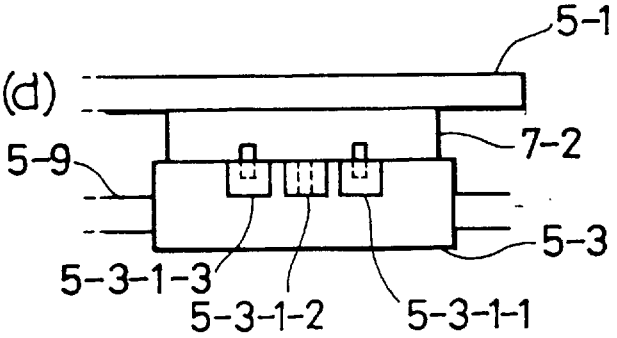

FIG. 32 is a view illustrating the case where it is judged on the carriage side whether or not the ink ribbon cassettes exist and what the types of the ink ribbon cassette are with the use of the stocker having no stocker cassette type identification sensors.

As illustrated in FIG. 32, instead of the sensor A (the stocker cassette type identification sensors 5-1-1-1 through 5-1-1-4), the sensor B (the stocker cassette type identification sensors 5-1-2-1 through 5-1-2-4) and the sensor C (the stocker cassette type identification sensors 5-1-3-1 through 5-1-3-4), there is provided a carriage cassette type identification sensor A (5-3-1-1), a carriage cassette type identification sensor B (5-3-1-2) and a carriage cassette type identification sensor C (5-3-1-3) for detecting what type of the ink ribbon cassette is held by the carriage 5-3.

According to the combinations of the detected results of the carriage cassette type identification sensor A (5-3-1-1), the carriage cassette type identification sensor B (5-3-1-2) and the carriage cassette type identification sensor C (5-3-1-3), it is identified whether or not the ink ribbon cassette is held by the carriage 5-3 and what type (color) of the ink ribbon cassette is held.

FIGS. 33(*a*) through 33(*d*) are explanatory views illustrating identification holes for identifying the i-types of the respective ink ribbon cassettes.

As illustrated in FIG. 33(*a*), there are provided identification holes 7-1-1 through 7-1-3 on respective predetermined positions of the surface of an ink ribbon cassette 7-1 which comes into contact with the upper surface of the carriage.

When the ink ribbon cassette 7-1 is held by the carriage 5-3 (see FIG. 33(*b*)), the carriage cassette type identification sensor A (5-3-1-1) is located in the identification hole 7-1-1, the carriage cassette type identification sensor B (5-3-1-2) is located in the identification hole 7-1-2 and the carriage cassette type identification sensor C (5-3-1-3 ) is located in the identification hole 7-1-3 respectively.

FIGS. 33(*c*) and 33(*d*) are detail explanatory views illustrating the carriage cassette type identification sensor A (5-3-1-1), the carriage cassette type identification sensor B (5-3-1-2) and the carriage cassette type identification sensor C (5-3-1-3).

The carriage cassette type identification sensor A (5-3-1-1), the carriage cassette type identification sensor B (5-3-1-2) and the carriage cassette type identification sensor C (5-3-1-3) respectively use the switches which change in to the on state when pushing down the respective projections. In case of FIG. 33(*c*), no ink ribbon is held by the stocker 5-1. Since no ink ribbon is held by the stocker 5-1, even when the stocker is moved down by the changer 5-2, the carriage cassette type identification sensor A (5-3-1-1), the carriage cassette type identification sensor B (5-3-1-2) and the carriage cassette type identification sensor C (5-3-1-3) are all into the off states. In contrast, as illustrate d in FIG. 33(*d*), when an ink ribbon cassette 7-2 having identification holes 7-2-1 and 7-2-3 is attached to the stocker 5-1 and the stocker 5-1 is moved down by the changer 5-2, the ink ribbon cassette 7-2 is held by the carriage 5-3, thereby resulting in that the carriage cassette type identification sensor A (5-3-1-1) and the carriage cassette type identification sensor C (5-3-1-3) become in the on states, while the carriage cassette type identification sensor B (5-3-1-2) becomes in the off state.

FIG. 37 is an explanatory view illustrating the relation between the positions of the respective identification holes and the types of the respective ink ribbon cassettes.

Thus, the holes for identifying the ink ribbon cassettes which are prepared in accordance with the types of the respective ink ribbon cassettes are detected by the carriage cassette type identification sensor A (5-3-1-1), the carriage cassette type identification sensor B (5-3-1-2) and the carriage cassette type identification sensor C (5-3-1-3). Then, it is judged whether or not the ink ribbon cassettes exist and what types of the ink ribbon cassettes are by the combinations of such detected results.

Figure 47A:
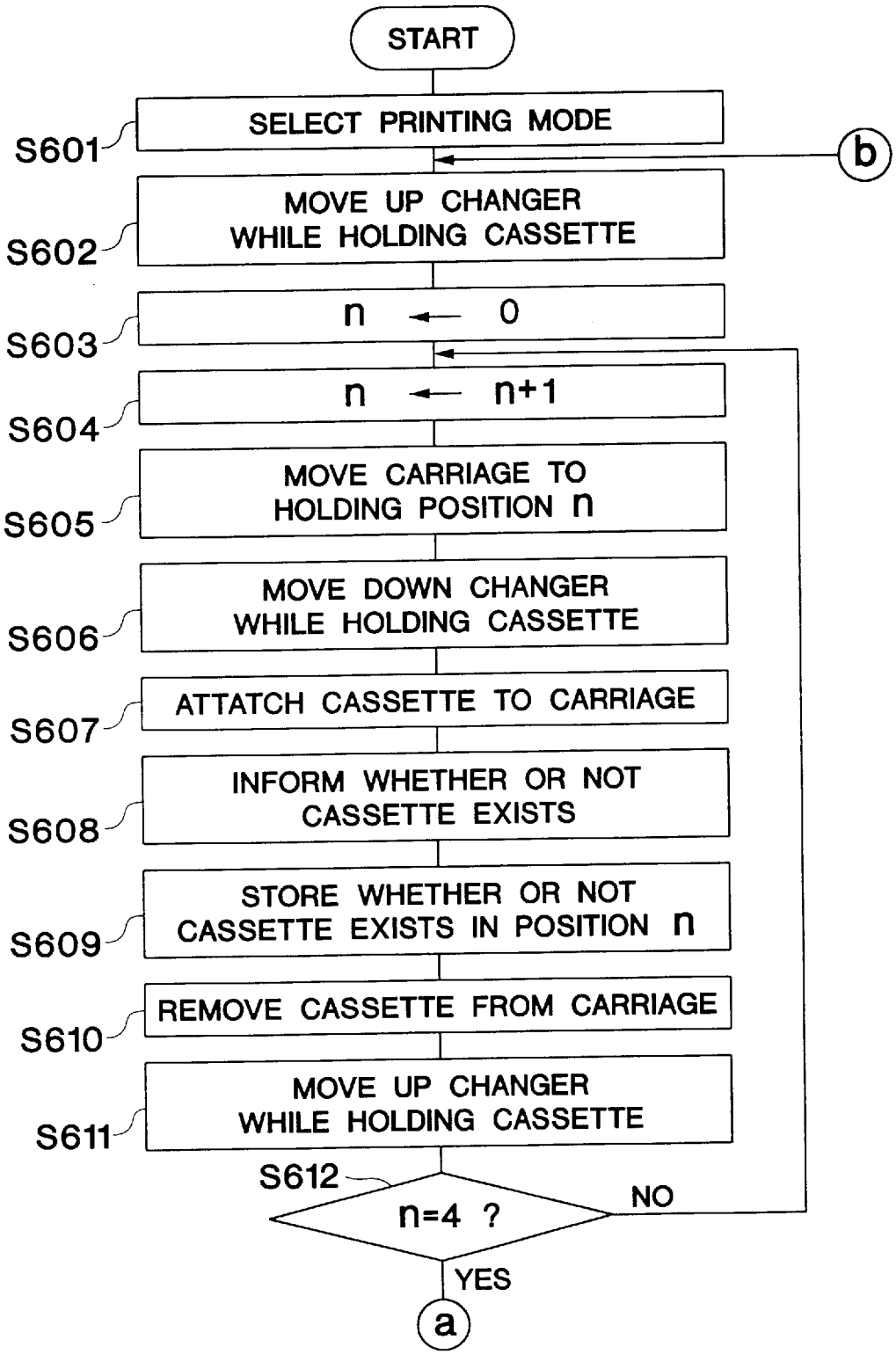
FIGS. 47*a* and 47*b* illustrate a flow chart showing what procedures are made for judging on the carriage side whether or not the ink ribbon cassettes exist with the use of the stocker having no stocker cassette holding sensor.
Figure 47B:
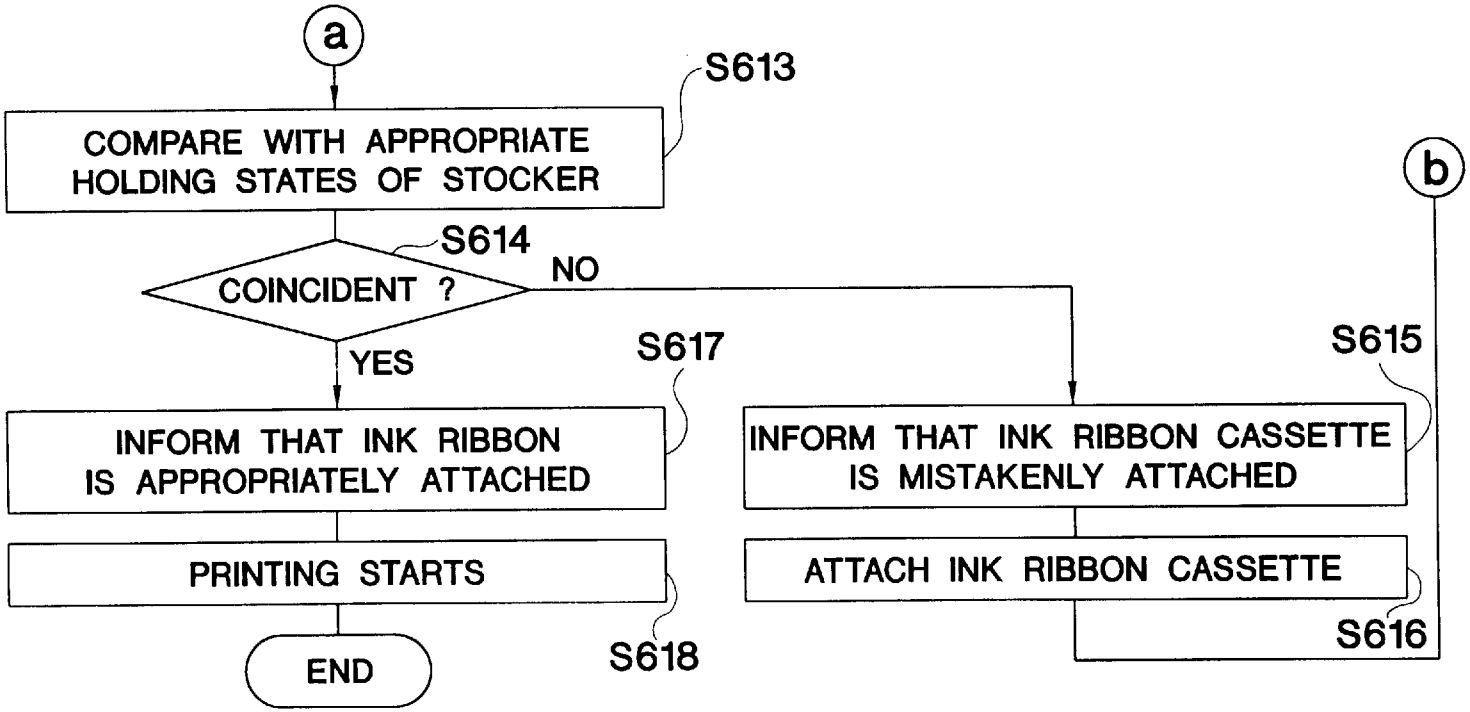

FIGS. 47*a* and 47*b* illustrate a flow chart showing what procedures are made for judging on the carriage side whether or not the ink ribbon cassettes exist with the use of the stocker having no stocker cassette holding sensors.

According to such procedures, it is confirmed whether or not the ink ribbon cassettes are attached to the stocker 5-1 prior to the printing operation as follows: (1) each attaching and detaching of the ink ribbon cassettes is carried out with respect to the position of the stocker 5-1 where each ink ribbon cassette is held, (2) the ink ribbon holding states in the respective holding positions of the stocker 5-1 are checked, i.e., whether or not the ink ribbon cassettes exist are checked by the carriage cassette holding sensor 5-3-1 of the carriage 5-3, thereby confirming the user that the types of the ink ribbon cassettes required for the selected printing mode and the holding positions to be held thereof.

The required number and the types of the ink ribbon cassettes vary depending on the selected printing mode. So, the memory device 3 stores the data (appropriate ink ribbon cassette holding states) shown on FIG. 43 beforehand. Note that it not necessary for an ink ribbon cassette to be held in the position denoted as "arbitrary" in FIG. 43. Note also that either a "red", "green", or "blue" ink ribbon cassette may be held in the position denoted as "color".

First, the printing mode is selected (S601). The stocker 5-1 is moved up by the changer 5-2 (S602). Then, a counter n is reset to zero (S603).

The counter n is incremented by 1 (S605). The carriage 5-3 is moved under a holding position n of the stocker 5-1 (S605). Then, the stocker 5-1 is moved down by the changer 5-2 (S606). The ink ribbon cassette of the holding position n in the stocker 5-1 is attached to the carriage 5-3 (S607).

It is detected by the carriage cassette holding sensor 5-3-1 of the carriage 5-3 whether or not the ink ribbon cassette exist in the holding position n of the stocker 5-1 (S 608). In S609, it is stored in the RAM of the memory device 3 whether or not the ink ribbon cassette exist in the holding position n of the stocker 5-1 (see FIG. 49). The ink ribbon cassette is taken out from the carriage 5-3 (S610). Thereafter, the ink ribbon cassette is returned to the stocker 5-1 and the stocker 5-1 is moved up (S611).

According to the present embodiment, since there are four ink ribbon cassette holding positions in the sticker 5-1, it is checked whether or not the counter n is equal to four. If not so, S604 is carried out so that the counter n is incremented by 1. Thereafter, with respect to the next holding position of the stocker 5-1, it is similarly checked whether or not the ink ribbon cassette exists, and such checked result is stored.

Thus, S604 through S611 are repeatedly carried out during n<4, i.e., are repeatedly carried out for the respective holding positions 1 through 4 of the stocker 5-1, thereby checking and storing the actual holding states (existence or non-existence) of the ink ribbon cassettes of the stocker 5-1.

FIG. 49 shows one storing example of such holding states. The content of the stored holding states is effective until the stocker 5-1 is opened, i.e., until the stocker close sensor 5-1-5 changes into the off state.

Next, (1) the actual holding states (existence or non-existence) of the ink ribbon cassettes of the stocker 5-1 obtained in accordance with the foregoing manner and (2) the holding states of the ink ribbon cassettes, which are stored in the memory device 3 as shown in FIG. 43, suitable for the selected printing mode are compared with each other (S613). If the ink ribbon cassette is not attached to the holding position of the stocker where the ink ribbon cassette must be attached, the step proceeds from S614 to S615 so that the display device 4 alarms and informs the user that the ink ribbon cassette is mistakenly attached. When the user attaches the ink ribbon cassette to the appropriate holding position (S616), the process returns to S602 so as to check the ink ribbon cassette holding states of the stocker.

In contrast, when (1) the actual holding states (existence or non-existence) of the ink ribbon cassettes of the stocker 5-1 obtained in accordance with the foregoing manner and (2) the holding states of the ink ribbon cassettes, which are stored in the memory device 3 as shown in FIG. 43, suitable for the selected printing mode (S613) are coincident with each other in S614, S617 is proceeded so that the display device 4 informs and confirms the user by displaying, as shown in FIG. 44, the types of the ink ribbon cassettes and the due positions thereof with reference to the ink ribbon cassette holding data (FIG. 43) stored in the memory device 3.

Thereafter, S618 is proceeded so as to start the printing.

According to the foregoing manner, it is judged on the carriage side whether or not the ink ribbon cassettes exist with the use of the stocker having- no stocker cassette holding sensor.

Figure 48A:
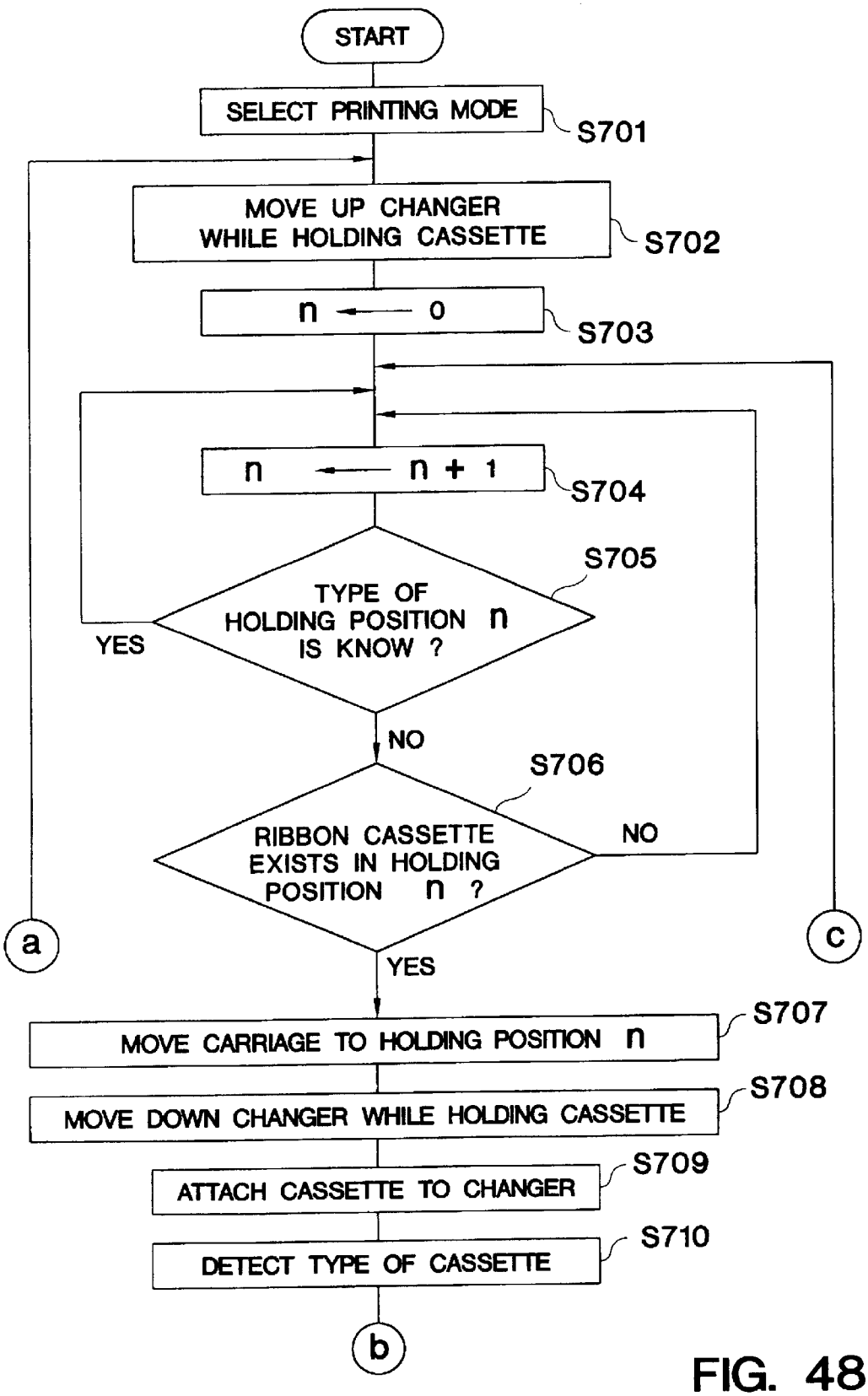
FIGS. 48*a* and 48*b* illustrate a flow chart showing what procedures are made for judging on the carriage side whether or not the ink ribbon cassettes exist and the type of the ink ribbon cassette with the use of the stocker having no stocker cassette type identification sensor.
Figure 48B:
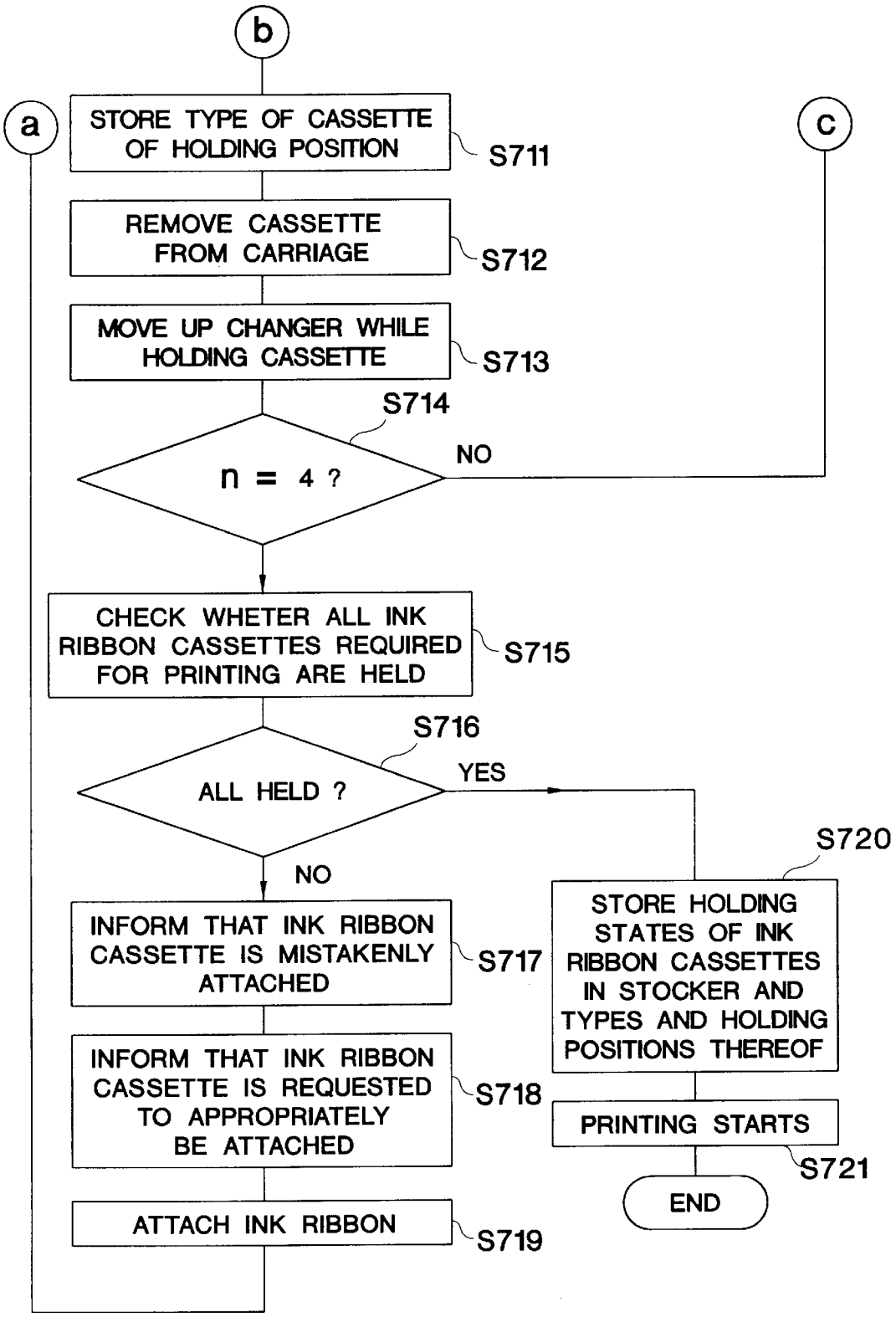

FIGS. 48*a* and 48*b* illustrate a flow chart showing what procedures are made for judging on the carriage side of (1) the existence or non-existence of the ink ribbon cassettes and (2) the types thereof with the use of the stocker having no stocker cassette type identification sensor.

According to such procedures, it is confirmed of existence and non-existence of the ink ribbon cassettes and the types thereof in the stocker 5-1 prior to the printing operation as follows: (1) each attaching and detaching of the ink ribbon cassettes is carried out with respect to the position of the stocker 5-1 where each ink ribbon cassette is held, (2) the ink ribbon cassette holding states (existence or non-existence and types) in the respective holding positions of the stocker 5-1, i.e., whether or not the ink ribbon cassettes exist are checked by the carriage cassette type identification sensor A (5-3-1-1), the carriage cassette type identification sensor B (5-3-1-2), and the carriage cassette type identification sensor C (5-3-1-3), and (3) it is checked in accordance with the holding states whether or not the types of the ink ribbon cassettes required for the selected printing mode are attached to the stocker 5-1. If so, the .printing is appropriately carried out irrespective of the holding position of the stocker 5-1.

First, the printing mode is selected (S701). The stocker 5-1 is moved up by the changer 5-2 (S702). Then, the counter n is reset to zero (S703). In S704, the counter n is incremented by 1. When the type of the ink ribbon cassette, held in the holding position n of the stocker 5-1, has been identified based on the fact that the types of the ink ribbon cassettes of the stocker 5-1 have once been checked for example (S705 and S706), it is recognized as unnecessary to judge the type of the ink ribbon cassette in the holding position n, thereby returning to S704 so that the counter n is further incremented by 1 and the type of the ink ribbon cassette is detected with respect to the next one in the stocker 5-1. Note that in the case where the types of the respective ink ribbon cassettes in the stocker 5-1 have been identified, since such types are stored in the RAM of the memory device 3 as shown in FIGS. 46 and 50, it is judged in accordance with the stored data whether or not the types have been identified.

In contrast, when the type of the ink ribbon cassette, held in the holding position n of the stocker 5-1, has not yet been identified based on the fact that the types of the ink ribbon cassettes of the stocker 5-1 is checked for the first time for example (S705), the process advances to S706.

In S706, it is detected by the stocker cassette holding sensors 5-1-1 through 5-1-4 whether or not the ink ribbon cassette is held in the holding position n of the stocker 5-1.

If not, the process returns to S704 based on the judgement that no ink ribbon cassette exists in the holding position n of the stocker 5-1, thereafter the detection is carried out with respect to the next holding position of the stocker 5-1 by further incrementing the counter n by 1.

In S706, when it is judged that the ink ribbon cassette is held in the holding position n, S707 is carried out accordingly. In S707, the carriage 5-3 is moved under the holding position n of the stocker 5-1. Then, the stocker 5-1 is moved down by the changer 5-2 (S708), and the ink ribbon cassette in the holding position n of the stocker 5-1 is attached to the carriage 5-3 (S709). In S710, it is detected, what type of the ink ribbon cassette is held in the holding position n of the stocker 5-1, by the carriage cassette type identification sensor A (5-3-1-1), the carriage cassette type identification sensor B (5-3-1-2) and the carriage cassette type identification sensor C (5-3-1-3) of the carriage 5-3. The detected type of the ink ribbon cassette in the holding position n is stored in the RAM of the memory device 3 as shown in FIGS. 46 and 50 (S711). Thereafter, the ink ribbon cassette is taken out from the carriage (S712), and the ink ribbon cassette is returned to the stocker 5-1 by the changer 5-2. In S713, the stocker 5-1 is moved up.

According to the present embodiment, since there are provided four ink ribbon cassette holding positions in the stocker 5-1, it is checked in S714 whether or not the counter n is equal to four. If not counted, S704 is carried out again and the counter n is incremented by 1 so that the existence or non-existence of the ink ribbon cassettes is detected for the next holding position of stocker 5-1 and the detected result is stored in like the manner. Thus, S704 through S713 are repeatedly carried out during n≦4, i.e., are repeatedly carried out for the respective holding positions 1 through 4 of the stocker 5-1, thereby checking and storing the actual holding states (existence or non-existence and types) of the respective ink ribbon cassettes of the stocker 5-1.

FIGS. 46 and 50 show one storing example of such holding states. The content of the stored holding states is effective until the stocker 5-1 is opened so as to be taken out the ink ribbon cassette, i.e., until the stocker cassette holding sensors 5-1-1 through 5-1-4 change into the off state.

Based on thus obtained results, it is checked whether or not all the types of the ink ribbon cassettes required for the printing mode selected in S701 are attached to the stocker 5-1 (S715). The ink ribbon cassettes required for the selected mode have been stored in the memory device 3 as shown in FIG. 43. In S716, it is judged whether or not the appropriate ink ribbon holding states are coincident with the actual holding states. Note that it is not necessary that the respective holding positions are coincident with each other but necessary that the number and types are coincident with each other. If one of the ink ribbon cassettes is not prepared, the process advances from S716 to S717. In S717, the device such as the display device 4 alarms and informs the user that there occurs error due to the ink ribbon cassette. The display device 4 alarms and informs that (1) the ink ribbon cassette required for the printing which is judged not to be attached to the stocker 5-1 in accordance with the checking of S715 and (2) the position to which the ink ribbon cassette must be attached (S718).

After the user attaches the ink ribbon cassette in accordance with the alarming and informing of S717 and S718 (S719); S702 is carried out again so that it is checked whether or not all the types of the ink ribbon cassettes required for the printing are attached to the stocker 5-1.

During the re-check, the checking with respect to the holding position, where the attaching and detaching of the ink ribbon cassette are not carried out in S719 because the types of the ink ribbon cassette has already been identified, is skipped in S705.

Thus, when it is judged that all the types of the ink ribbon cassettes required for the printing are attached to the stocker 5-1 in S702 through S716, the types of the respective ink ribbon cassettes attached to the stocker 5-1 and the holding positions of the respective ink ribbon cassettes are stored in the RAM of the memory device 3 as shown in FIGS. 46 and 50 (S720). In S721, the desired printing is carried out in accordance with the types of the respective ink ribbon cassettes attached to the stocker 5-1 and the holding positions of the respective ink ribbon cassettes which are stored in S720.

For example, since there are provided four holding positions, i.e., the holding position 1 (the left end) through the holding position 4 (the right end), when the color printing mode is selected in S701, it is judged based on the content (see FIG. 43) of the memory device 3 that the four types of the ink ribbon cassettes required for the color printing mode are black, yellow, magenta and cyan ink ribbon cassettes respectively. It is assumed that the cyan ink ribbon cassette is held in the holding position 1, the black ink ribbon cassette is held in the holding position 2, the magenta ink ribbon cassette is held in the holding position 3 and the blue ink ribbon cassette is held in the holding position 4 in S702 through S714. Since it is judged that the yellow ink ribbon cassette required for the printing lacks in S715, it is alarmed and informed to the user that "the blue ink ribbon cassette is mistakenly attached" and "the yellow ink ribbon cassette should be attached to the holding position 4.

When it is confirmed, based on the fact that the user has attached the yellow ink ribbon cassette to the holding position 4, that all the ink ribbon cassettes required for the printing are prepared, the ink ribbon cassette holding states of the stocker 5-1 and types of the ink ribbon cassettes are respectively stored, i.e., the data that the cyan ink ribbon cassette is held in the holding position 1, the black ink ribbon cassette is held in the holding position 2, the magenta ink ribbon cassette is held in the holding position 3 and the yellow ink ribbon cassette is held in the holding position 4 are stored in the memory device 3 as shown in FIG. 46.

The changer 5-2 changes the ink ribbon cassette in reference to such stored data. More specifically, when the black ink ribbon cassette is required, the ink ribbon cassette attached to the holding position 2 is used. When the yellow ink ribbon cassette is required, the ink ribbon cassette attached to the holding position 4 is used. When the magenta ink ribbon cassette is required, the ink ribbon cassette attached to the holding position 3 is used. When the cyan ink ribbon cassette is required, the ink ribbon cassette attached to the holding position 1 is used.

It is judged on the carriage side in accordance with the foregoing manner (1) whether or not the ink ribbon cassettes exist and (2) what types of the respective ink ribbon cassettes are attached with the use of the stocker having no stocker cassette type identification sensor.

[FOURTH EMBODIMENT]

The following descriptions will discuss the fourth embodiment of the present invention in reference to FIG. 51 through FIG. 60. However, it should be noted here that the present invention is not limited to this preferred embodiment.

The present embodiment will be explained through the example of the ink ribbon cassette-automatic changer printing system which permits a printing operation by automatically exchanging among four ink ribbon cassettes.

The basic configuration of the system of the present invention is the same as that of the first embodiment with some exemptions. Therefore, for convenience in explanations, members having the same function as the aforementioned preferred embodiment will be designated by the same reference numerals, and thus the descriptions thereof shall be omitted here.

FIG. 51 is a table which summarizes the relationship among the output state of the changer upper limit sensor 5-2-2 and the changer lower limit sensor 5-2-3 (see FIG. 9 in the first embodiment), and an angle of the cam 5-2-1 and the height position of the stocker. For example, when the changer upper limit sensor 5-2-2 is set ON, and the changer lower limit sensor 5-2-3 is set OFF, it can be seen that the angle of the cam 5-2-1 is 0°, and the stocker 5-1 is set in the upper limit position.

In the present embodiment, a carriage left limit sensor (not shown) is provided. The carriage left limit sensor is turned ON when the carriage 5-3 is moved to the left limit position, and using this position as an original position, the carriage left limit sensor recognizes the current position of the carriage 5-3 by the moving distance from the original position. (The motor for driving the carriage 5-3 can recognizes the moving distance by the number of steps of the stepping motor is provided).

Here, in order to move the carriage 5-3 right below each of the ink ribbon cassettes 5-5 through 5-8, the number of steps (from the original position to the position of each stocker) to be applied to the stepping motor (not shown) for moving the carriage 5-3 is stored in the memory device 3 beforehand. Then, the value obtained by subtracting the number of steps in the current position of the carriage from the number of steps in the target position of the stocker is applied to the stepping motor.

When the changer 5-2 raises or lowers the stocker 5-1, whether or not the stocker movable holding claw (see FIG. 15 in the first embodiment) can be selected by the claw moving cam (not shown) which raises and lowers the stocker 5-1.

Like the cam 5-2-1 (see FIG. 9 in the first embodiment), the claw moving cam rotates in synchronous with the operation of the changer. The claw moving cam has a projection formed at a position between 180° (the stocker 5-1 is at the bottom end) and 270° (the stocker 5-1 is at the intermediate position) for moving the stocker movable holding claw.

Namely, when the stocker 5-1 is raised by rotating the changer motor (not shown) in the direction of 180°→270°→360° (0°), the stocker movable holding claw 5-1-8 is moved. On the other hand, when the stocker 5-1 is raised by rotating the changer motor in the direction of 180°→90°→0°, the stocker movable holding claw 5-1-8 is not moved.

Figure 52A:
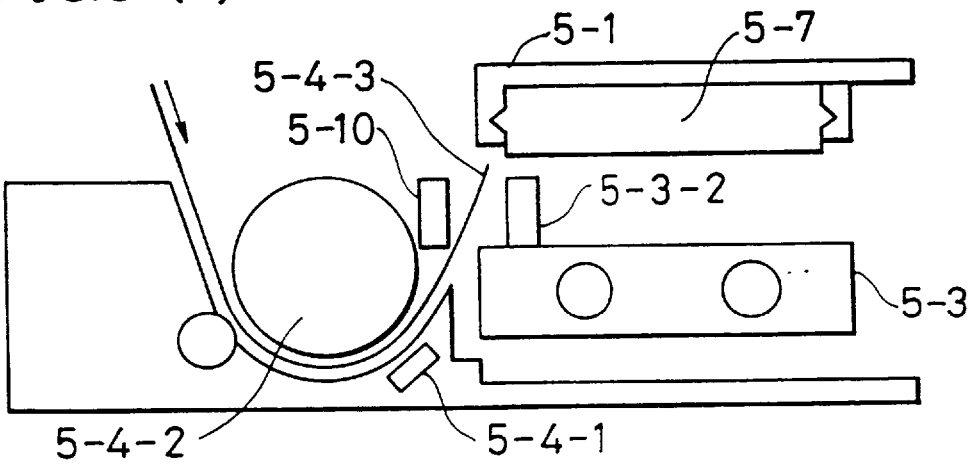
FIGS. 52(*a*) and 52(*b*) are side views of an ink ribbon cassette automatic changer printer of an embodiment.
Figure 52B:
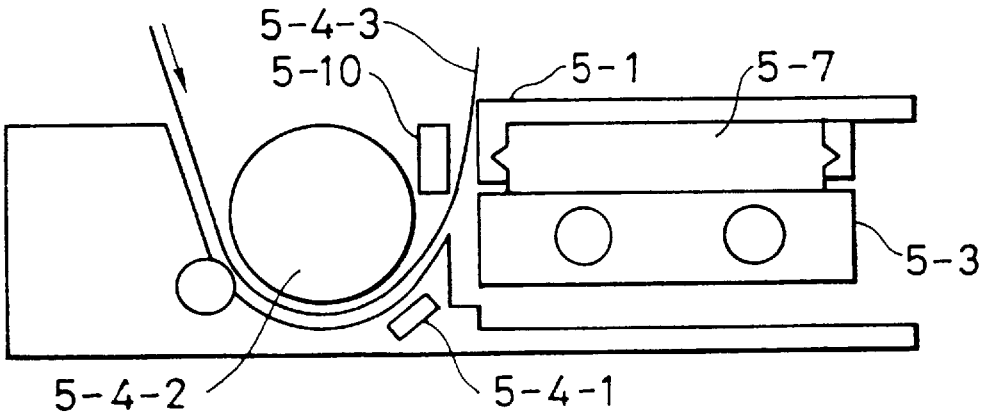

FIG. 52(*a*) and FIG. 52(*b*) are explanatory view showing the cross section of the ink ribbon cassette automatic changer printer in accordance with the present invention. FIG. 52(*a*) shows the state where the stocker 5-1 is raised to the upper limit position, while FIG. 52(*b*) shows the state where the stocker 5-1 is lowered to the lower limit position.

In FIG. 52(*a*) and FIG. 52(*b*), the print sheet 5-4-3 is fed by the sheet feeding roller 5-4-2 in the direction of an arrow in the figures to be placed between a platen 5-10 and the print head 5-3-2.

When the print sheet 5-4-3 is inserted, the output from the sheet detecting sensor 5-4-1 is set ON so as to indicate that the sheet is inserted. For the sheet detecting sensor 5-4-1, the same switch as the carriage cassette detecting sensor 5-3-1 is used (the switch is turned ON only when the projection is pushed, and the projection is pushed by the insertion of the sheet, and the output is set ON.

In FIG. 52(*a*), the stocker 5-1 is placed in the upper limit position. However, in this state, when the print sheet 5-4-3 is transported, the leading end portion of the print sheet 5-4-3 is brought in contact with the bottom end portion of the stocker 5-1, which causes sheet jam.

In FIG. 52(*b*), the stocker 5-1 is placed at the lower limit position. In this state, the print sheet 5-4-3 is not in contact with the lower limit position of the stocker 5-1, and is smoothly transported while being guided by the front surface portion of the stocker 5-1.

Figure 53:
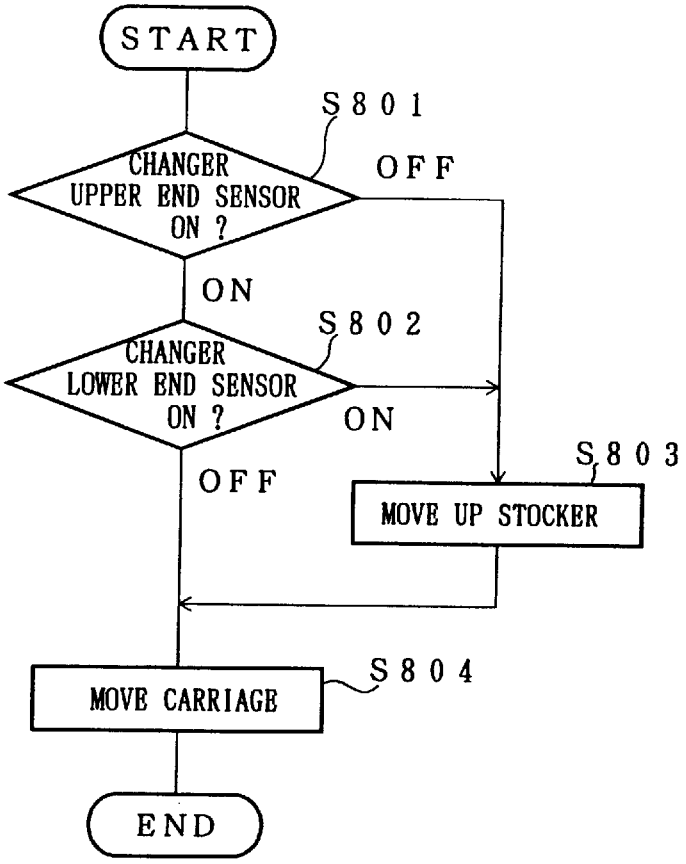
FIG. 53 is a flow chart showing how the changer prohibits the movement of the carriage when the changer is not in the carriage movable state.

FIG. 53 is a flowchart showing process for preventing the carriage from moving when the changer is not in the carriage movable state.

In the present embodiment, in order to pass the ink ribbon cassette between the stocker 5-1 and the carriage 5-3, the changer 5-2 moves the stocker 5-2 up and down. However, even if the carriage 5-3 is tried to be moved when the stocker 5-1 is not raised, the carriage 5-3 is in contact with the stocker 5-1, and the carriage 5-3 cannot be moved, which causes a trouble in this process, it is controlled such that the carriage 5-3 is not moved when the stocker is not placed in the upper limit position.

When an instruction for moving the carriage 5-3 is given, the process shown in the flowchart of FIG. 53 is started. First, in S801, it is determined whether the changer upper limit sensor 5-2-2 is set in the ON position or the OFF position. If the changer upper limit sensor 5-2-2 is set in the ON position, the sequence goes to S802, while, if the changer upper limit sensor 5-2-2 is set in the OFF position, the sequence goes onto S803.

In S802, it is determined whether the changer lower limit sensor 5-2-3 is set in the ON position or in the OFF position. If the changer lower limit sensor 5-2-3 is set in the ON position, the sequence goes to S803, while, if the changer upper limit sensor 5-2-2 is set in the OFF position, the sequence goes to S804.

In S803, since the changer upper limit sensor 5-2-2 is in the OFF position or the changer upper limit sensor 5-2-2 is set in the ON position and the changer lower limit sensor 5-2-3 is in the ON position, as can be seen from FIG. 51, the stocker is not in the upper limit position, and the carriage 5-3 cannot be moved. Therefore, the stocker 5-1 is moved by the carriage 5-3, and the sequence goes onto S804.

On the other hand, in S804, since the changer upper limit sensor 5-2-2 is set ON, and the changer lower limit sensor 5-2-3 is set OFF, it can be seen that the stocker 5-1 is in the upper limit position as is clear from FIG. 51, and the carriage 5-3 is moved, thereby terminating the process.

By the described process, when the changer is not set in the carriage movable position, the movement of the carriage is stopped.

FIG. 24 is a flowchart showing the content of the process for stopping the operation of the changer when the changer is not set in the desired state.

In the present embodiment, when the ink ribbon cassette is passed between the stocker 5-1 and the carriage 5-3, the changer 5-2 moves the stocker 5-1 up and down. However, when the stocker 5-1 cannot be moved for some reason (for example, the carriage 5-3 is moved by the user or a object is placed on the stocker 5-1), a load is incurred on the changer motor, etc., which may result in some trouble. Therefore, in this process, it is controlled such that if a desirable state of the changer 5-2 cannot be achieved even after a predetermined time has elapsed, the operation of the changer 5-2 would be stopped.

The predetermined time is set to an optimal value according to the specification of the ink ribbon cassette automatic changer printer (larger enough than the time required for a normal operation and smaller enough than the time which creates the problem such as an overheat of the motor) to be stored in the memory device 3.

Figure 54:
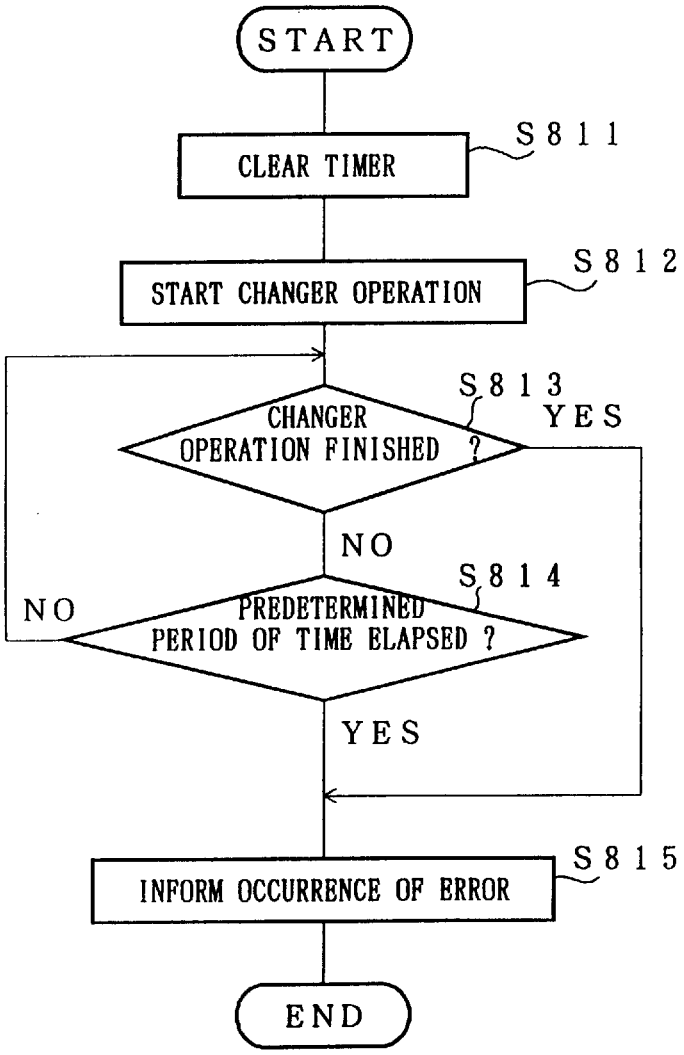
FIG. 54 is a flow chart showing what procedures are made for prohibiting the movement of the changer when the changer does not become a target state.

When an instruction is given for operating the changer 5-2, the process shown in the flowchart of FIG. 54 is started. First, in S811, the timer is reset for measuring the time. The timer is provided in the arithmetic and control unit 1.

In S812, the operation of the changer 5-2 (for raising or lowering the stocker 5-1) is initiated.

In S813, it is determined whether or not the operation of the changer 5-2 is completed by the changer upper limit sensor 5-2-2 and the changer lower limit sensor 5-2-3. If so, the process is terminated, and if not the sequence goes onto S814.

In the case where the changer 5-2 is operated so as to raise the stocker 5-1, when the changer upper limit sensor 5-2-2 is set in the ON position, and the changer lower limit sensor is set in the OFF position, it is determined that the process is completed. On the other hand, in the case where the changer 5-2 is operated so as to lower the stocker 5-1, when the changer upper limit sensor 5-2-2 is set in the OFF position, and the changer lower limit sensor is set in the ON position, it is determined that the process is completed.

In S814, it is determined whether or not a predetermined time has elapsed after the operation of the changer 5-2 is started based on the timer in the arithmetic control unit 1 and the time set in the memory unit 3. If the predetermined times has not elapsed, the sequence goes back to S813, and if elapsed, the sequence moves onto S815.

In S815, since the operation of the changer 5-2 is not completed although the predetermined time has elapsed, it is determined that an abnormality has occurred in the ink ribbon cassette automatic changer printer. Then, a message such as "Abnormality has occurred in the printer. Switch off the power supply." is displayed on the display unit 4 so as to inform the user of the occurrence of abnormality, thereby terminating the process in accordance with the present embodiment.

By the displayed message, the user can see the occurrence of the abnormality in the printer, and if an object is placed on the stocker, it is to be removed, and the power switch is turned off.

On the other hand, if the power supply is turned on again, the system initializes the printer. In this state, if the problem of the abnormality condition is solved, the printing operation is performed again in the normal process.

By the process for managing the abnormality condition, if the changer is not set in the desired state, the operation of the changer is stopped.

Figure 55:
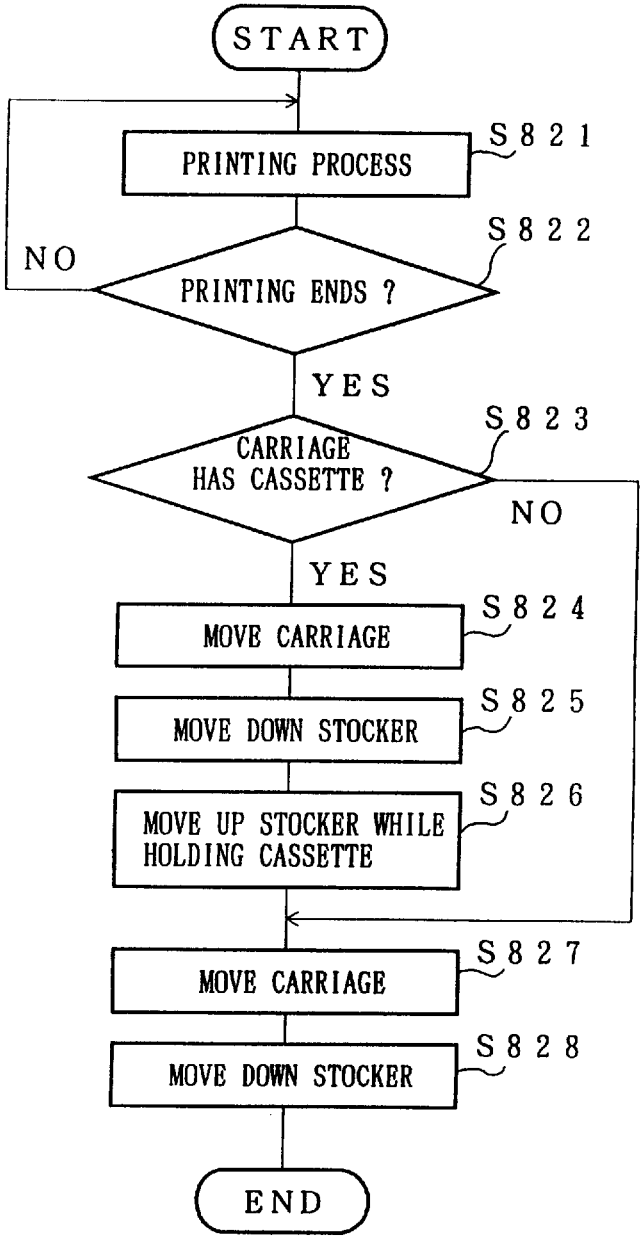
FIG. 55 is a flow chart showing what procedures are made for automatically moving the changer from the carriage movable state into a ribbon changing state after the printing operation.

FIG. 55 is a flowchart showing the content in the process for automatically switching the changer from the carriage movable state to the ribbon exchange state.

In this process, in order to ease the insertion of print sheet by the user in the ink ribbon cassette automatic changer printer (in order to prevent the occurrence of sheet jamming), or in order to lower the height of the member for storing the ink ribbon cassette automatic changer printer, it is controlled so that the stocker 5-1 is lowered after the printing operation is completed.

When the printing operation of the ink ribbon cassette automatic changer printer is started, the process shown in the flowchart of FIG. 55 is started. First, in step S822, the printing process is performed. In S822, it is determined whether or not the printing operation is terminated. If not, the sequence goes back to S821, if so the sequence moves onto S823.

In S823, it is determined whether or not the ink ribbon cassette is held on the carriage 5-3. If so, the sequence moves onto S827, and if not the sequence moves to S824.

In S824, in order to set the ink ribbon cassette on the carriage 5-3 back to the initial position of the stocker 5-1, the carriage 5-3 is moved to the position right below the holding position corresponding to the stocker 5-1.

In S825, the changer 5-2 lowers the stocker 5-1. As a result, the ink ribbon cassette on the carriage 5-3 is supported by both the carriage 5-3 and the stocker 5-1.

In S826, the changer 5-2 raises the stocker 5-1 (holding the ink ribbon cassette) without moving the stocker movable holding claw 5-1-8. By the described process in S824 through S826, the ink ribbon cassette is passed to the stocker 5-1 on the carriage 5-3.

Next, in S827, the carriage 5-3 is moved to the home position.

In the conventional printer, the home position of the carriage 5-3 is set in the central position as disclosed by Japanese Laid-Open Patent Application No. 2582767/1990 (Tokukaihei 2-2582767), in order to smoothly transport the print sheet. On the other hand, in the present invention, it is arranged so as to smoothly transport the print sheet by setting the stocker in the lower position 5-1 as will be described later. Therefore, the home position of the carriage 5-3 is not limited. For example, in the present embodiment, the home position is set to the left end position of the stocker 5-1 for storing the black ink ribbon cassette which is usually used most often. However, the home position may be set to an other position.

In S828, the changer 5-2 does not lower the stocker movable holding claw 5-1-8 but lowers the stocker 5-1 (holding the ink ribbon cassette).

By the described process, after performing the printing operation, the position of the changer is automatically switched from the carriage movable state to the ribbon exchange state.

The processes in S824 and S827 are the processes for moving the carriage 5-3. Therefore, if the changer is not in the carriage movable state, it is also controlled so as to prevent the carriage from moving.

The processes in S825, S826 and S828 are to be performed by the changer 5-2 (for moving the stocker 5-1 up and down). Therefore, it is also controlled such that if the changer is not set in the desired state, the operation of the changer is stopped.

Figure 58:
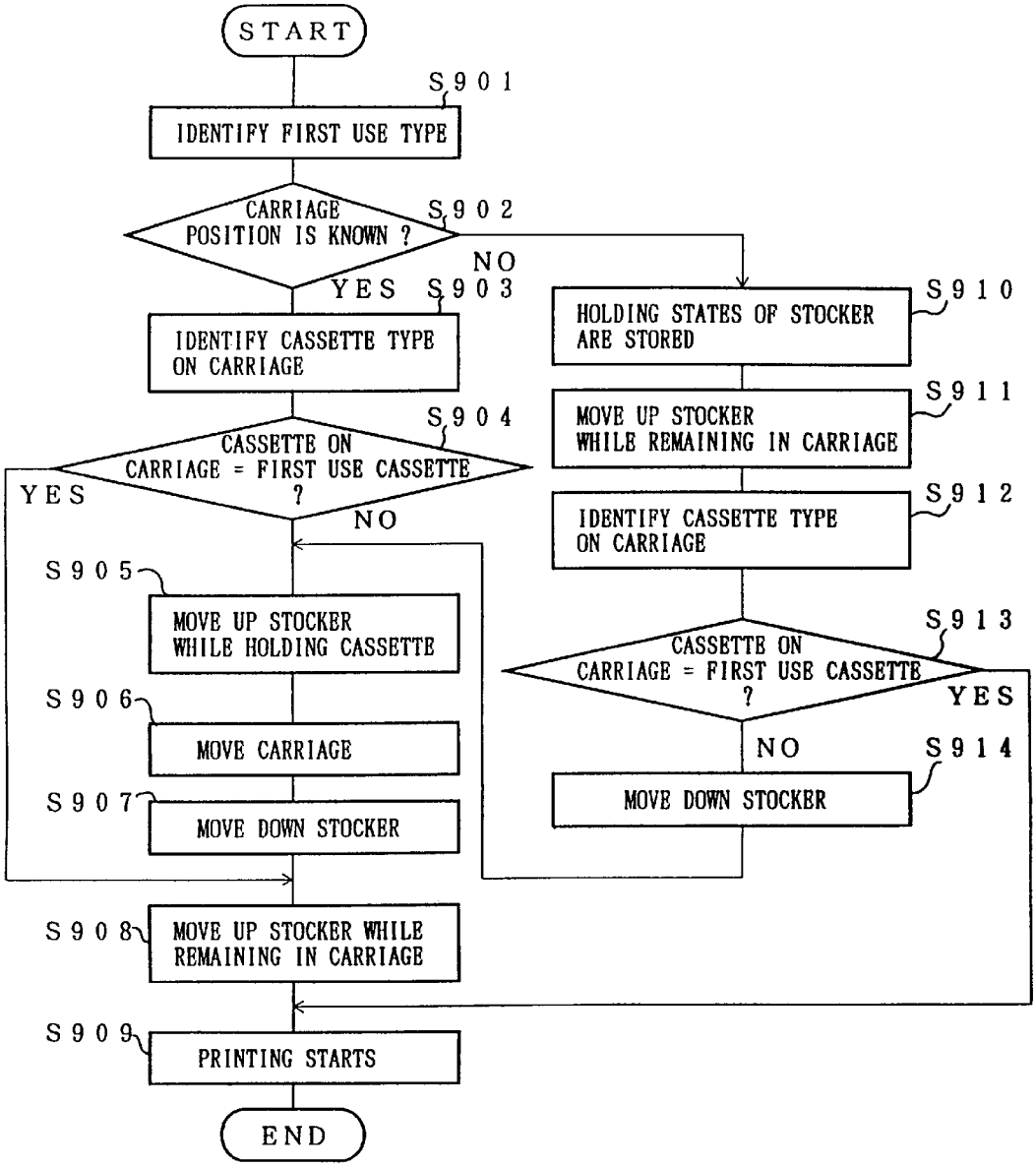
FIG. 58 is a flow chart showing (1) the procedures of whether or not the stocker is moved up while holding the ink ribbon cassette when starting the printing and (2) the procedures for identifying the type of the ink ribbon cassette on the carriage in accordance with the ink ribbon cassette holding states of the stocker when the type of the ink ribbon cassette on the carriage can not be identified.
Figure 63:
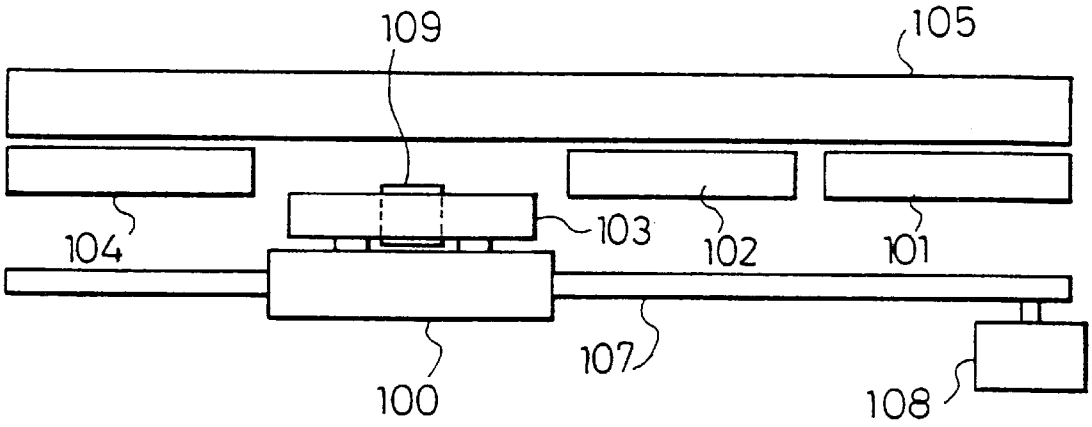
FIG. 63 is an explanatory view illustrating a conventional ink ribbon cassette automatic changer printer.
Figure 64:
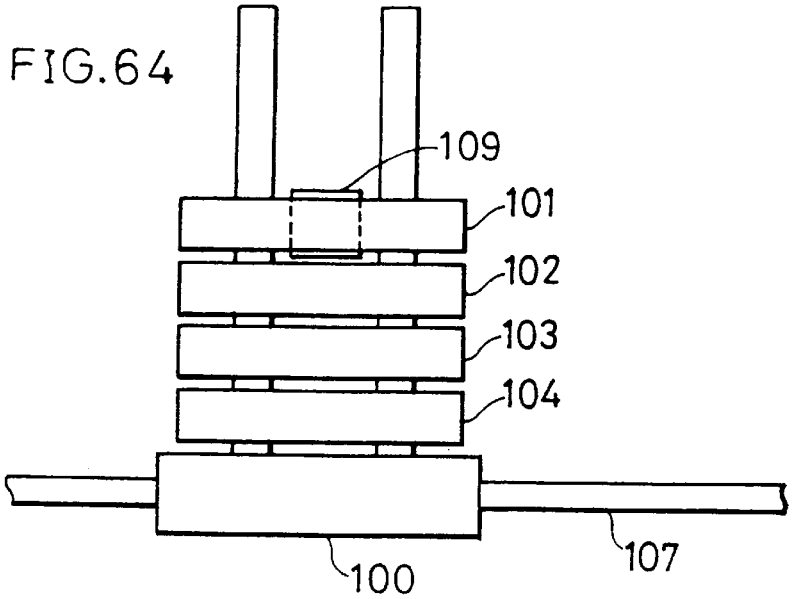
FIG. 64 is a plane view illustrating a conventional printer.
Figure 65:
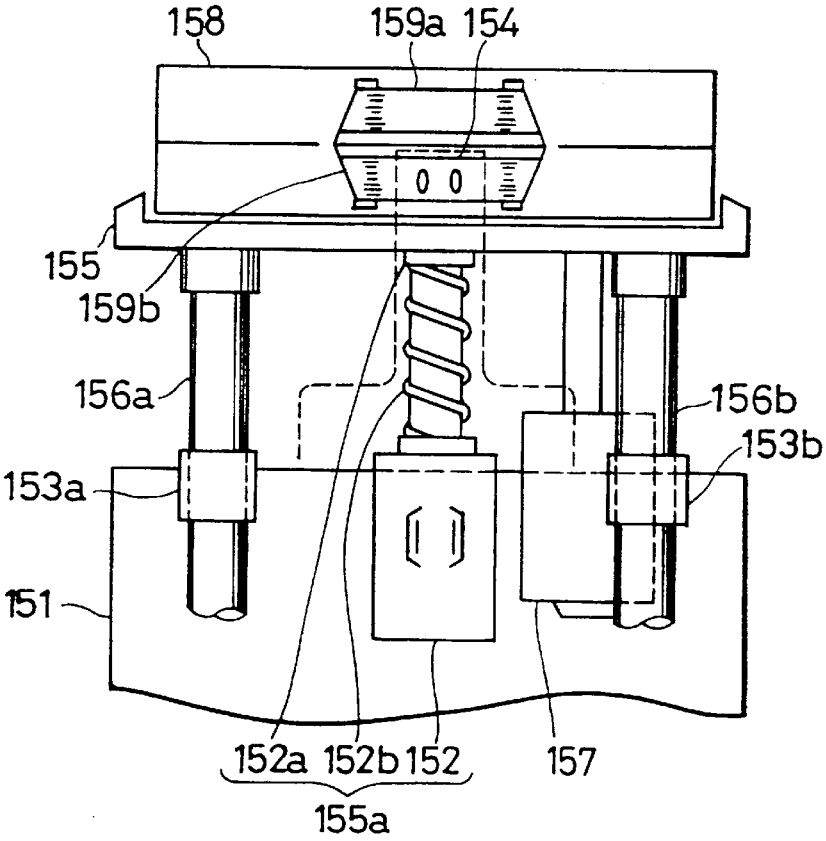
FIG. 65 is a front view illustrating a conventional printer of JP'781 in which especially the lower side ribbon is used.
Figure 66:
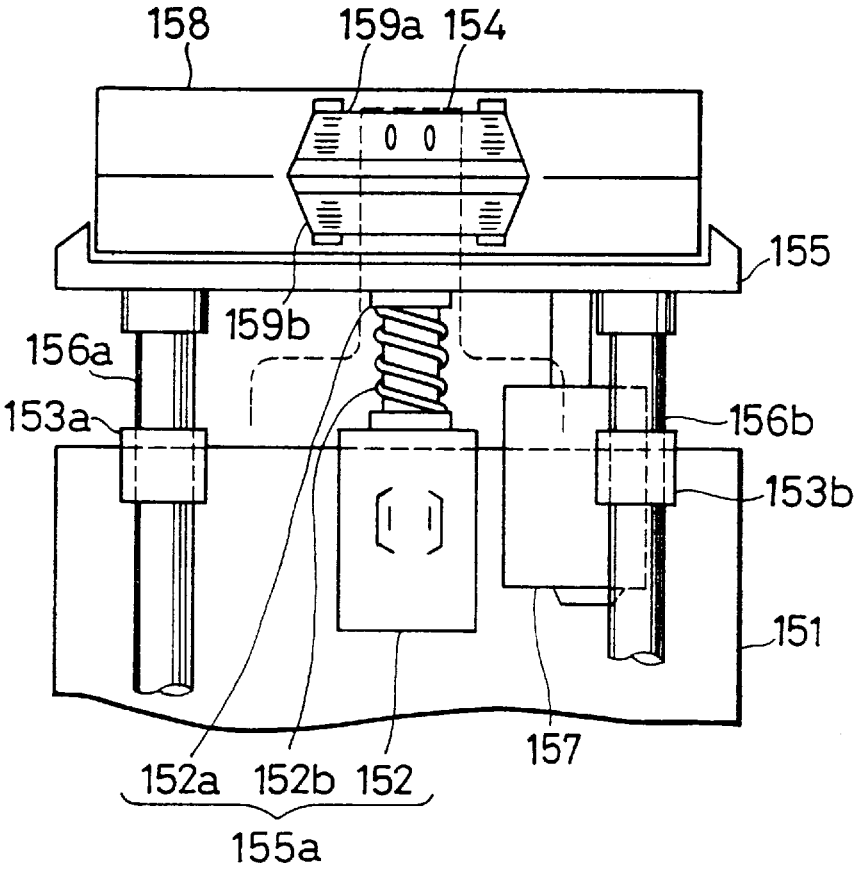
FIG. 66 is a front view illustrating a conventional printer of JP'781 in which especially the upper side ribbon is used.
Figure 67A:
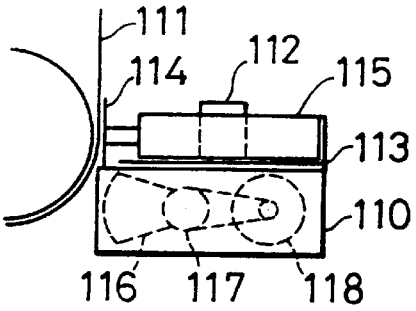
FIGS. 67(*a*) and 67(*b*) are explanatory views illustrating the states of the ink ribbon cassette of the case where the printing is carried out with respect to the plain paper and thermosensible paper by a conventional ink ribbon cassette automatic changer printer.
Figure 67B:
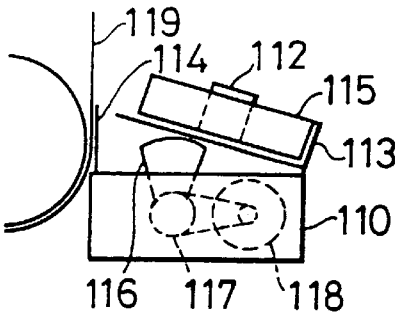
Figure 68A:
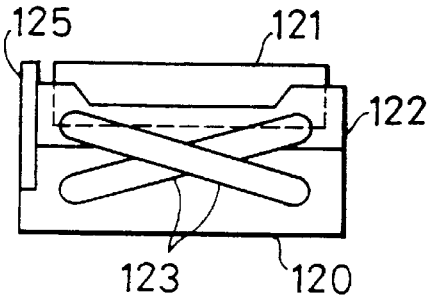
FIGS. 68(*a*) and 68(*b*) are another explanatory views illustrating the states of the ink ribbon cassette of the case where the printing is carried out with respect to the plain paper and thermosensible paper by a conventional ink ribbon cassette automatic changer printer.
Figure 68B:
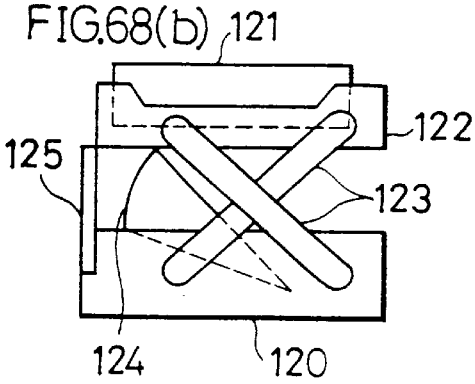
Figure 69:
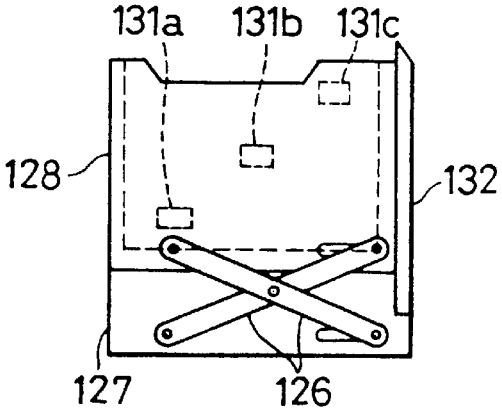
FIG. 69 is an explanatory view illustrating a carriage of a conventional multiple color thermal transfer recording apparatus in which a plurality of ink ribbon cassettes are simultaneously used.
Figure 70:
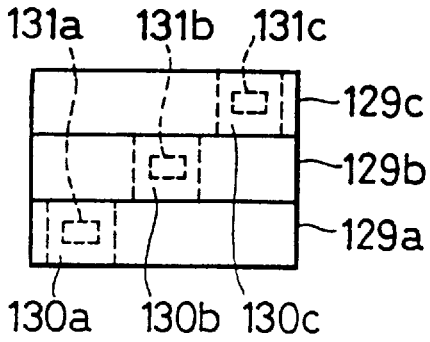
FIG. 70 is an explanatory view illustrating the relation between the detection switches of a conventional multiple color thermal transfer recording apparatus in which a plurality of ink ribbon cassettes are simultaneously used and the ink ribbon cassettes.
Figure 71:
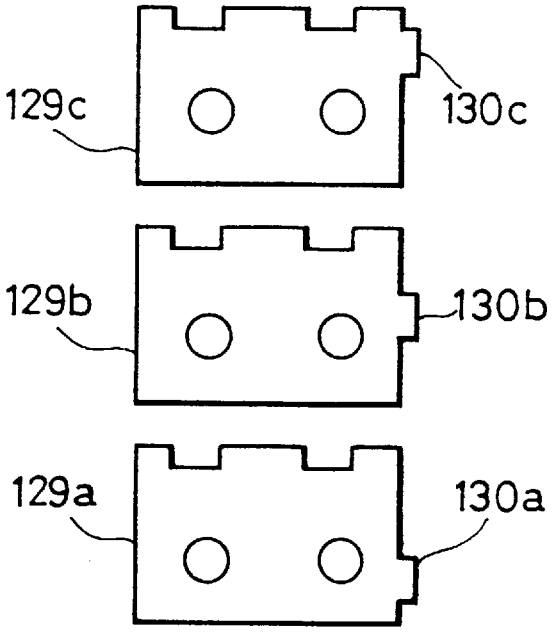
FIG. 71 is an explanatory view illustrating the types of the ink ribbon cassettes used in a conventional multiple color thermal transfer recording apparatus in which a plurality of ink ribbon cassettes are simultaneously used.
Figure 72A:
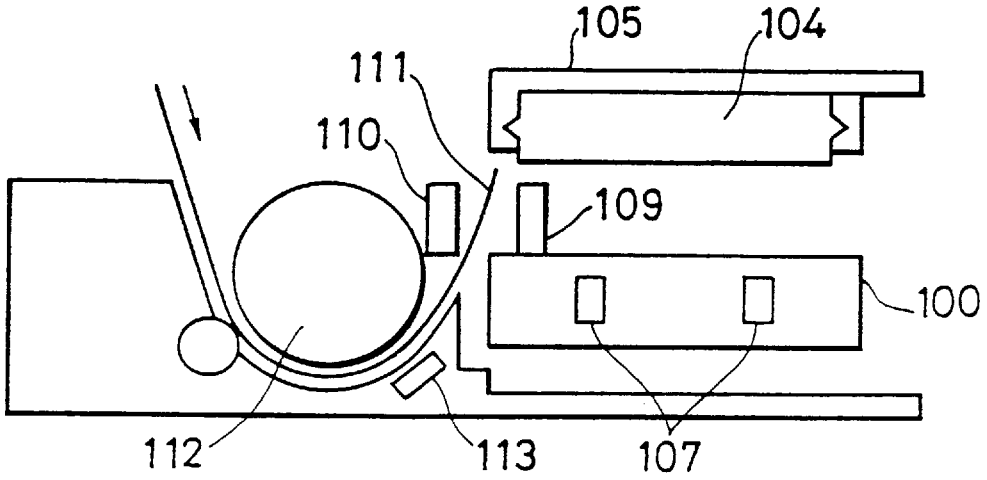
FIGS. 72(*a*) and 72(*b*) are side views illustrating a conventional ink ribbon cassette automatic changer printer.
Figure 72B:
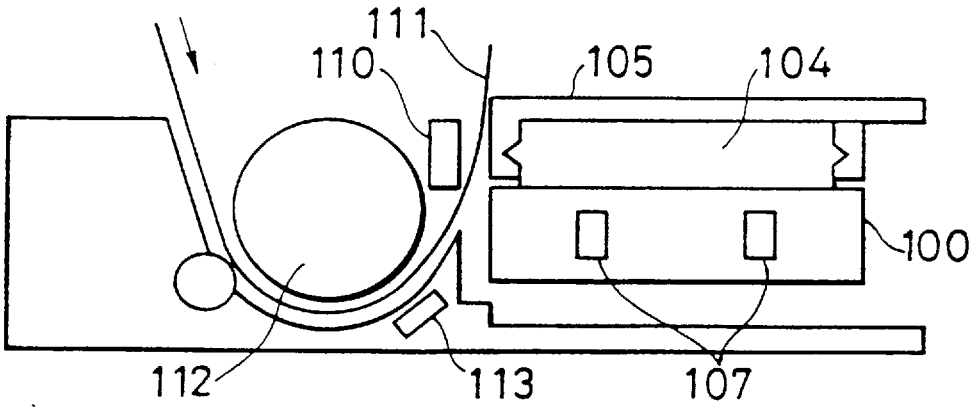

FIG. 58 is a flowchart showing the process for automatically switching the position of the changer from the carriage movable state to the ribbon exchange state upon turning ON the power switch.

This process is performed for controlling such that if the stocker 5-1 is in a lower position (due to the interruption of the power source, etc.), the stocker 5-1 is further lowered so as to ease the user to insert the print sheet to the ink ribbon cassette automatic changer printer (to prevent the sheet jamming) or to lower the height of the member for storing the ink ribbon cassette automatic changer printer.

Figure 56:
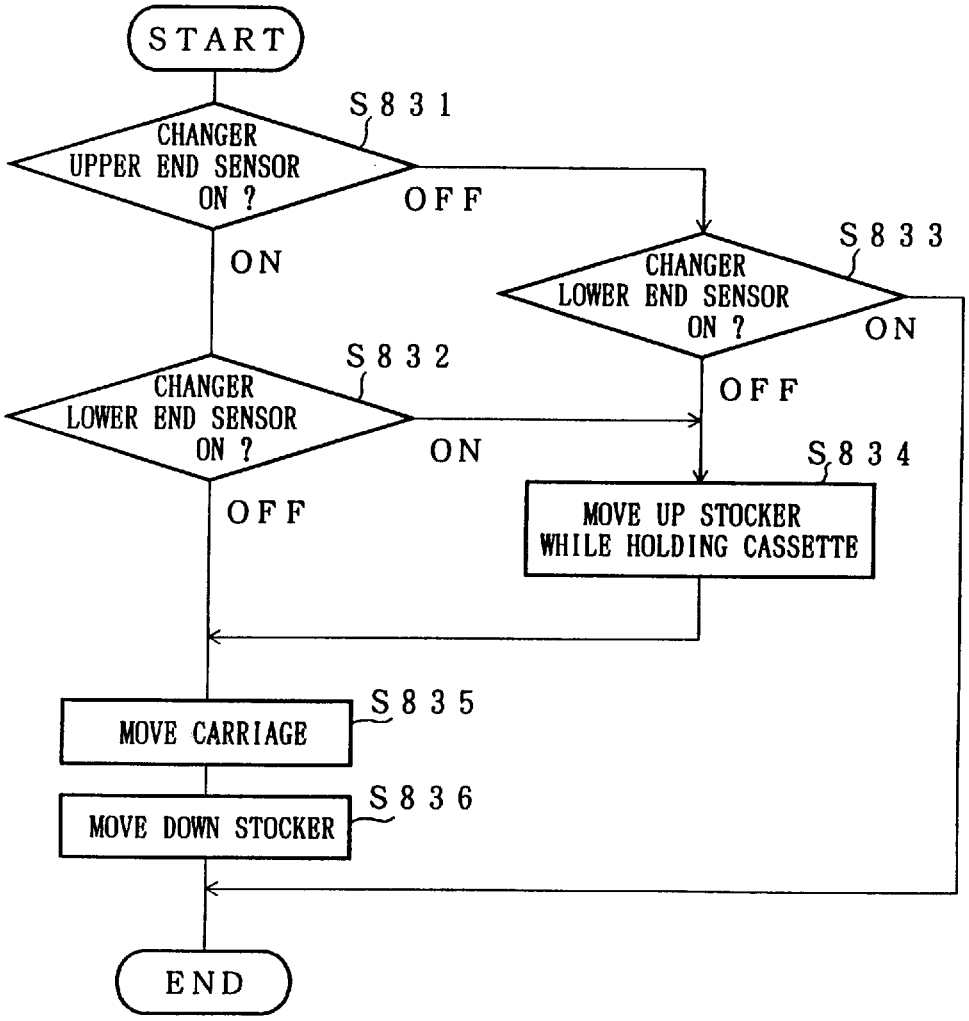
FIG. 56 is a flow chart showing what procedures are made for automatically moving the changer from the carriage movable state into the ribbon changing state when turning on the power source.

When the power switch of the ink ribbon cassette automatic changer printer system is turned ON, the operation shown in the flowchart of FIG. 56 is started. First, in S831, it is determined whether the changer upper limit sensor 5-2-2 is set in the ON position or in the OFF position. If the changer upper limit sensor 5-2-2 is set in the ON position, the sequence moves to S832, and if it is set in the OFF position, the sequence moves to S833.

In S832, it is determined whether the changer lower limit sensor 5-2-3 is set in the ON position or in the OFF position. If the changer lower limit sensor 5-2-3 is set in the ON position, the sequence moves to S834, and if it is in the OFF position, since the changer upper limit sensor 5-2-2 is in the ON position and the changer lower limit sensor 5-2-3 is in the OFF position, as can be seen from FIG. 7, it is determined that the stocker 5-1 is in the upper limit position. Then, the sequence moves to S835.

In S833, it is determined whether the changer lower limit sensor 5-2-3 is in the ON position or in the OFF position. If it is in the ON position, since the changer upper limit sensor 5-2-2 is in the OFF position, and the changer lower limit sensor 5-2-3 is in the ON position, as can be seen from FIG. 7, the stocker 5-1 is in the lower limit position. Therefore, it is determined that the power source before turning the power switch ON is properly interrupted (the power switch is turned OFF when the printing operation is not performed), thereby terminating this process. On the other hand, if the changer lower limit sensor 5-2-3 is in the OFF position, the sequence moves to S834.

In S834, both the changer upper limit sensor 5-2-2 and the changer lower limit sensor 5-2-3 are in the ON position, or both the changer upper limit sensor 5-2-2 and the changer lower limit sensor 5-2-3 are in the OFF position. Therefore, as can be seen from FIG. 7, since the stocker 5-1 is in the intermediate position, the changer 5-2 once lowers the stocker 5-1, and after placing the ink ribbon cassette on the carriage 5-3, the changer 5-2 raises the stocker 5-1. Then, the sequence moves to S835.

In S835, since the stocker 5-1 is raised to the upper limit position, and the carriage 5-3 can be moved, the carriage 5-3 is moved to the home position. This is because by moving the carriage 5-3 to the home position (the position where the black ink ribbon cassette which is usually used most often is stored), the process for initiating the printing operation can be performed efficiently.

Lastly, in S836, the changer 5-2 lowers the stocker 5-1, and this process is terminated.

By the described process, the position of the changer can be automatically switched from the carriage movable state to the ribbon exchange state upon turning ON the power switch.

Figure 57:
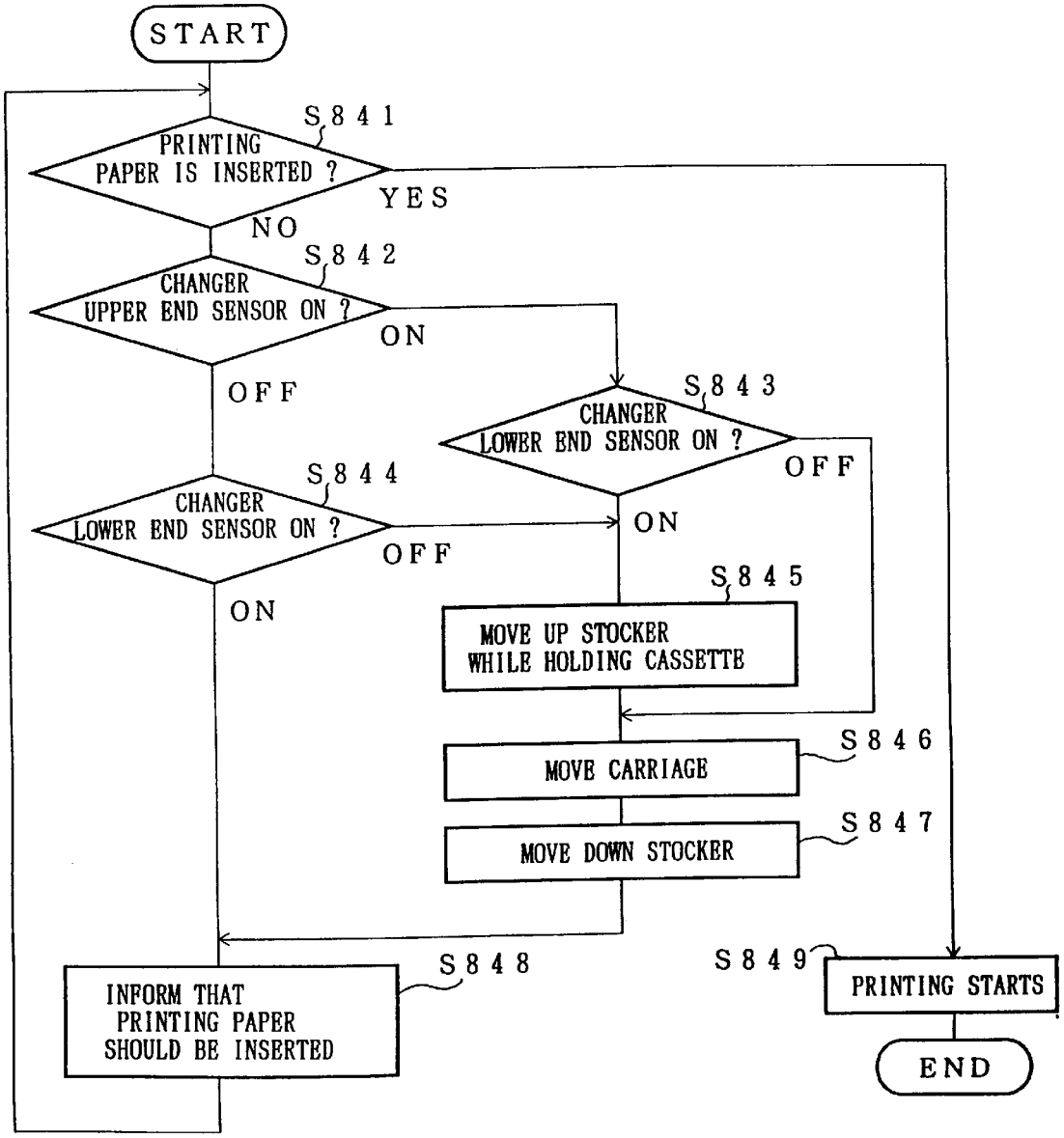
FIG. 57 is a flow chart showing what procedures are made for prohibiting the moving-up of the stocker until the printing paper is supplied.

FIG. 57 is a flowchart showing the process for preventing the stocker from being raised until the print sheet is inserted.

This process is performed for controlling the stocker 5-1 so as not to be raised until the insertion of the print sheet is confirmed in order to ease the user to insert the print sheet in the ink ribbon cassette automatic changer printer when initiating the printing operation (in order to prevent the occurrence of sheet jamming).

When the user gives an instruction for starting the printing operation in the ink ribbon cassette automatic changer printer system, or an additional sheet is required when the sheet is run out during the printing operation, the process in the flowchart of FIG. 57 is started. First, in S841, it is determined whether or not the print sheet is inserted by the sheet detecting sensor 5-4-1. If the sheet is not inserted, the sequence moves to S842. On the other hand, if the sheet is inserted, the sequence moves to S849.

In S842, it is determined whether or not the changer upper limit sensor 5-2-2 is in the ON position or in the OFF position. If it is in the ON position, the sequence moves to S843, and if it is in the OFF position, the sequence moves to S844.

In S843, it is determined whether or not the changer lower limit sensor 5-2-3 is in the ON position or in the OFF position. If the changer lower limit sensor 5-2-3 is in the ON position, the sequence goes to S845. On the other hand, if the changer lower limit sensor 5-2-3 is in the OFF position, since the-changer upper limit sensor 5-2-2 is in the ON position, and the changer lower limit sensor 5-2-3 is in the OFF position, as can be seen from FIG. 51, it is determined that the stocker 5-1 is in the upper limit position, and the sequence moves to S846.

In S844, it is determined whether or not the changer lower limit sensor 5-2-3 is in the ON position or in the OFF position. If the changer lower limit sensor 5-2-3 is in the ON position, since the changer upper limit sensor 5-2-2 is in the OFF position, and the changer lower limit sensor 5-2-3 is in the ON position, as can be seen from FIG. 7, it is determined that the stocker 5-1 is in the lower limit position, and the sequence goes to S843. On the other hand, if the changer lower limit sensor 5-2-3 is in the OFF position, the sequence goes to S845.

In S845, both the changer upper limit sensor 5-2-5 and the changer lower limit sensor 4-2-3 are set in the ON position, or both the changer upper limit sensor 5-2-2 and the changer lower limit sensor 5-2-3 are set in the OFF position. Therefore, as can be seen from FIG. 7, since the stocker 5-1 is in an intermediate position, the changer 5-2 once lowers the stocker 5-1, and the stocker 5-1 holds thereon the ink ribbon cassette on the carriage $^{5}$-$^{3}$, the changer 5-2 raises the stocker 5-1.

In S846, since the stocker 5-1 is set on the upper limit position, and the carriage 5-3 can be moved, the carriage 5-2 is moved to the home position. When the kind (color) of the ink ribbon cassette to be used is known, (for example, in the case where the sheet is run out during the printing operation), it may be arranged such that the carriage 5-2 is moved right below the position in the stocker, where the ink ribbon cassette to be used is held. As a result, the time required for starting the printing operation can be shortened.

In S847, the changer 5-2 lowers the stocker 5-1, and the sequence moves to S848.

In S848, a message such as "set a print sheet in the printer", etc., is displayed on the display device 4 for urging the user to insert the print sheet. Then, the sequence moves to S841. Although it is not adopted in the present embodiment, if the insertion of the sheet is confirmed in S841, the printing operation is started in S849, and this process is terminated.

The described process is performed so as to prevent the stocker from being raised until the print sheet is inserted.

FIG. 58 is a flowchart showing the process for determining whether or not the stocker is to be raised with the ink ribbon cassette being held thereon when raising the position of the stocker at the start of the printing operation. The flowchart of FIG. 58 also shows the process for recognizing the kind of the ink ribbon cassette on the carriage based on the storing state of the ink ribbon cassette in the stocker in the case, that is to be performed when the kind of the ink ribbon cassette on the carriage cannot be recognized.

The described process is performed for controlling so as to determine whether the changer 5-2 raises the stocker 5-1 with the ink ribbon cassette held thereon or in the open state at the start of the printing operation, in order to reduce the time required for stating the printing operation.

When the kind of the ink ribbon cassette on the carriage cannot be recognized by the general method (for example, when the position of the carriage cannot be recognized immediately after the power switch is turned ON, or the ink ribbon cassette is already set on the carriage upon turning ON the power switch), the kind of the ink ribbon cassette on the carriage is recognized from the holding state of the ink ribbon cassette in the stocker.

When the user gives an instruction for starting the printing operation in the ink ribbon cassette automatic changer printer system, the process in the flowchart of FIG. 58 is started.

The example will be given through the following case. The print sheet is already inserted in the printer, the stocker 5-1 is in the lower state, and four ink ribbon cassettes are stored in the stocker 5-1 in the order of B, Y, M and C (black, yellow, magenta and cyan) from the left end. The described state is stored in the memory 3 as shown in FIG. 59.

In FIG. 58, the kind (color) of the ink ribbon cassette to be used first when starting the printing operation in 901 is recognized (black, when the color is not specified in the print data) in reference to the print data stored in the memory device 3.

In S902, it is determined whether or not the current position of the carriage 5-3 is known. If the current position of the carriage 5-3 is known, the sequence moves to S903. If not, the sequence moves to S610.

The position of the carriage 5-3 is recognized in the following manner. A carriage left limit position sensor (not shown) is provided. The carriage left limit position sensor is set in the ON position when the carriage 5-3 is moved to the left limit position. The position of the carriage 5-3 is recognized by the distance the carriage 5-3 moves from the described position (original position). Therefore, for example, when the printer is not initialized after turning ON the power switch (the carriage 5-3 is not moved to the original position), the current position of the carriage 5-3 cannot be recognized.

In S903, as the position of the carriage 5-3 is known, the kind of the ink ribbon cassette held on the carriage 5-3 is recognized based on the position of the carriage 5-3. (Since the order of storing the ink ribbon cassettes in the stocker 5-1 is stored in the memory device 3 as shown in FIG. 59, i.e., the storing order of four ink ribbon cassettes B, Y, M and C from the left end in the stocker 5-1, for example, when the stocker 5-1 is moved to the left limit position of the carriage 5-3, it can be seen that the black ink ribbon cassette is held on the carriage 5-3 from FIG. 59.

In S903, it is determined whether or not the kind (color) of the ink ribbon cassette held on the carriage 5-3 recognized in S903 is identical with the kind (color) of the ink ribbon cassette to be used when starting the printing operation. If so, the sequence moves to S908, and if not the sequence moves to S905.

In S905, since the ink ribbon cassette held on the carriage 5-3 will not be used when starting the printing operation, the changer 5-2 raises the stocker 5-1 with the ink ribbon cassette held thereon.

In S906, the carriage 5-3 is moved to the position right below the position where the ink ribbon cassette to be used first when starting the printing operation, that is recognized in S901 is held. (For example, when the kind (color) of the ink ribbon cassette recognized in S901 is cyan, it can be seen from FIG. 59 that the carriage 5-1 is moved to the right limit position).

In S907, the changer 5-2 lowers the stocker 5-1. In S908, the changer 5-2 raises the normal recording area 5-1 with the ink ribbon cassette remaining in the carriage 5-3.

In S909, since the ink ribbon cassette to be used first when starting the printing operation, which is recognized in S901 is held on the carriage 6-3, the printing operation is started using the cassette, thereby terminating this process.

On the other hand, if it is determined in S902 that the current position of the carriage 5-3 is not known, the sequence moves to S610. In S610, the ink ribbon cassette holding position of the stocker 5-1 is detected by the stocker cassette holding sensors 5-1-1 through 5-1-4 to be stored in the memory device 3. (In this example, four ink ribbon cassettes are stored in the stocker 5-1 in the order of B, Y, M and C from the left end, and thus the storing state is stored in the memory 3 as shown in FIG. 60(*a*).) 60(*a*)).

In S611, the changer 5-2 raises the stocker 5-1 with the ink ribbon cassette remaining on the carriage 5-3.

In S612, the ink ribbon cassette holding state of the stocker 5-1 is detected again by the stocker cassette holding sensors 5-1-1 through 5-1-4, to be compared with the state stored in S610. As a result of comparison, it is recognized such that the ink ribbon cassette corresponding to the position subject to a change from "exist" to "not exist" is the ink ribbon cassette held on the carriage 5-3.

In the case where the content of the memory in S610 is as shown in FIG. 60(*a*), and the, result of detection in S612 is as shown in FIG. 60(*b*), as a change occurs at the left end position, from the content stored in the memory 3 as shown in FIG. 59, it is recognized that the black ink ribbon cassette is held on the carriage 5-3.

In the case where three ink ribbon cassettes are stored on the stocker 5-1, and a single ink ribbon cassette is held on the carriage 5-3, the kind (color) of the ink ribbon cassette held on the carriage 5-3 can be recognized from the position of the empty space in the stocker 5-1, where the ink ribbon cassette is not held.

In the case where a single ink ribbon cassette is held on the carriage 5-3, and the stocker 5-1 is set in the state shown in FIG. 60(*b*), it can be recognized that the black ink ribbon cassette is held on the carriage 5-3 without comparing the state with the state shown in FIG. 60(*a*).

In S613, it is determined whether or not the kind (color) of the ink ribbon cassette held on the carriage 5-3 that is recognized in S612 is identical with the kind (color) of the ink ribbon cassette to be used first when starting the printing operation that is recognized in S901. If they are identical, the sequence moves to S909, and if not, the sequence moves to S614.

In S614, the changer 5-2 lowers the stocker 5-1, and the sequence moves to S905. Then, the same processes as described earlier are performed.

In the case of adopting the system which is nor provided with the stocker cassette holding sensors 5-1-1 through 5-1-4, if it is determined that the position of the carriage 5-3 is not known in S902, the sequence may skip to S905.

Even in the case of adopting the system provided with the stocker cassette holding sensors 5-1-1 through 5-1-4, the process for transiting to S610 is effective (the process for reducing the time required for starting the printing operation) only when the kind (color) of the ink ribbon cassette held on the carriage 5-3 is identical with the kind (color) of the ink ribbon cassette to be used first that is recognized in S901. Therefore, when there is a high possibility that they are different (for example, when the recognized color is other than "black" in S901), it is better to move to S905.

By the described process, when raising the stocker at the start of the printing operation, it is determined whether or not the ink ribbon cassette is to be raised with the ink ribbon cassette held therein. If the kind of the ink ribbon cassette on the carriage cannot be recognized, the kind of the ink ribbon cassette on the carriage is recognized from the storing state of the ink ribbon cassette in the stocker.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A printer system with an automatic ink ribbon cassette exchange system, comprising:

a carriage for holding thereon a single ink ribbon cassette;

a stocker for storing therein plural ink ribbon cassettes;

a changer for taking out an ink ribbon cassette held in a predetermined position of said stocker to be mounted on said carriage or taking out the ink ribbon cassette held on said carriage to be stored in a predetermined empty space in said stocker;

stocker state detection means for detecting whether or not said stocker is set in a predetermined position for permitting a user to exchange one of the ink ribbon cassettes on said stocker; and control means for controlling operations of said carriage and said changer, wherein when said stocker state detection means detects that said stocker is set in the predetermined position, said control means controls said changer so as not to take out one of the ink ribbon cassettes on said stocker nor install the ink ribbon cassette from said carriage in said stocker.

2. The printer system with an automatic ink ribbon cassette exchange system as set forth in claim 1, further comprising:

stocker cassette detection means for detecting that the ink ribbon cassette is held in said stocker; and informing means for informing the user of predetermined information, wherein said control means controls said carriage and said changer such that in exchanging the ink ribbon cassette, said changer takes out the ink ribbon cassette of said carriage to be installed in a predetermined position of said stocker which does not store an ink ribbon cassette, detected by said stocker cassette detection means, said stocker is moved to a predetermined position which permits the user to exchange one of the ink ribbon cassettes on said stocker for another ink ribbon cassette, and said informing means informs the user that one of the ink ribbon cassettes on said stocker is in an exchangeable state.

3. The printer system with an automatic ink ribbon cassette exchange function as set forth in claim 2, further comprising:

carriage cassette detection means for detecting whether or not the ink ribbon cassette is held on said carriage, wherein when said stocker is held in the predetermined position for permitting the user to exchange one of the ink ribbon cassettes on said stocker, said control means determines whether or not the ink ribbon cassette is mounted on said carriage based on information detected by said carriage cassette detection means to inform said informing means that the ink ribbon cassette is mounted, and controls said carriage and said changer so as not to perform a printing operation.

4. The printer system with an automatic ink ribbon cassette exchange system as set forth in claim 2, further comprising:

carriage cassette detection means for detecting whether or not the ink ribbon cassette is held on said carriage;

input means; and print mode setting means for setting a print mode based on a kind of an ink ribbon cassette stored in said stocker, wherein when said stocker is set in a predetermined position for allowing the user to exchange one of the ink ribbon cassettes on said stocker, said control means determines whether or not the ink ribbon cassette is mounted on said carriage based on information detected by said carriage cassette detection means and informs said informing means to input the kind of the ink ribbon cassette mounted on said carriage and sets the print mode in accordance with the kind of the ink ribbon cassette inputted by said input means in said print mode set means.

* * * * *